US007188689B2

(12) United States Patent
Maxwell et al.

(10) Patent No.: US 7,188,689 B2
(45) Date of Patent: Mar. 13, 2007

(54) VARIABLE GAUGE DRILLING APPARATUS AND METHOD OF ASSEMBLY THEREFOR

(75) Inventors: Terrance Dean Maxwell, Leduc (CA); Julio Garcia, Edmonton (CA); Nestor Humberto Gil, Edmonton (CA); Bryan James Restau, Beaumont (CA); Richard T. Hay, St. Albert (CA); Edward James Cargill, Devon (CA)

(73) Assignee: Halliburton Energy Services, Inc., Houston, TX (US)

( * ) Notice: Subject to any disclaimer, the term of this patent is extended or adjusted under 35 U.S.C. 154(b) by 313 days.

(21) Appl. No.: 10/777,205

(22) Filed: Feb. 13, 2004

(65) Prior Publication Data

US 2005/0098353 A1 May 12, 2005

(30) Foreign Application Priority Data

Nov. 7, 2003 (CA) ..... 2448723

(51) Int. Cl.
*E21B 17/10* (2006.01)

(52) U.S. Cl. ..... 175/325.3; 175/325.4; 175/76; 166/241.6

(58) Field of Classification Search .. 175/325.1–325.6, 175/76; 166/241.6
See application file for complete search history.

(56) References Cited

U.S. PATENT DOCUMENTS 2,210,824 A 8/1940 Walker, Sr.
2,783,028 A 2/1957 Jamison et al.
3,180,437 A 4/1965 Kellner et al.
3,572,450 A * 3/1971 Thompson ..... 175/76
3,823,787 A 7/1974 Haworth et al.

(Continued)

FOREIGN PATENT DOCUMENTS

CA 1177057 10/1984

(Continued)

OTHER PUBLICATIONS

Warren T: "Technology Gains Momentum," Oil and Gas Journal, US, Pennwell Publishing Co., Tulsa, vol. 96, No. 51, Dec. 21, 1998, pp. 101-105.

(Continued)

*Primary Examiner*—David Bagnell
*Assistant Examiner*—Giovanna M Collins
(74) *Attorney, Agent, or Firm*—Terrence N. Kubarchuk; William Shull; Michael D. McCully

(57) ABSTRACT

A variable gauge drilling apparatus and a method for assembling a variable gauge drilling apparatus for insertion in a subject borehole. The variable gauge drilling apparatus includes: an apparatus housing having a housing size which is suitable for insertion in a subject borehole which has a subject borehole size within a design range of borehole sizes; a plurality of interchangeable borehole engaging devices having different device sizes for mounting on the apparatus housing to provide the drilling apparatus with a drilling apparatus size within a range of drilling apparatus sizes, wherein the range of drilling apparatus sizes is compatible for use of the drilling apparatus within the design range of borehole sizes; and a universal borehole engaging device mount located on the apparatus housing, wherein the mount is configured to accept for mounting any one of the plurality of interchangeable borehole engaging devices.

31 Claims, 25 Drawing Sheets

U.S. PATENT DOCUMENTS

| | | | | |
|---|---|---|---|---|
| 3,896,667 | A | | 7/1975 | Jeter |
| 3,967,680 | A | | 7/1976 | Jeter |
| 4,185,704 | A | | 1/1980 | Nixon, Jr. |
| 4,314,615 | A | | 2/1982 | Sodder, Jr. et al. |
| 4,377,207 | A | | 3/1983 | Kofahl |
| 4,428,626 | A | | 1/1984 | Blau et al. |
| 4,512,422 | A | | 4/1985 | Knisley |
| 4,549,613 | A | | 10/1985 | Case |
| 4,612,987 | A | | 9/1986 | Cheek |
| 4,655,289 | A | | 4/1987 | Schoeffler |
| 4,714,110 | A | | 12/1987 | Dysarz |
| 5,034,929 | A | | 7/1991 | Cobern et al. |
| 5,060,737 | A | | 10/1991 | Mohn |
| 5,139,094 | A | | 8/1992 | Prevedel et al. |
| 5,186,264 | A | | 2/1993 | du Chaffaut |
| 5,293,945 | A | | 3/1994 | Rosenhauch et al. |
| 5,307,885 | A | | 5/1994 | Kuwana et al. |
| 5,314,030 | A | | 5/1994 | Peterson |
| 5,353,884 | A | | 10/1994 | Misawa et al. |
| 5,419,395 | A | * | 5/1995 | Harvey et al. ..... 166/241.6 |
| 5,447,200 | A | * | 9/1995 | Dedora et al. ..... 166/311 |
| 5,447,207 | A | | 9/1995 | Jones |
| 5,467,834 | A | | 11/1995 | Hughes et al. |
| 5,547,031 | A | | 8/1996 | Warren et al. |
| 5,603,386 | A | | 2/1997 | Webster |
| 5,685,379 | A | | 11/1997 | Barr et al. |
| 5,706,905 | A | | 1/1998 | Barr |
| 5,758,732 | A | | 6/1998 | Leiv |
| 5,803,185 | A | | 9/1998 | Barr et al. |
| 5,875,859 | A | | 3/1999 | Ikeda et al. |
| 5,931,239 | A | | 8/1999 | Schuh |
| 6,158,529 | A | | 12/2000 | Dorel |
| 6,158,533 | A | | 12/2000 | Gillis et al. |
| 6,227,313 | B1 | | 5/2001 | Davis et al. |
| 6,244,361 | B1 | | 6/2001 | Comeau et al. |
| 6,267,185 | B1 | | 7/2001 | Mougel et al. |
| 6,318,462 | B1 | | 11/2001 | Tessier |
| 6,382,333 | B1 | | 5/2002 | Murray |
| 2002/0053470 | A1 | | 5/2002 | Noe et al. |
| 2002/0185314 | A1 | | 12/2002 | Cargill et al. |

FOREIGN PATENT DOCUMENTS

| | | |
|---|---|---|
| CA | 2298375 | 9/2000 |
| CA | 2314575 | 1/2001 |
| EP | 0 452 126 A2 | 10/1991 |
| EP | 0 497 422 A1 | 8/1992 |
| EP | 0718641 A | 6/1996 |
| EP | 1371810 A1 | 12/2003 |
| GB | 2017191 | 10/1979 |
| GB | 2172324 | 9/1986 |
| GB | 2172325 | 9/1986 |
| GB | 2177738 | 1/1987 |
| GB | 2307537 | 5/1997 |
| GB | 2356207 | 5/2001 |
| WO | WO 90/07625 | 7/1990 |
| WO | WO 90/08245 | 7/1990 |
| WO | WO 98/34003 | 8/1998 |
| WO | WO 99/24688 | 5/1999 |
| WO | WO 00/65198 | 11/2000 |
| WO | WO 01/11191 A1 | 2/2001 |

OTHER PUBLICATIONS

"LoTAD (Trademark), Mechanical Friction- and Wear- Reduction Running String," product description of Weatherford Drilling & Intervention Services website www.weatherford.com, 2 pp.
LoTAD (Trademark), product description of Weatherford Drilling & Intervention Services website www.weatherford.com, 2pp.

* cited by examiner

VARIABLE GAUGE DRILLING APPARATUS AND METHOD OF ASSEMBLY THEREFOR

TECHNICAL FIELD

The present invention relates to a downhole drilling apparatus having a variable gauge such that the drilling apparatus provides a range of drilling apparatus sizes compatible for use within a range of borehole sizes in which the drilling apparatus is to be inserted. Further, the present invention relates to a method for assembling a variable gauge drilling apparatus for insertion in a borehole having a specific borehole size.

BACKGROUND OF THE INVENTION

Downhole devices are often used during drilling operations which are required to engage the wall of the borehole. These borehole engaging devices are typically located along the length of the drilling string and extend radially or outwardly therefrom to engage the borehole wall to perform their specific intended function.

Such downhole borehole engaging devices include stabilizers, underreamers and anti-rotation devices. Stabilizers are typically located at various positions along the length of the drilling string to provide lateral support for the drilling string and to centralize the drilling string in the borehole. The stabilizer may be comprised of blades, pads or any other borehole engaging member capable of supporting and centralizing the drilling string, which members tend to be fixed in an extended position extending outwardly or radially from the drilling string. When using a stabilizer, it is desirable that each of the blades, pads or other borehole engaging members engage the borehole wall concurrently or simultaneously in order to support and centralize the drilling string. Thus, the size or gauge of the stabilizer is selected to be compatible with the size or gauge of the borehole in which it is to be used such that the stabilizer can perform its intended function.

Underreamers are typically utilized in the drilling string in order to expand the gauge or diameter of the borehole to a dimension which is greater then the gauge or diameter which is attainable with only a drill bit. The underreamer may be comprised of blades or any other borehole engaging member capable of reaming the borehole wall in the desired manner, which borehole engaging members preferably engage the wall such that the gauge or diameter of the borehole can be increased relatively evenly or consistently. The borehole engaging members of the underreamer may be fixed in an extended position, such as in the stabilizer, or the members may be movable between an extended position and a retracted position. The member is preferably capable of being locked in the extended position to perform the reaming function. Thus, as with the stabilizer, the size or gauge of the underreamer is selected to be compatible with the size or gauge of the borehole in which it is to be used such that the underreamer can perform its intended function.

Anti-rotation devices or rotation restraining devices are often used during drilling operations to enable a portion of the drilling string, such as a housing of a downhole motor, a rotary steerable device or system or other drilling apparatus, to resist rotation relative to the wall of the borehole. For instance, a drilling string or a drilling shaft with an attached drill bit may be rotated to perform the drilling operation, while it is desirable to resist the rotation of a housing surrounding the drilling string or drilling shaft in order to provide for or to enhance the stability and/or steerability of the drill bit.

In such applications, the drilling string or drilling shaft typically rotates within the housing while an anti-rotation device associated with the housing engages the borehole wall in order to resist the rotation of the housing. Anti-rotation or rotation restraining devices are commonly used in conjunction with downhole motor assemblies and rotary steerable drilling systems, such as that shown in U.S. Pat. No. 6,244,361 issued Jun. 12, 2001 to Comeau et. al.

A typical anti-rotation device is comprised of a number of rotation restraining members such as blades, pads, rollers or pistons which are arranged about the circumference of the housing and protrude therefrom in order to engage the borehole wall. In order to function in the desired manner and inhibit the rotation of the housing, at least one of the rotation restraining members must engage the borehole wall. These members may be movable between extended and retracted positions to facilitate movement of the anti-rotation device through the borehole. Further, as with the stabilizer and the underreamer, the size or gauge of the housing and the anti-rotation device, including the protruding rotation restraining members, are selected to be compatible with the size or gauge of the borehole in which the anti-rotation device is to be used such that the anti-rotation device can perform its intended function.

More particularly, with respect to the anti-rotation device, the housing typically has a fixed diameter. The rotation restraining members are affixed or fitted within the housing and typically have a limited range of radial movement relative to the housing. Thus, the anti-rotation device has a pre-determined or relatively fixed gauge, size or dimension suitable for use within one selected or desired gauge of borehole. In other words, the drilling apparatus, including the anti-rotation device affixed or fitted within the housing thereof, must be assembled for each specific size or gauge of borehole in which it is to be used. For instance, to utilize the drilling apparatus in boreholes having different gauges or within a single borehole having a varying gauge, the housing and the anti-rotation device affixed thereto must be selected to have a size or configuration compatible for insertion in each differing borehole gauge. Accordingly, a different drilling apparatus having a different configuration must be provided for each borehole gauge or the drilling apparatus must be substantially disassembled and re-assembled to be suitable for each borehole gauge.

As a result, there is a need for a variable gauge drilling apparatus for use in drilling operations. Further, there is a need for a variable gauge drilling apparatus comprised of a borehole engaging device, such as a stabilizer, an underreamer or an anti-rotation device, in which the gauge of the drilling apparatus can be relatively easily varied to permit its use in a range of borehole sizes or gauges such that the borehole engaging device engages the borehole wall to perform its intended function.

SUMMARY OF THE INVENTION

The within invention is comprised of a variable gauge drilling apparatus and a method for assembling the variable gauge drilling assembly for insertion in a subject borehole. The variable gauge drilling apparatus preferably comprises a portion, element or component of a drilling string for insertion in a borehole. Further, the drilling apparatus may comprise a portion, element or component of another downhole tool or device comprising the drilling string. For instance, the variable gauge drilling apparatus may comprise or form a component of such downhole drilling tools or devices as a downhole motor assembly, a rotary steerable system or other directional drilling apparatus or any other apparatus or sub comprising the drilling string.

The variable gauge drilling apparatus is suitable for use in a selected or predetermined design range of borehole sizes or gauges. The method provides for the assembly of the variable gauge drilling assembly for insertion in a subject borehole having a subject borehole size within the design range of borehole sizes. The borehole size or gauge is determined by a diameter of the borehole.

Further, the drilling apparatus has a drilling apparatus size or gauge which is variable within a selected or predetermined range of drilling apparatus sizes, wherein the range of drilling apparatus sizes is compatible for use of the drilling apparatus within the design range of borehole sizes. The drilling apparatus size refers to a maximum cross-sectional dimension of the drilling apparatus. Specifically, the drilling apparatus size is determined by a drilling apparatus diameter defined by the diameter of a circle closely encompassing or enclosing the maximum outer cross-sectional perimeter of the drilling apparatus.

Further, the drilling apparatus size is varied to a selected drilling apparatus size suitable for insertion in the subject borehole. The selected drilling apparatus size is within the range of drilling apparatus sizes and is selected such that the drilling apparatus is capable of, or suitable for, engaging the wall of the borehole in a desired manner upon its insertion in the subject borehole. The manner in which the drilling apparatus engages the borehole wall is determined largely be the relationship between, or the relative dimensions of, the selected drilling apparatus size and the subject borehole size. Further, the desired manner in which the drilling apparatus engages the borehole wall is dependent upon the intended function of the drilling apparatus and the purpose for which the drilling apparatus engages the borehole such as stabilizing and/or centralizing the drilling string in the borehole, reaming the borehole to a larger gauge or restraining the rotation of a component of the drilling string.

In a first aspect of the invention, the invention is comprised of a variable gauge drilling apparatus comprising:

(a) an apparatus housing having a housing size which is suitable for insertion in a subject borehole which has a subject borehole size within a design range of borehole sizes;

(b) a plurality of interchangeable borehole engaging devices having different device sizes for mounting on the apparatus housing to provide the drilling apparatus with a drilling apparatus size within a range of drilling apparatus sizes, wherein the range of drilling apparatus sizes is compatible for use of the drilling apparatus within the design range of borehole sizes; and (c) a universal borehole engaging device mount located on the apparatus housing, wherein the mount is configured to accept for mounting any one of the plurality of interchangeable borehole engaging devices.

The variable gauge apparatus is designed and adapted for use within a design range of borehole sizes so that the same apparatus may be used in different boreholes with a variety of drilling string configurations. Once a subject borehole, having a subject borehole size within the design range of boreholes sizes, is selected, the appropriate or compatible interchangeable borehole engaging device must simply be mounted on the apparatus housing. The appropriate or compatible interchangeable borehole engaging device provides the drilling apparatus with a drilling apparatus size compatible with the subject borehole size such that the drilling apparatus is suitable for use in the subject borehole to engage the borehole wall and perform its intended function.

The apparatus housing is preferably comprised of one integral member, element, component or conduit for mounting of the interchangeable borehole engaging device therewith. However, the apparatus housing may be comprised of a plurality of members, elements, components or conduits permanently or detachably connected, affixed or fastened together to form the apparatus housing. Further, as stated, the apparatus housing has a housing size which is suitable for insertion in the subject borehole. The housing size is selected such that the apparatus housing is suitable for insertion in any borehole size within the design range of borehole sizes. As the subject borehole size is within the design range of borehole sizes, the same apparatus housing may be used in any of a variety of subject boreholes.

In order to be suitable for insertion in the subject borehole, it necessarily follows that the housing size must be smaller or less than the subject borehole size. In the preferred embodiment, the apparatus housing is preferably substantially circular on cross-section to be compatible with the circular shape of the borehole. Thus, in the preferred embodiment, the housing size refers to the cross-sectional diameter of the apparatus housing. Accordingly, the diameter of the apparatus housing is less than the diameter of the subject borehole. Further, the diameter of the apparatus housing is preferably selected relative to the diameter of the subject borehole to provide a sufficient annulus or clearance space between the apparatus housing and the borehole wall to permit any required or desired fluid flow, such as drilling mud or other drilling fluids, through the annulus during the drilling operation. In other words, the apparatus housing is selected so that the housing size is smaller than the borehole size to an extent sufficient to prevent blockage of a clearance space between the apparatus housing and the borehole during use of the drilling apparatus.

The interchangeable borehole engaging device may be comprised of any device, tool or mechanism intended for use downhole in a manner such that the device, or a portion thereof, engages the wall of the borehole during use either continuously or intermittently. For instance, the interchangeable borehole engaging device may be comprised of a stabilizer or stabilizing device for stabilizing and/or centralizing the drilling string in the borehole during the drilling operation. In this case, the stabilizing device is preferably comprised of one or more stabilizing members, such as blades or pads or other borehole engaging members, which extend from the apparatus housing when the device is mounted in the mount to engage the borehole to perform a stabilizing and/or centralizing function. Accordingly, in this case, the plurality of interchangeable borehole engaging devices is comprised of a plurality of interchangeable stabilizing devices. Further, each of the plurality of interchangeable stabilizing devices is comprised of a stabilizer assembly for mounting in the mount on the apparatus housing.

Alternately, the interchangeable borehole engaging device may be comprised of an underreaming device for reaming or enlarging the borehole during the drilling operation. In this case, the underreaming device is preferably comprised of one or more reaming members, such as blades or other borehole engaging members, which extend from the apparatus housing when the device is mounted in the mount to engage the borehole to perform a borehole reaming or enlarging function. Accordingly, in this case, the plurality of interchangeable borehole engaging devices is comprised of a plurality of interchangeable underreaming devices. Further, each of the plurality of interchangeable underreaming devices is comprised of an underreaming assembly for mounting in the mount on the apparatus housing.

However, in the preferred embodiment, the interchangeable borehole engaging device is comprised of a rotation restraining device for restraining the rotation of the apparatus housing in the borehole during the drilling operation. In this case, the universal borehole engaging device mount may be referred to as a universal rotation restraining device mount. Further, the rotation restraining device is preferably comprised of one or more rotation restraining members, comprised of a plurality of rollers, pistons, blades, pads or other borehole engaging elements or members, which extend from the apparatus housing when the device is mounted in the mount to engage the borehole to perform a rotation restraining or anti-rotation function. Accordingly, in this case, the plurality of interchangeable borehole engaging devices is comprised of a plurality of interchangeable rotation restraining devices. Further, each of the plurality of interchangeable rotation restraining devices is preferably comprised of a rotation restraining assembly for mounting in the mount on the apparatus housing. In the preferred embodiment, each of the plurality of interchangeable rotation restraining devices is comprised of a plurality of rotation restraining assemblies for mounting on the apparatus housing.

The plurality of interchangeable borehole engaging devices have different device sizes for mounting on the apparatus housing in order to provide the drilling apparatus with a selected drilling apparatus size. The selected drilling apparatus size is within a predetermined range of drilling apparatus sizes which is compatible for use of the drilling apparatus within the design range of borehole sizes. In other words, the different device sizes permit the selection of a selected borehole engaging device which will provide a desired or selected drilling apparatus size when mounted on the apparatus housing which is compatible for use of the drilling apparatus within the subject borehole.

Thus, the housing size in combination with the device size provides the drilling apparatus size. Preferably, the housing size for the drilling apparatus does not vary. As a result, the device size is varied in order to achieve the desired or selected drilling apparatus size. The device size is varied by interchanging the plurality of interchangeable borehole engaging devices having different device sizes. In the preferred embodiment, the housing size is determined by a diameter of the apparatus housing on cross-section. Further, the drilling apparatus size is also preferably determined by a cross-sectional dimension. In the preferred embodiment, the drilling apparatus size is determined by a drilling apparatus diameter defined by the diameter of a circle closely encompassing or enclosing the maximum outer cross-sectional perimeter of the drilling apparatus. The device size provides the difference between the diameter of the apparatus housing and the diameter of the drilling apparatus as defined above.

The universal borehole engaging device mount is located on the apparatus housing. The mount is referred to as being universal as it is configured or otherwise adapted to accept for mounting any one of the plurality of interchangeable borehole engaging devices. Thus, as the drilling apparatus is required for use between subject boreholes having different subject borehole sizes, one interchangeable borehole engaging device having one device size may be removed and simply be replaced with another interchangeable borehole engaging device having a different device size.

The universal mount is located on the apparatus housing and may be comprised of any mechanism, structure, device or means capable of and suitable for mounting one of the interchangeable borehole engaging devices with the apparatus housing. However, preferably, the mount is comprised of a pocket defined by an exterior surface of the apparatus housing. The pocket may have any shape, configuration and dimensions compatible with the borehole engaging device and capable of receiving at least a portion of the borehole engaging device therein. Further, the specific dimensions of the pocket will also be dependent upon the configuration of the apparatus housing including the housing size. Finally, the pocket may be oriented in the exterior surface of the apparatus housing in any suitable manner permitting the receipt of the borehole engaging device therein. In the preferred embodiment, the pocket is axially aligned. In other words, the pocket is preferably aligned with a longitudinal axis of the apparatus housing.

Preferably, the plurality of interchangeable borehole engaging devices is comprised of a plurality of interchangeable rotation restraining devices and each of the plurality of interchangeable rotation restraining devices is comprised of a rotation restraining assembly for mounting in the pocket. More preferably, each of the plurality of interchangeable rotation restraining devices is comprised of a plurality of rotation restraining assemblies and the mount is comprised of a plurality of pockets. In the preferred embodiment, each of the plurality of interchangeable rotation restraining devices is comprised of at least three rotation restraining assemblies and the mount is comprised of at least three corresponding pockets. In this case, each of the plurality of pockets is preferably axially aligned for receipt of the rotation restraining assembly therein. In other words, each pocket is preferably aligned with the longitudinal axis of the apparatus housing. More particularly, each pocket defines a longitudinal axis, wherein the longitudinal axis of each pocket is substantially parallel with the longitudinal axis of the apparatus housing.

Where the interchangeable rotation restraining device is comprised of a plurality of rotation restraining assemblies for mounting in a plurality of pockets, the rotation restraining assemblies and their respective pockets are preferably spaced about the circumference of the apparatus housing. More preferably, the rotation restraining assemblies and their respective pockets are preferably substantially evenly spaced about the circumference of the apparatus housing to enhance the performance of the rotation restraining device. In addition, if desired, at least two of the rotation restraining carriage assemblies may be spaced about the circumference of the apparatus housing and axially or longitudinally along the apparatus housing so that the rotation restraining assemblies are staggered or offset axially along the apparatus housing.

With respect to drilling apparatus size, in the preferred embodiment comprising a plurality of rotation retraining assemblies, the drilling apparatus size determined by the drilling apparatus diameter is particularly defined by the diameter of a circle closely encompassing or enclosing all of the rotation restraining assemblies when mounted in their respective pockets on cross-section of the drilling apparatus when the rotation restraining assemblies are in an extended position as discussed further below.

Preferably, each rotation restraining assembly is comprised of an assembly housing and a rotation restraining member connected with the assembly housing. The assembly housing is preferably comprised of one integral member, element or component for connection of the rotation restraining member therewith. However, the assembly housing may be comprised of a plurality of members, elements or components permanently or detachably connected, affixed or fastened together to form the assembly housing.

Further, the assembly housing has an assembly housing size, wherein the assembly housing size defines the device size. Specifically, the assembly housing size of the rotation restraining assembly differs between the interchangeable rotation restraining devices such that the plurality of interchangeable rotation restraining devices have different device sizes. In other words, the different device sizes of the plurality of interchangeable rotation restraining devices are preferably determined by varying the size of the assembly housings comprising the rotation restraining assemblies of each of the interchangeable rotation restraining devices.

The rotation restraining member may be connected with the assembly housing by any mechanism, structure, device or means for releasably or permanently fastening, affixing or otherwise securing the rotation restraining member with the assembly housing. However, preferably, the rotation restraining member is releasably or removably connected with the assembly housing to facilitate the maintenance, repair and replacement of the rotation restraining member.

Any type or configuration of rotation restraining member capable of engaging the borehole wall to restrain or inhibit the rotation of the apparatus housing within the borehole may be used. For instance, each rotation restraining member may be comprised of one or more rollers, pistons, blades, pads or other borehole engaging elements or members. The rotation restraining member preferably extends outwardly or radially from the assembly housing, which assembly housing is mounted within the pocket defined by the exterior surface of the apparatus housing, for engagement with the borehole wall. Thus, each of the rollers, pistons, blades, pads or other borehole engaging elements or members comprising the rotation restraining assembly extends outwardly or radially towards the borehole wall. Each of the rollers, pistons, blades, pads or other borehole engaging elements or members may further be aligned longitudinally with a longitudinal axis of the assembly housing. Alternately, each of the rollers, pistons, blades, pads or other borehole engaging elements or members may be angled or inclined longitudinally such that the borehole engaging element or member may be acted upon by annulus fluid flow in the clearance space between the apparatus housing and the borehole wall during the drilling operations.

In the preferred embodiment, each rotation restraining member is comprised of a plurality of rollers. Further, each of the rollers preferably has an axis of rotation substantially perpendicular to a longitudinal axis of the apparatus housing and is oriented such that the roller is capable of rolling about the axis of rotation of the roller in response to a force exerted on the roller substantially in the direction of the longitudinal axis of the apparatus housing.

Preferably each roller is comprised of a peripheral surface about a circumference of the roller and preferably the peripheral surface is comprised of an engagement surface for engaging the borehole wall to restrain rotation of the apparatus housing. The engagement surface may have any shape or configuration capable of contacting and engaging the borehole wall. Preferably, the engagement surface is comprised of the peripheral surface of the roller being tapered.

Each rotation restraining member may be connected with the assembly housing in a fixed radial position extending from the assembly housing, but preferably the rotation restraining member is capable of movement between a retracted position and an extended position. In the extended position, the rotation restraining member, and thus the plurality of rollers, extend radially or outwardly from the assembly housing for engaging the borehole wall. Movement in an opposite direction inwardly towards the retracted position facilitates the movement of the drilling apparatus through the borehole.

Any mechanism or structure may be operatively associated with the rotation restraining member to permit the movement of the rotation restraining member between the retracted and extended positions. However, preferably, the rotation restraining assembly is further comprised of a biasing device for biasing the rotation restraining member toward the extended position. The biasing device may be comprised of any apparatus or mechanism which can perform the biasing function or which can urge the rotation restraining member towards the extended position.

Preferably the biasing device is comprised of at least one spring which acts between the assembly housing and the rotation restraining member. Alternatively or in addition, the biasing device or spring may extend through the assembly housing to act upon or engage the device mount or the pocket defined by the exterior surface of the apparatus housing. In other words, the biasing device or spring may act between the rotation restraining member and the device mount, and may particularly act between the rotation restraining member and its respective pocket. As a further alternative, the rotation restraining assembly may be comprised of an actuator or actuator device or mechanism for moving the rotation restraining member between the retracted and extended positions.

The drilling apparatus is also preferably comprised of a securing mechanism for securing the interchangeable borehole engaging device with the mount, being the pocket in the preferred embodiment. The securing mechanism may be comprised of any fastener or mechanism, device or means for removably or releasably fastening or affixing the borehole engaging device with the pocket such that the borehole engaging devices are interchangeable. In the preferred embodiment, the drilling apparatus is further comprised of a securing mechanism for securing the rotation restraining assembly in the pocket or for securing each rotation restraining assembly in its respective pocket. Thus, the securing mechanism may be comprised of any fastener or mechanism, device or means, or a combination thereof, for removably or releasably fastening or affixing the rotation restraining assembly in the pocket.

For instance, the securing mechanism may be comprised of at least one fastener, and preferably, a plurality of fasteners. Any type of fastener or combination of types of fasteners capable of securing the rotation restraining assembly in the pocket may be used. Further, any number of such fasteners may be used which is sufficient to maintain the rotation restraining assembly in the pocket when subjected to the stresses or forces encountered downhole during the drilling operation or use of the variable gauge drilling apparatus in the borehole.

For instance, one or more fasteners may be comprised of a screw, bolt, locking pin or reciprocating dowel. The reciprocating dowel, which may be referred to as an expansion piston, may be comprised of any reciprocally movable dowel or pin such that the dowel may be moved between an extended position, in which the rotation restraining assembly is secured within the pocket by the dowel, and a retracted position, in which the rotation restraining assembly may be placed within or removed from the pocket. In this case, the securing mechanism is preferably comprised of at least two opposed axial movable dowels located at opposed ends of the rotation restraining assembly such that each dowel reciprocates axially or along the longitudinal axis of the rotation restraining assembly. When in the extended or expanded position or condition, each dowel extends from the rotation restraining assembly for engagement with or receipt in the device mount or the respective pocket defined by the apparatus housing. When in the retracted or unexpanded position or condition, each dowel is withdrawn from engagement with or receipt in the device mount or the respective pocket.

Alternatively, or in addition to the use of one or more fasteners, the securing mechanism may be comprised of at least one underlying surface on the rotation restraining assembly and at least one complementary overlying surface on the mount. Preferably, the securing mechanism is comprised of a plurality of underlying surfaces on the rotation restraining assembly and a plurality of complementary overlying surfaces on the mount. More particularly, in the preferred embodiment, the securing mechanism is comprised of a plurality of underlying surfaces on each rotation restraining assembly and a plurality of complementary overlying surfaces on the mount. The engagement of the underlying surfaces with the complementary overlying surfaces prevents or inhibits the removal or release of the rotation restraining assembly from the mount, and specifically prevents or inhibits the removal or release of each rotation restraining assembly from its respective pocket.

Each of the underlying surfaces on the rotation restraining assembly may be defined by or comprised of any portion or component or surface of the rotation restraining assembly, including any portion or component or surface of either or both of the rotation restraining member and the assembly housing. However, in the preferred embodiment, each of the underlying surfaces on the rotation restraining assembly is defined by or comprised of the assembly housing. Thus, each of the overlying surfaces acts upon or engages a complementary underlying surface on the assembly housing.

Preferably, the mount is further comprised of an axially movable member positioned on the housing, wherein the axially movable member is axially movable in a securing direction toward a securing position in which the axially movable member overlies the rotation restraining assembly so that one of the plurality of overlying surfaces on the mount is comprised of the axially movable member. Thus, the securing mechanism is comprised of the axially movable member and the complementary underlying surface on the rotation restraining assembly.

The axially movable member may have any shape or configuration capable of providing the overlying surface to engage the complementary underlying surface of the rotation restraining assembly. Further, the axially movable member may be movable in any manner in the securing direction towards the securing position such as through a sliding, rotating or screwing action. Finally, the axially movable member may be comprised of a single integral member, component or element or a plurality of members, components or elements permanently or detachably connected, affixed or secured together to comprise the axially movable member.

Preferably, the axially movable member is comprised of a ring which surrounds the apparatus housing. Thus, the ring is axially movable in the securing direction along the apparatus housing toward the securing position. Axial movement refers to movement along or parallel with the longitudinal axis of the apparatus housing. The ring may be comprised of one or more components or elements surrounding the apparatus housing. In the preferred embodiment, the axially movable member is comprised of an abutment ring which surrounds the apparatus housing and a locking ring which surrounds the apparatus housing. Preferably, the abutment ring is axially positioned between the locking ring and the rotation restraining assembly. Thus, the abutment ring directly engages or contacts the rotation restraining assembly, preferably the assembly housing, while the locking ring primarily abuts against or contacts the abutment ring to maintain the abutment ring against the rotation restraining assembly. However, any other arrangement or configuration in which the axially movable member may perform its intended function may be utilized.

The abutment ring and the locking ring may be movable in any manner in the securing direction towards the securing position such as through a sliding, rotating or screwing action. However, preferably, the abutment ring is slidably positioned on the apparatus housing and the locking ring is threadably connected with the apparatus housing. Accordingly, the abutment ring is moved along the apparatus housing through a primarily sliding action, while the locking ring is rotated relative to the apparatus housing to move along the apparatus housing. Thus, the abutment ring slides into contact with the assembly housing and the locking ring is rotated or threaded along the apparatus housing into engagement with the abutment ring to maintain the position of the abutment ring against the assembly housing.

In order to enhance the action of the locking ring and thus assist in maintaining the engagement of the abutment ring with the rotation restraining assembly, the abutment ring is preferably relatively more deformable than both the rotation restraining assembly and the locking ring. The relative ability of the abutment ring to yield or bend has been found to enhance the locking action of the locking ring.

The overlying surface on the mount may be comprised, at least in part, of the locking ring. However, preferably, the overlying surface is primarily or substantially comprised of the abutment ring. The abutment ring may have any shape or configuration suitable for defining the overlying surface or be comprised of any structure adapted to provide the overlying surface. Preferably, the abutment ring is comprised of at least one arm extending axially in the securing direction such that when the axially movable member is in the securing position, at least a portion of the arm is axially aligned with at least one of the plurality of rotation restraining assemblies so that rotation of the abutment ring relative to the apparatus housing is inhibited by at least one of the plurality of rotation restraining assemblies. In the preferred embodiment, the abutment ring is comprised of a plurality of arms extending axially in the securing direction such that when the axially movable member is in the securing position at least a portion of each of the arms is axially aligned with each of the plurality of rotation restraining assemblies.

Further, alternatively or in combination with the axially movable member, one of the plurality of underlying surfaces on the rotation restraining assembly may be comprised of an overcut angular surface on the rotation restraining assembly and one of the overlying surfaces on the mount may be comprised of a complementary undercut angular surface on the mount. Thus, the securing mechanism may be further comprised of the engagement of the overcut angular surface on the rotation restraining assembly with the complementary undercut angular surface on the mount. The angular surfaces may be overcut and undercut any desired degree capable of securing the rotation restraining assembly with the mount. In the preferred embodiment, the complementary angular surfaces are overcut and undercut about 3 degrees or in a range of about 2 to 4 degrees.

For instance, in the preferred embodiment, the mount is comprised of the pocket. Preferably, at least one of the opposed ends of the pocket defines or comprises an undercut angular surface on the mount. Further, at least one of the ends of the housing assembly defines or comprises the complementary overcut angular surface on the rotation restraining device. Where necessary to facilitate the placement and proper fitting of the housing assembly within the mount, the mount may be further comprised of a fitting member. The fitting member is adapted for insertion in the pocket, preferably adjacent one of the opposed ends of the pocket, to fit or rest between the end of the pocket and the adjacent end of the assembly housing. In this case, the surface of the fitting member adjacent the assembly housing preferably defines or comprises the undercut angular surface on the mount for engagement with the complementary overcut angular surface on the assembly housing.

Preferably, the securing mechanism is further comprised of an urging mechanism for urging into engagement the overcut angular surface and the undercut angular surface. The urging mechanism may be comprised of any device, structure, apparatus or means capable of and suitable for urging the angular surfaces into engagement. However, preferably, the urging mechanism is comprised of the axially movable member, wherein the overcut angular surface and the undercut angular surface are urged into engagement by axial movement of the axially movable member in the securing direction. Any portion or surface of the axially movable member may contact any portion or surface of the rotation restraining assembly to urge the angular surfaces into engagement. However, preferably, the axially movable member is comprised of an urging shoulder for engaging the rotation restraining assembly and wherein the urging mechanism is comprised of the urging shoulder. In the preferred embodiment, the abutment ring defines or comprises the urging shoulder, which urging shoulder contacts the assembly housing to urge the angular surfaces into engagement.

In addition, the within invention is comprised of a method for assembling a variable gauge drilling apparatus. The method may be used for or applied to the assembly of any compatible variable gauge drilling apparatus, however, the within method is preferably used for or applied to the assembly of the variable gauge drilling apparatus as described herein, and particularly to the assembly of the preferred embodiment of the variable gauge drilling apparatus described herein.

In a second aspect of the invention, the invention is comprised of a method for assembling a variable gauge drilling apparatus for insertion in a subject borehole, wherein the subject borehole has a subject borehole size within a design range of borehole sizes, the method comprising the following steps:

(a) selecting an apparatus housing having a housing size which is suitable for insertion in the subject borehole;

(b) selecting a selected rotation restraining device from a plurality of interchangeable rotation restraining devices having different device sizes so that the selected rotation restraining device will provide the drilling apparatus with a selected drilling apparatus size within a range of drilling apparatus sizes, wherein the range of drilling apparatus sizes is compatible for use of the drilling apparatus within the design range of borehole sizes and wherein the selected drilling apparatus size is compatible for use of the drilling apparatus within the subject borehole; and (c) mounting the selected rotation restraining device on the apparatus housing using a universal rotation restraining device mount located on the apparatus housing.

In addition, where it is desired or required to interchange the rotation restraining device such that the drilling apparatus is suitable for use in a second subject borehole having a differing subject borehole size than that of the first subject borehole, the method may further include the following steps:

(d) selecting a second selected rotation restraining device from the plurality of interchangeable rotation restraining devices having different device sizes so that the second selected rotation restraining device will provide the drilling apparatus with a second selected drilling apparatus size which is compatible for use of the drilling apparatus within a second subject borehole, wherein the second subject borehole has a second subject borehole size which is within the design range of borehole sizes but which is different from the subject borehole size; and (e) mounting the second selected rotation restraining device on the apparatus housing using the universal rotation restraining device mount.

As discussed previously, the apparatus housing is preferably selected so that the housing size is smaller than the borehole size to an extent sufficient to prevent blockage of a clearance space between the apparatus housing and the borehole during use of the drilling apparatus.

Further, the selected rotation restraining device is selected to provide a selected drilling apparatus size such that the rotation restraining device will engage the borehole during use of the drilling apparatus to inhibit rotation of the apparatus housing relative to the borehole. In the preferred embodiment, the selected rotation restraining device is selected so that the selected drilling apparatus size is approximately equal to the borehole size. In this case, the selected drilling apparatus size will permit the rotation restraining device to engage the borehole in a sufficient manner to inhibit rotation of the apparatus housing.

BRIEF DESCRIPTION OF DRAWINGS

Embodiments of the invention will now be described with reference to the accompanying drawings, in which.

DETAILED DESCRIPTION

Figure 43:
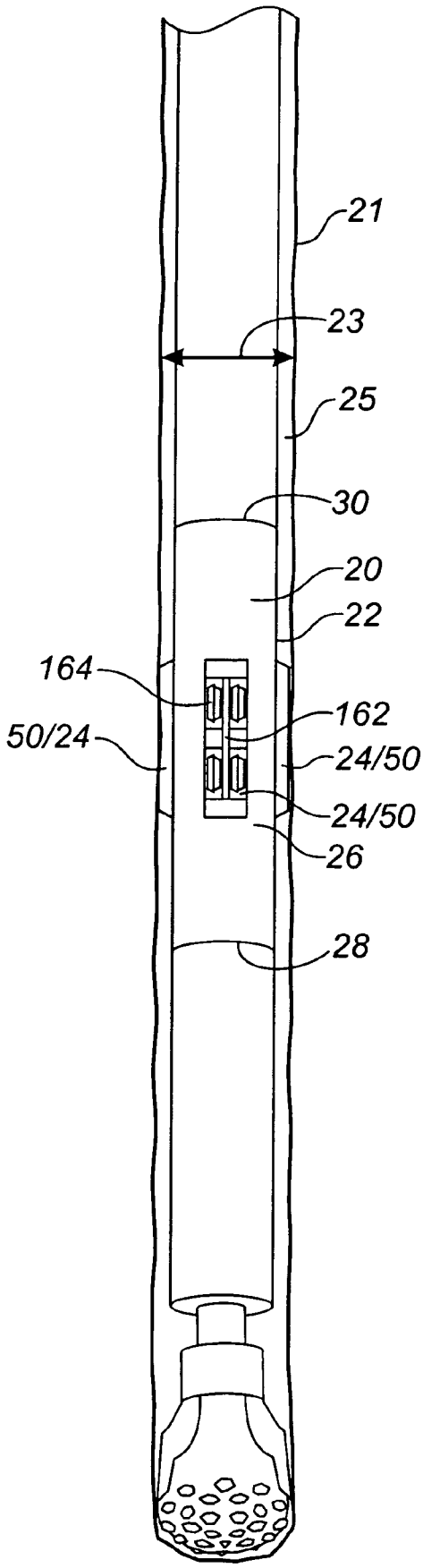
FIG. 43 is a schematic of a variable gauge drilling apparatus inserted within a subject borehole.

The within invention is directed at a variable gauge drilling apparatus (20) and a method for assembling the variable gauge drilling apparatus (20) for insertion in a subject borehole (21). The drilling apparatus (20) has a variable gauge such that the size or outer perimetrical dimension of the drilling apparatus (20) may be varied as required to be compatible for insertion and use within the desired subject borehole (21). The subject borehole (21) has a subject borehole size within a design range of borehole sizes. The drilling apparatus (20) and the components or members thereof are adapted and configured to permit the variation of the size or gauge of the drilling apparatus to be compatible with the design range of borehole sizes. Accordingly different drilling apparatuses may be configured to be compatible with different design ranges of borehole size. The borehole size, as shown by reference number (23) in FIG. 43, refers to the diameter of the borehole.

In the preferred embodiment described herein, the drilling apparatus (20) is adapted for insertion and use within a design range of borehole sizes having a diameter of between about 12.250 inches (31.115 cm) and 17.500 inches (44.45 cm). Thus, the subject borehole (21) would have a diameter within the range of between about 12.250 inches (31.115 cm) and 17.500 inches (44.45 cm). However, as stated, the drilling apparatus (20) may be adapted or configured to be compatible for use with other design ranges of borehole size.

The variable gauge drilling apparatus (20) is comprised of an apparatus housing (22), a plurality of interchangeable borehole engaging devices (24) and a universal borehole engaging device mount (26). In order to vary the gauge or outer perimetrical dimension of the drilling apparatus (20), the size or dimensions of any of the components of the drilling apparatus (20) may be varied. However, in the preferred embodiment, the plurality of interchangeable borehole engaging devices (24) have different device sizes such that the interchanging of the borehole engaging devices (24) varies the size of the drilling apparatus (20).

The drilling apparatus (20) has a drilling apparatus size. The drilling apparatus size refers to a maximum or outermost perimetrical dimension of the drilling apparatus (20)

on cross-section. More particularly, as the drilling apparatus (20) is intended for insertion in a subject borehole (21), the drilling apparatus size (20) is preferably determined by a diameter of the drilling apparatus (20) which is defined herein as the diameter of a circle closely encompassing or enclosing the outermost perimeter of the drilling apparatus (20) on cross-section.

The drilling apparatus size may be varied within a range of drilling apparatus sizes, wherein the range of drilling apparatus sizes is compatible for use of the drilling apparatus (20) within the design range of borehole sizes. Thus, in the preferred embodiment, the range of drilling apparatus sizes is compatible for use of the drilling apparatus (20) within a subject borehole (21) having a size ranging from about 12.250 inches (31.115 cm) to about 17.500 inches (44.45 cm).

As indicated, any of the components or elements of the drilling apparatus (20) may be varied in order to vary the drilling apparatus size such that it is compatible for use of the drilling apparatus (20) within the subject borehole (21). However, preferably, the plurality of interchangeable borehole engaging devices (24) have different device sizes for mounting on the apparatus housing (22) and particularly for mounting with the universal borehole engaging device mount (26), which may be referred to herein simply as the device mount (26). The different device sizes of the plurality of interchangeable borehole engaging devices (24) provide the drilling apparatus (20) with different drilling apparatus sizes within the range of drilling apparatus sizes compatible with the design range of borehole sizes. The apparatus housing (22) and the device mount (26) do not require any modification or adaptation. In other words, the same configuration and size of the apparatus housing (22) and the device mount (26) may be used with any of the plurality of the interchangeable borehole engaging devices (24). As a result, the drilling apparatus size may be readily changed by removing one of the plurality of interchangeable borehole engaging devices (24) having a first device size from the device mount (26) and mounting a further one of the plurality of interchangeable borehole engaging devices (24) having a different second device size with the device mount (26).

Referring to FIGS. 1–13, the apparatus housing (22) has a housing size which is suitable for insertion in the subject borehole (21) having a subject borehole size (23) within the design range of borehole sizes. The housing size refers to the maximum perimetrical dimension on cross-section of the apparatus housing (22). More particularly, as the apparatus housing (22) is adapted for insertion in the subject borehole (21), in the preferred embodiment, the apparatus housing (22) is substantially circular on cross-section and the housing size is defined by the maximum diameter of the apparatus housing (22) on cross-section as shown by reference number (27) in FIGS. 3 and 9.

The housing size is therefore selected to permit the insertion of the apparatus housing (22) within the subject borehole (21). Accordingly, the apparatus housing (22) has a housing size smaller or less than the subject borehole size (23). In other words, the diameter of the apparatus housing (22) is less than the diameter of the subject borehole (21). In addition, the housing size or diameter of the apparatus housing (22) is also selected to provide an annulus or clearance space (25) between the apparatus housing (22) and the wall of the subject borehole (21) which is sufficient to permit any required or desired fluid flow, such as drilling mud or other drilling fluids, through the annulus during the drilling operation. In other words, the apparatus housing (22) has a housing size which is smaller than the subject borehole size (23) to an extent sufficient to prevent blockage of the annulus or clearance space (25) during use of the drilling apparatus (20). Finally, as stated, in the preferred embodiment, the apparatus housing (22) does not require any modification for use in any of the boreholes within the design range of borehole sizes. As a result, the housing size is selected to be suitable for insertion in all borehole sizes in the design range of borehole sizes for that particular drilling apparatus (20) and to provide a sufficient clearance space (25) or annulus in all boreholes in the design range.

In the preferred embodiment, the drilling apparatus (20) comprises or forms part of a drilling string for conducting the drilling operation such that the drilling apparatus (20) is located along the length of the drilling string. Thus, the drilling apparatus (20) is adapted for connection into the drilling string. More particularly, the uphole and downhole ends of the apparatus housing (22) are particularly adapted for connection with adjacent subs, components or other downhole tools which also comprise the drilling string. Further, the drilling apparatus (20) may be connected into the drilling string as a separate or distinct sub or component of the drilling string at any position along the length of the drilling string or it may comprise a part or portion of a further tool or component of the drilling string. For instance, the drilling apparatus (20) may be connected with a downhole motor assembly, a rotary steerable drilling system or any other component of the drilling string. Alternatively, a downhole motor assembly, a rotary steerable drilling system or any other component of the drilling string may be comprised of the drilling apparatus (20).

Referring to FIGS. 1–3, 8–9 and 12–13, the apparatus housing (22) has a first end (28) and an opposed second end (30). Further, the apparatus housing (22) defines a bore (32) extending therethrough between the first and second ends (28, 30), which defines the longitudinal axis of both the apparatus housing (22) and the drilling apparatus (20). Preferably, the first end (28) of the apparatus housing (22) is the downhole end and the second end (30) of the apparatus housing (22) is the uphole end. As well, the apparatus housing (22) may be comprised of a plurality of members or elements permanently or detachably connected, fastened or affixed together in any suitable manner to provide the apparatus housing (22). However, in the preferred embodiment, the apparatus housing (22) is comprised of a single integral tubular member having an interior surface (34) defining the bore (32) which extends therethrough and an exterior surface (36) defining the housing size. Depending upon the position of the drilling apparatus (20) along the drilling string, the bore (32) of the apparatus housing (22) preferably has a diameter sufficient to permit a drilling shaft or drive shaft of a downhole motor assembly or rotary steerable system to extend therethrough or to permit drilling fluids to be conducted through the drilling apparatus (20) during the drilling operation. Further, the first and seconds (28, 30) of the apparatus housing (22) are adapted for connection with adjacent components of the drilling string.

The apparatus housing (22) may be connected with adjacent components of the drilling string in any manner and by any permanent or detachable connector or fastener or other means, mechanism or structure for connecting or affixing the adjacent structures together such that communication with the bore (32) of the apparatus housing (22) is permissible. For instance, a welded or threaded connection may be provided at either or both ends (28, 30) of the apparatus housing (22). In the preferred embodiment, the exterior surface (36) of the apparatus housing (22) at the first end (28) is threaded for threadably connecting with an adjacent structure or component of the drilling string having a complementary threaded inner surface. In other words, the first end (28) is comprised of a threaded pin connector (38) for engaging a complementary threaded box connector (not shown). Further, in the preferred embodiment, the second end (30) of the apparatus housing (22) is comprised of a plurality of teeth (40) for interlocking with or engaging a plurality of complementary teeth (not shown) on an adjacent structure or component of the drilling string. The interlocking teeth of the apparatus housing (22) and the adjacent structure act to prevent or inhibit any relative rotation therebetween.

Figure 1:
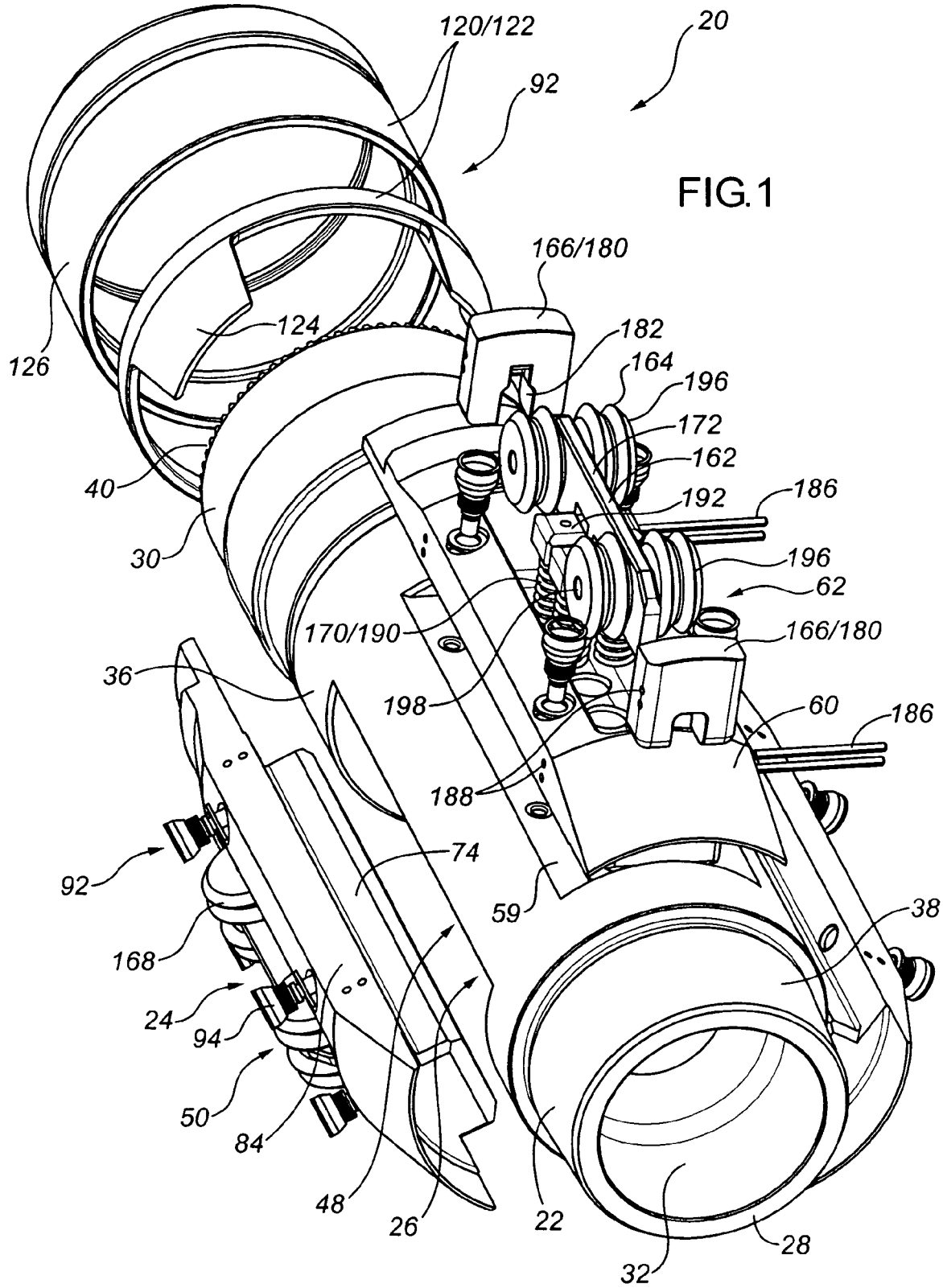
FIG. 1 is an exploded pictorial view of a preferred embodiment of a variable gauge drilling apparatus comprised of an interchangeable borehole engaging device, wherein the interchangeable borehole engaging device is comprised of an interchangeable rotation restraining device.
Figure 2:
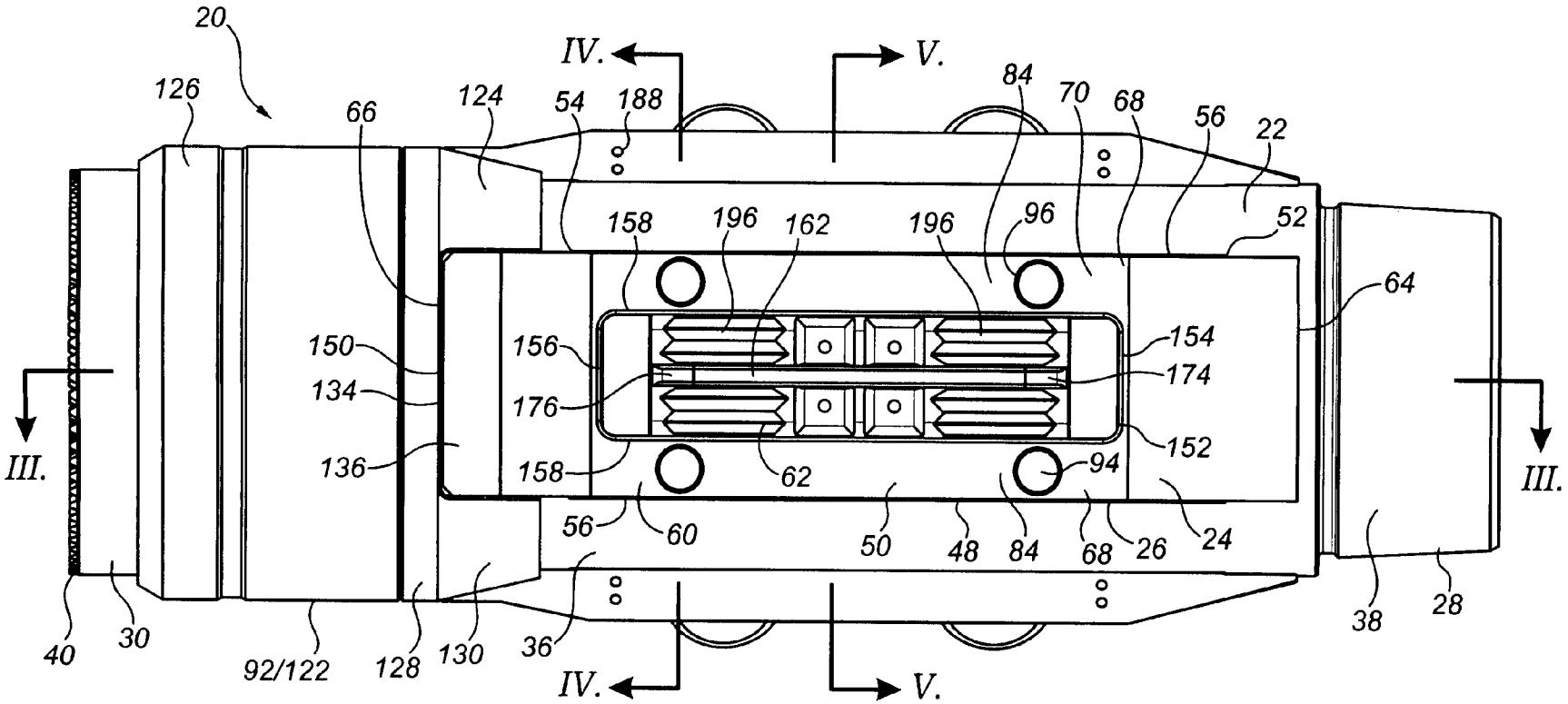
FIG. 2 is a side view of the drilling apparatus shown in FIG. 1 showing the interchangeable rotation restraining device having a first device size and wherein the interchangeable rotation restraining device is comprised of a plurality of rotation restraining assemblies.
Figure 3:
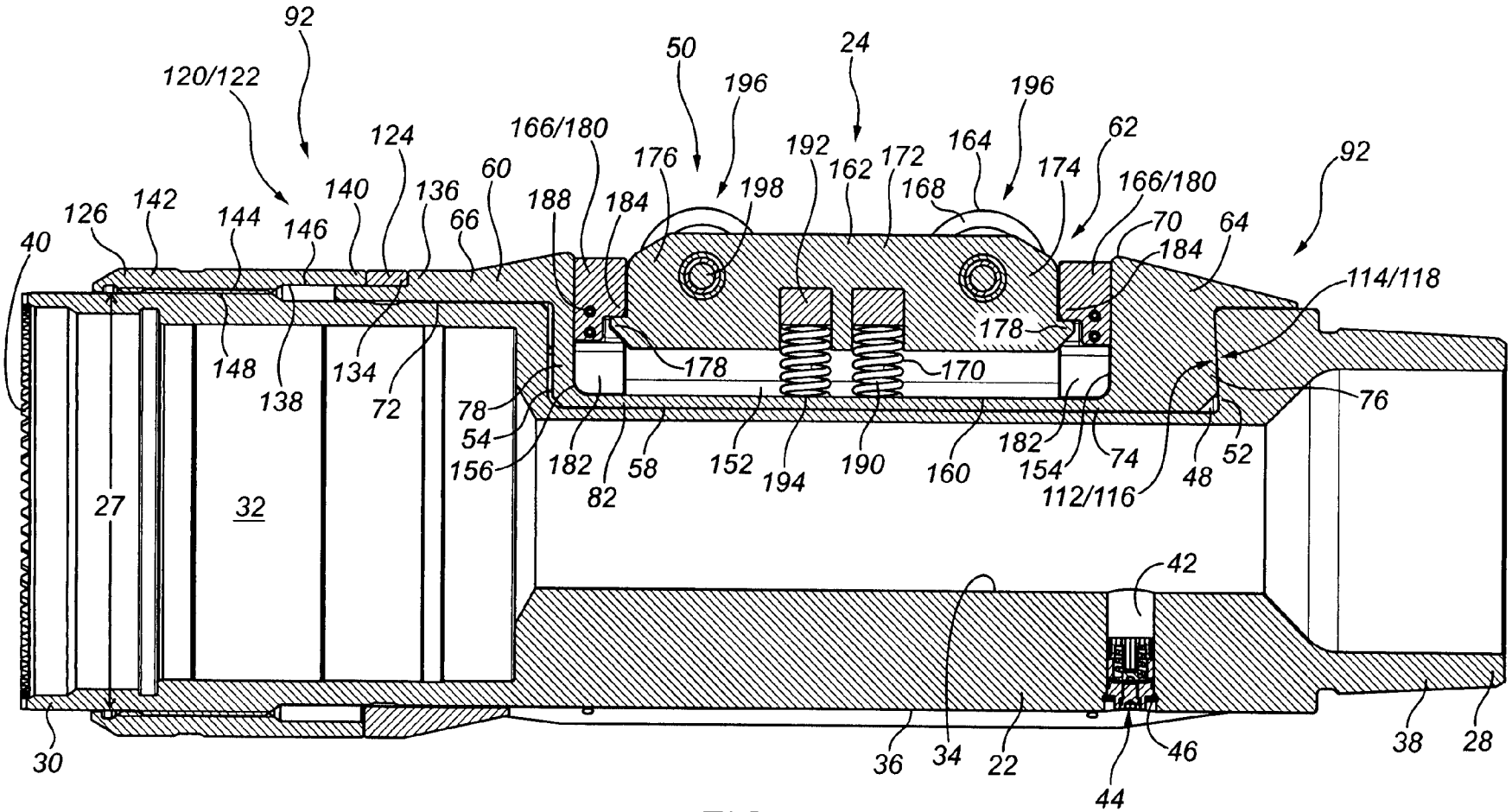
FIG. 3 is a longitudinal sectional view of the drilling apparatus taken along line 3—3 of FIG. 2.
Figure 4:
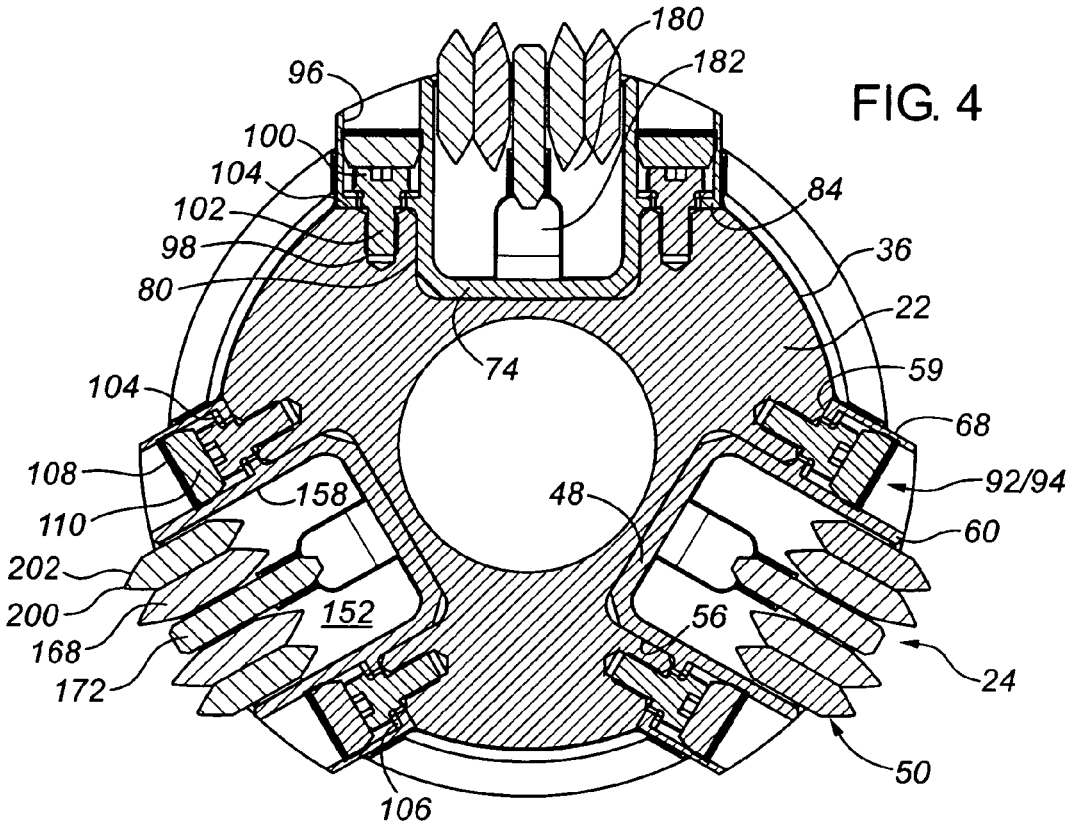
FIG. 4 is a cross-sectional view of the drilling apparatus taken along line 4—4 of FIG. 2 showing the first device size.
Figure 9:
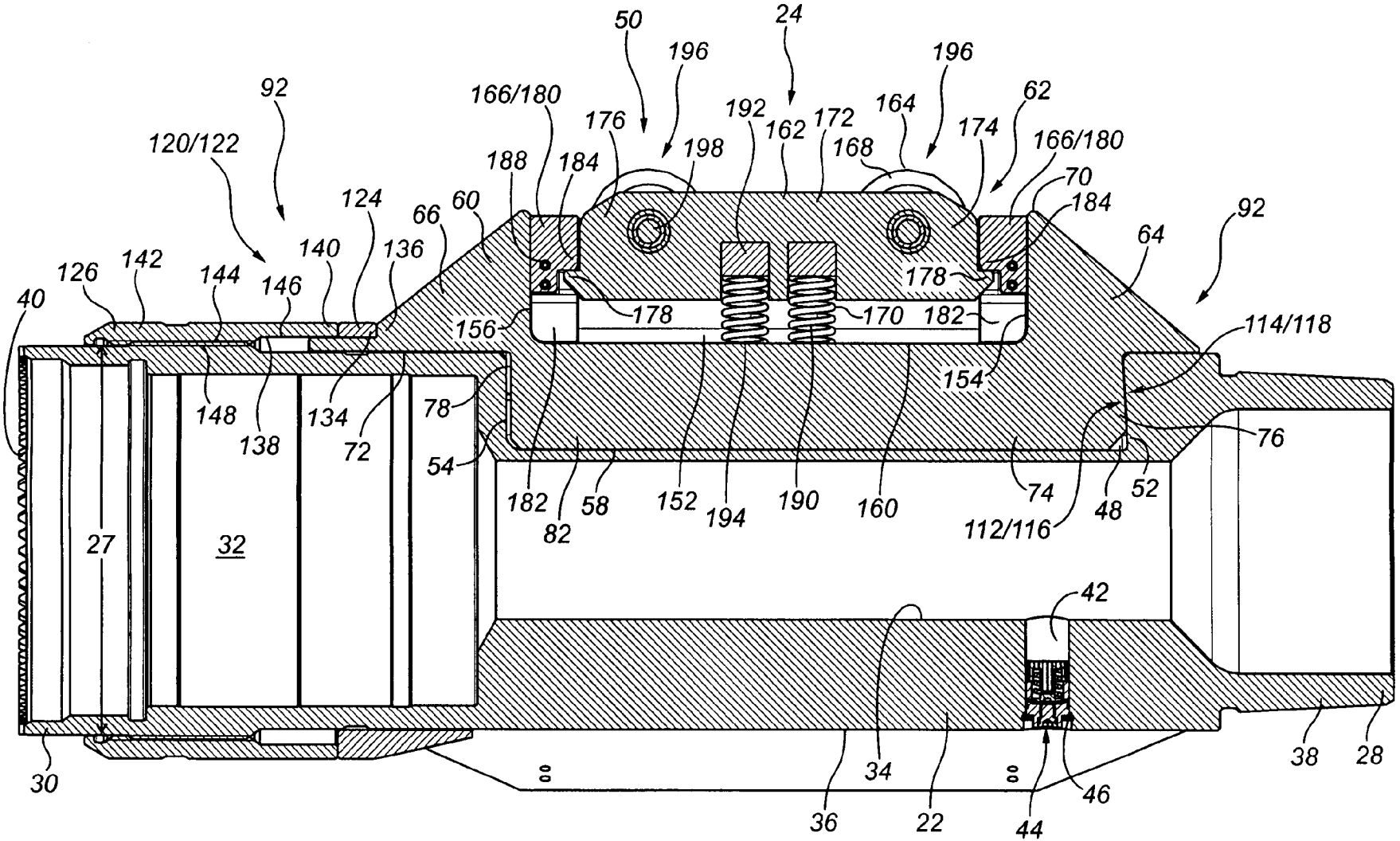
FIG. 9 is a longitudinal sectional view of the drilling apparatus taken along line 9—9 of FIG. 8.
Figure 10:
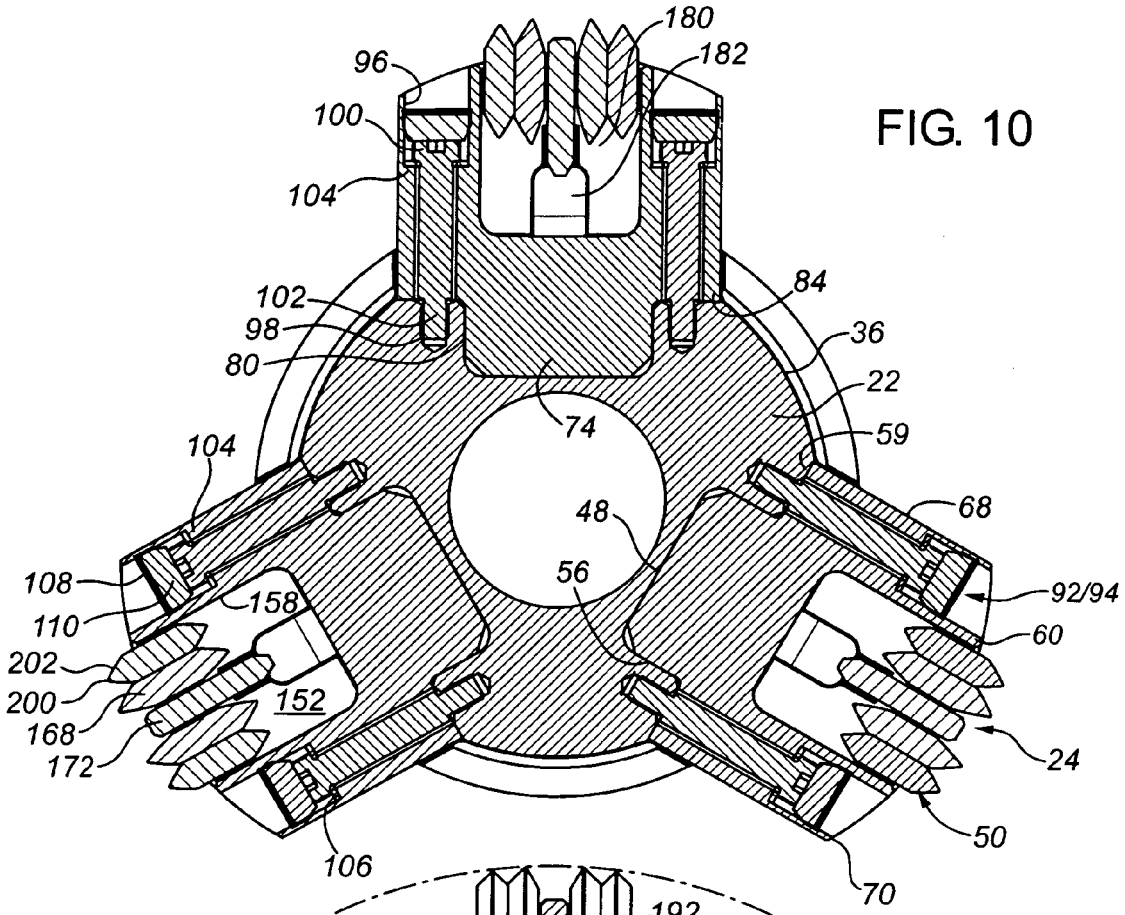
FIG. 10 is a cross-sectional view of the drilling apparatus taken along line 10—10 of FIG. 8 showing the second device size.
Figure 13:
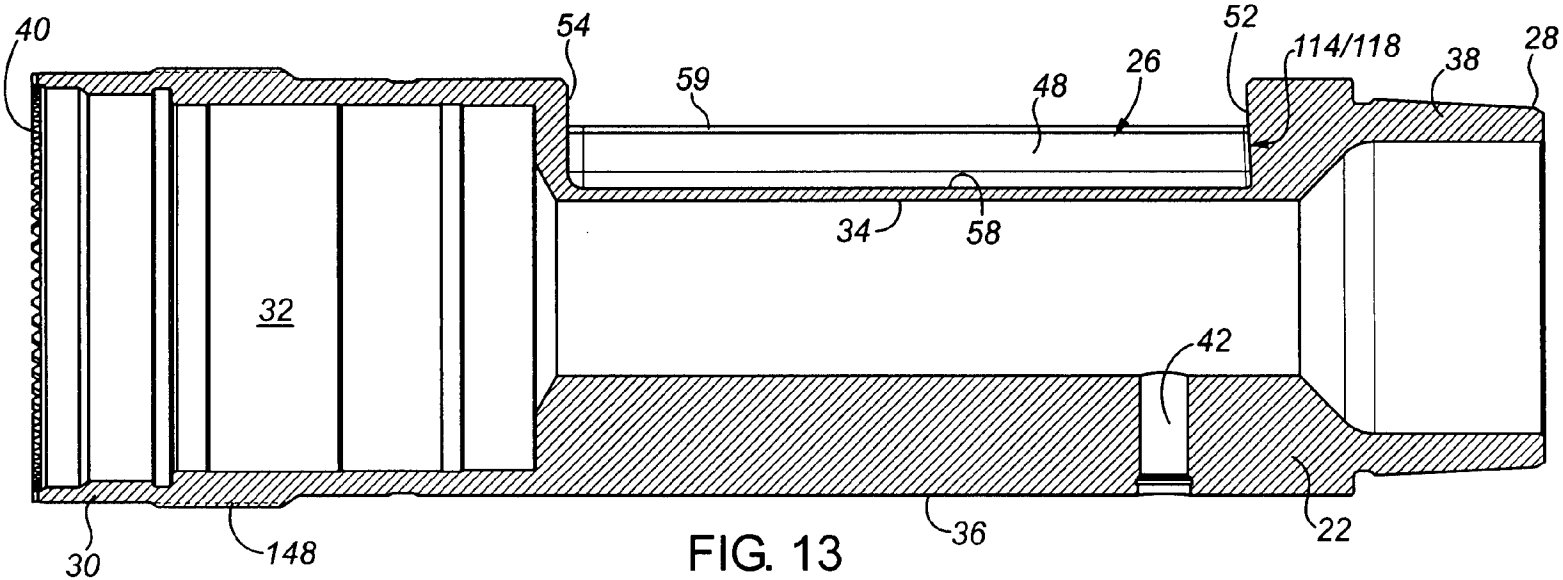
FIG. 13 is a longitudinal sectional view of the apparatus housing taken along line 13—13 of FIG. 12.
Figure 14:
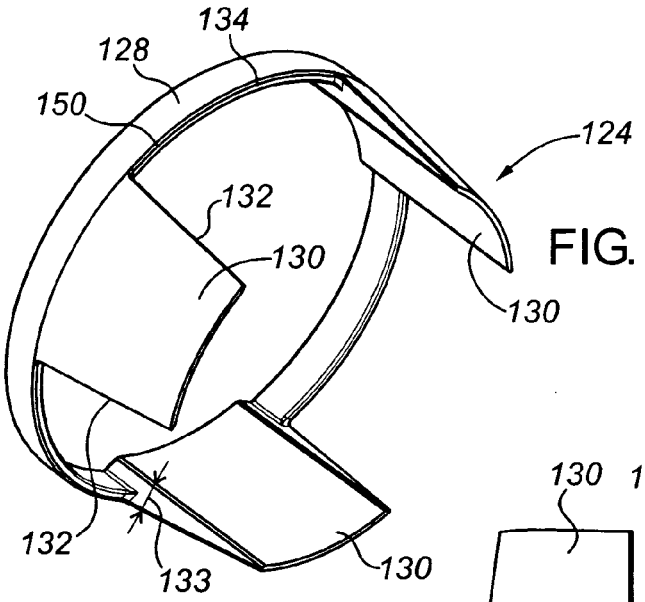
FIG. 14 is a pictorial view of an abutment ring of the drilling apparatus as shown in FIGS. 2 and 8.
Figure 15:
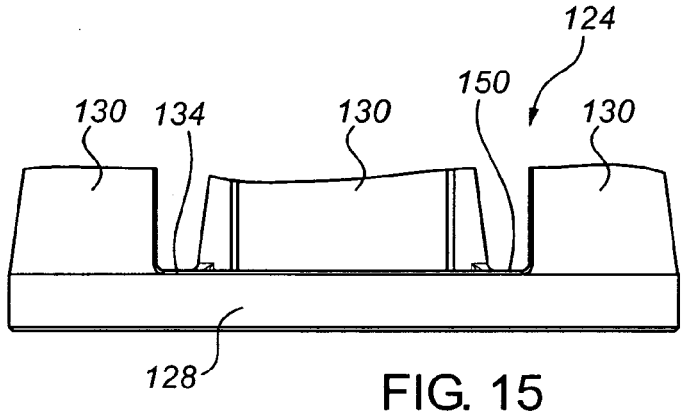
FIG. 15 is a side view of a portion of the abutment ring shown in FIG. 14.
Figure 16:
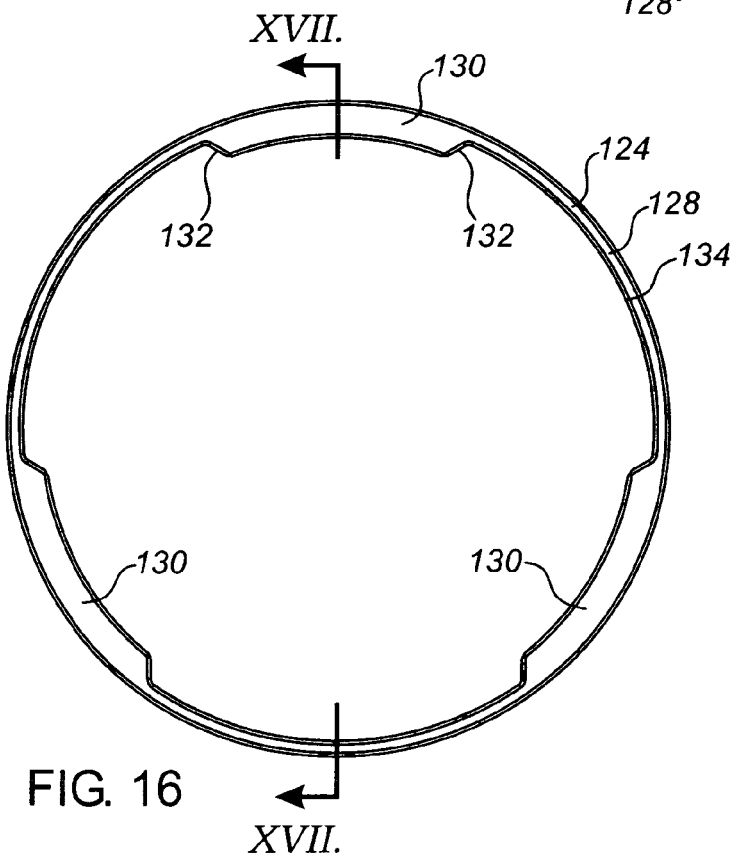
FIG. 16 is an end view of the abutment ring shown in FIG. 14.
Figure 17:
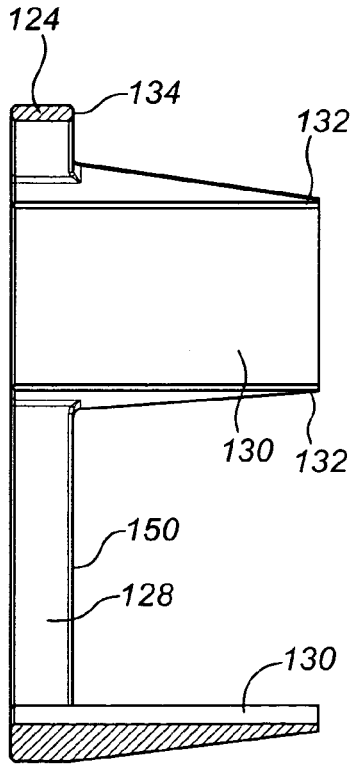
FIG. 17 is a sectional view of the abutment ring taken along line 17—17 of FIG. 16.

Finally, as shown in FIGS. 3, 9 and 13, the apparatus housing (22) may define a port (42) extending between the interior and exterior surfaces (34, 36) of the apparatus housing (22) to permit the passage of fluids therethrough. Preferably, a valve is positioned in the port (42) for controlling the flow or passage of the fluids therethrough. In the preferred embodiment, a charging valve assembly (44) sealingly engages the wall of the port (42) and is retained in position within the port (42) by one or more retaining rings (46).

Further, as stated, the device mount (26) is located on the apparatus housing (22) and is configured to accept for mounting any one of the plurality of interchangeable borehole engaging devices (24). Thus, the device mount (26) may have any configuration compatible with the plurality of interchangeable borehole engaging devices (24) such that any one of the interchangeable borehole engaging device (24) may be accepted thereby in order to mount the interchangeable borehole engaging device (24) with the apparatus housing (22). Further, the device mount (26) may be comprised of any mechanism, device, structure or other means capable of, or adapted for, mounting the interchangeable borehole engaging device (24) with the apparatus housing (22).

Accordingly, the device mount (26) may be associated with the apparatus housing (22) and located on the apparatus housing (22), particularly its exterior surface (36), in any manner compatible with the function of the device mount (26). For instance, the exterior surface (36) of the apparatus housing (22) may define or comprise the device mount (26). Thus, the device mount (26) may be integrally formed with or by the apparatus housing (22). Alternately, the device mount (26) may be permanently or detachably fastened, connected or otherwise affixed with the exterior surface (36) of the apparatus housing (22) in any suitable manner such as by welding or by using one or more fasteners.

In the preferred embodiment, the device mount (26) is integrally formed with the apparatus housing (22). More particularly, the device mount (26) is comprised of at least one pocket (48) defined by the exterior surface (36) of the apparatus housing (22). The particular configuration and dimensions of the pocket (48) and the orientation of the pocket (48) relative to the longitudinal axis of the apparatus housing (22) are selected to be compatible with the interchangeable borehole engaging device (24) as discussed above.

Preferably, the plurality of interchangeable borehole engaging devices (24) is comprised of a plurality of interchangeable rotation restraining devices. Although, as discussed previously, the borehole engaging device (24) may be any device intended for engaging the wall of the borehole when inserted in the subject borehole (21), such as a stabilizer device or underreamer device, the borehole engaging device (24) is preferably a rotation restraining device. The rotation restraining device (24) is provided to engage the subject borehole (21) during use of the drilling apparatus (20) to inhibit rotation of the apparatus housing (22) relative to the borehole. Each of the plurality of interchangeable rotation restraining devices (24) may be comprised of any mechanism, device, assembly or means suitable for engaging the borehole wall and capable of being accepted for mounting by the mount device (26).

Further, the plurality of interchangeable rotation restraining devices (24) have different device sizes for mounting on the apparatus housing (22) by the device mount (26). Thus, interchanging the rotation restraining devices (24) having different device sizes varies the drilling apparatus size within the range of drilling apparatus sizes. The range of drilling apparatus sizes is compatible for use of the drilling apparatus (20) within the design range of borehole sizes. Thus, one of the plurality of interchangeable rotation restraining devices (24) is selected for mounting to provide the desired drilling apparatus size which will be dependent upon the subject borehole size (23). In other words, the specific interchangeable rotation restraining device (24) mounted in the device mount (26) will be compatible with the subject borehole size (23). In the preferred embodiment, the specific rotation restraining device (24) to be mounted with the device mount (26) is selected to provide a drilling apparatus size such that the rotation restraining device (24) will engage the borehole during use of the drilling apparatus (22) to inhibit rotation of the apparatus housing (22) relative to the borehole. To achieve this result, the rotation restraining device (24) is preferably selected so that the drilling apparatus size is approximately equal to the subject borehole size (23). If the drilling apparatus size is significantly or substantially larger than the subject borehole size (23), the drilling apparatus (20) will be incapable of insertion in the borehole or movement of the drilling apparatus (20) longitudinally through the borehole will be impeded. Conversely, if the drilling apparatus size is significantly or substantially smaller than the subject borehole size (23), the rotation restraining device (24) will be unable to sufficiently engage the borehole to inhibit rotation of the apparatus housing (22).

Preferably, each of the plurality of interchangeable rotation restraining devices (24) is comprised of at least one rotation restraining assembly (50) for mounting in the pocket (48). In the preferred embodiment, each of the plurality of interchangeable rotation restraining devices (24) is comprised of a plurality of rotation restraining assemblies (50). Thus, in the preferred embodiment, the device mount (26) is comprised of a plurality of pockets (48) such that each pocket (48) accepts a single rotation restraining assembly (50) for mounting. Any number of rotation restraining assemblies (50) and corresponding pockets (48) may be used which are sufficient to engage the borehole wall during use of the drilling apparatus (20) to inhibit rotation of the apparatus housing (22) relative to the borehole. In the preferred embodiment, three rotation restraining assemblies (50) are provided for mounting in three corresponding pockets (48).

Further, each of the pockets (48) may be positioned longitudinally along the longitudinal axis of the apparatus housing (22) and circumferentially about the apparatus housing (22) at any position or location compatible with performing the function of the rotation restraining device (24). Preferably, the pockets (48) are spaced circumferentially about the exterior surface (36) of the apparatus housing (22). In the preferred embodiment, the pockets (48) are spaced substantially evenly about the circumference of the apparatus housing (22). Accordingly, in the preferred embodiment, the three pockets (50) and corresponding three rotation restraining assemblies (50), or a centerline thereof, are spaced about 120 degrees apart about the circumference of the apparatus housing (20). This spacing may enhance or facilitate the effective functioning of the rotation restraining device (24). Further, this spacing may assist in centralizing the drilling apparatus (20) within the borehole. However, the pockets (48) need not be spaced substantially evenly depending upon the particular drilling operation and the desired functioning of the drilling apparatus (20).

Further, each pocket (48) may be positioned longitudinally along the apparatus housing (22) at any location between its first and second ends (28, 30). In the preferred embodiment, each pocket (48) is positioned longitudinally or axially along the apparatus housing (22) at substantially the same location. In other words, the pockets (48) and thus the corresponding rotation restraining assemblies (50) are positioned axially or longitudinally at about the same location between, and distances from, the first and second ends (28, 30) of the apparatus housing (22). However, alternatively, the pockets (48) may be spaced axially or longitudinally along the apparatus housing (22) such that the location or position of two or more pockets (48) may differ axially or longitudinally. In other words, the location between, and distances from, the first and second ends (28, 30) of the apparatus housing (22) differs between at least two of the pockets (48). The combination of circumferentially and longitudinally spacing at least two of the pockets (48) results in a longitudinally or axially staggered configuration of the pockets (48) and corresponding rotation restraining assemblies (50). This staggered configuration may assist or facilitate the effective functioning of the rotation restraining device (24).

In addition, each pocket (48) may have any shape adapted for accepting or receiving the rotation restraining assembly (50) or a portion thereof. In the preferred embodiment, referring particularly to FIGS. 5, 11, 12 and 13, the pocket (48) is comprised of an elongate indentation or cavity within the exterior surface (36) of the apparatus housing (22) which is preferably oriented longitudinally or axially aligned such that a longitudinal axis of the pocket (48) is substantially parallel with the longitudinal axis of the apparatus housing (22). Further, in the preferred embodiment, the pocket (48) is preferably rectangular in shape having opposed first and second ends (52, 54) extending towards the first and second ends (28, 30) respectively of the apparatus housing (22), opposed side surfaces (56) and a bottom surface (58). In addition, the exterior surface (36) of the apparatus housing (22) adjacent each of the sides surfaces (56) preferably comprises a relatively flat portion (59) which extends approximately perpendicularly to each side surface (56) in the preferred embodiment. The relatively flat portion (59) may be utilized to assist with or facilitate the mounting of the rotation restraining assembly (50) as discussed below.

The depth of the pocket (48) within the apparatus housing (22) is defined by the distance between the bottom surface (58) of the pocket (48) and the flat portion (59) of the exterior surface (36) of the apparatus housing (22) adjacent the pocket (48). The depth of the pocket (48) will be dependent upon the diameter of the apparatus housing (22) or housing size and the required diameter of the bore (32) extending therethrough. Further, the depth will also be selected to correspond or be compatible with the depth or dimensions of the part or portion of the rotation restraining assembly (50) to be received therein. The shape and dimensions of each pocket (48) comprising the device mount (26) are preferably identical or substantially similar such that any of the plurality of rotation restraining assemblies (50) of any of the plurality of interchangeable rotation restraining devices (24) may be mounted by the universal device mount (26).

Referring to FIGS. 1–11, each rotation restraining assembly (50) is preferably comprised of an assembly housing (60) and a rotation restraining member (62) connected with the assembly housing (60). Although the components or elements of the rotation restraining assemblies (62) may vary between assemblies (62), in the preferred embodiment, the components or elements of each of the plurality of rotation restraining assemblies (62) of each of the plurality of interchangeable rotation restraining devices (24) are substantially similar. Preferably, only the size of various of the components or elements of the rotation restraining assembly (62), as discussed further below, differs between interchangeable rotation restraining devices (24) such that the rotation restraining devices (24) have different device sizes.

Although any of the components of the rotation restraining assembly (62) may be adapted to be accepted by, or received within, the pocket (48), preferably at least a part or portion of the assembly housing (60) is adapted or configured for receipt in the pocket (48). Referring particularly to FIGS. 5–7 and 11, the assembly housing (60) has a first end (64) and an opposed second end (66), opposed side surfaces (68), a top surface (70) and an opposed bottom surface (72). The bottom surface (72) of the assembly housing (60) is comprised of or defines a protrusion or projection (74) which is configured to be compatible with or to correspond to the pocket (48) such that the projection (74) is receivable within the pocket (48).

Figure 7:
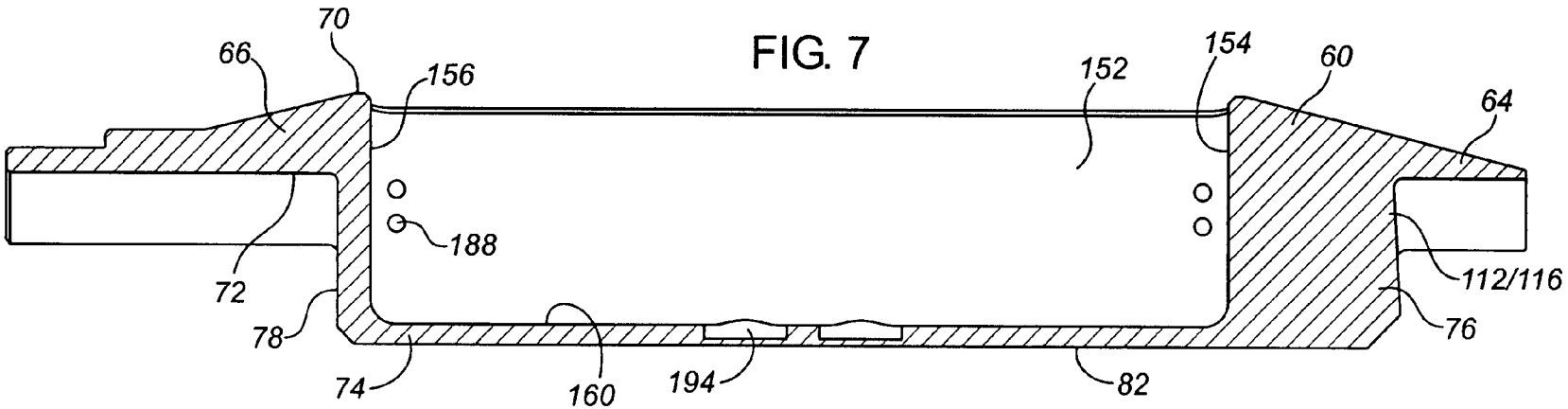
FIG. 7 is a longitudinal sectional view of the assembly housing taken along line 7—7 of FIG. 6.
Figure 8:
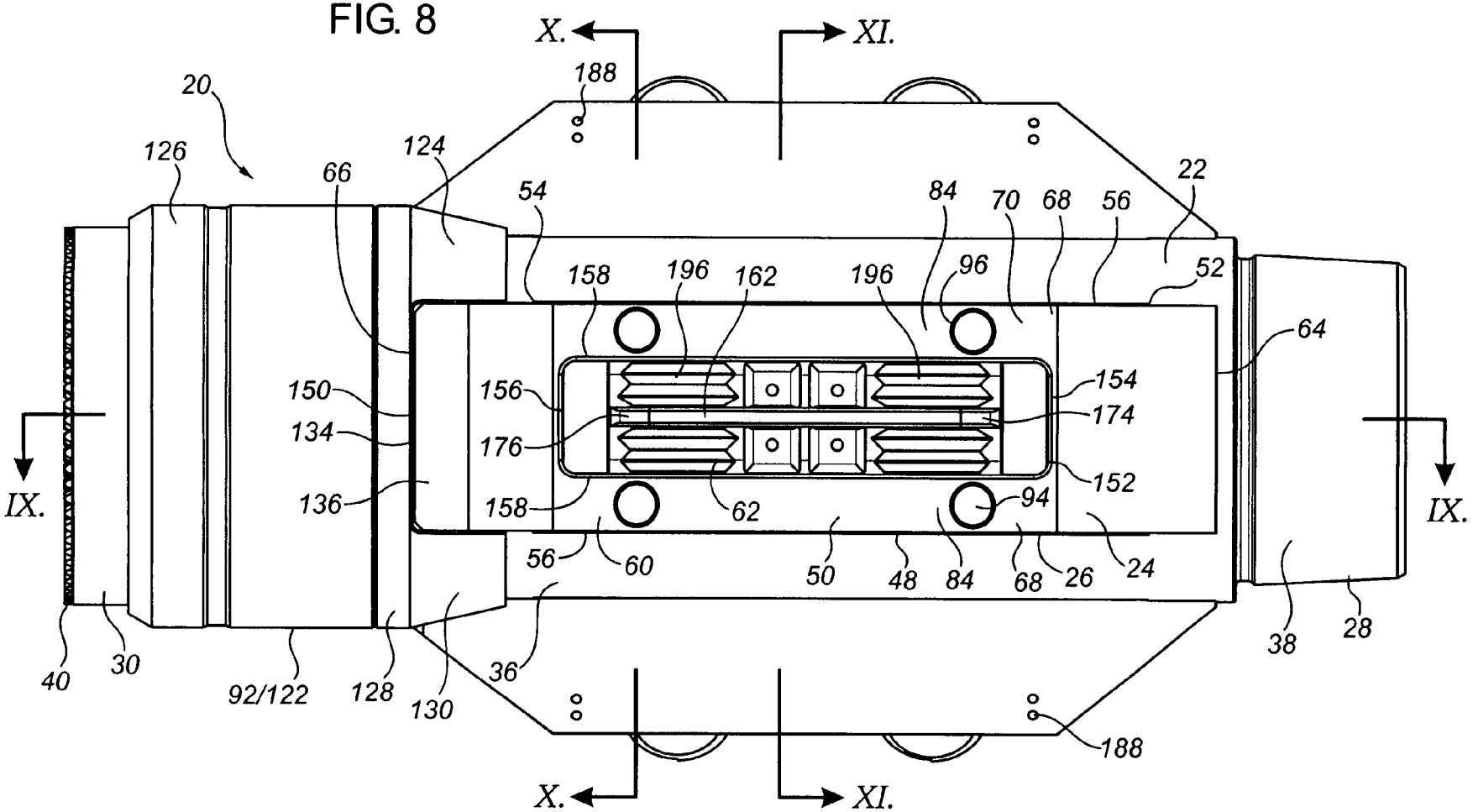
FIG. 8 is a side view of the drilling apparatus showing the interchangeable rotation restraining device having a second device size and wherein the interchangeable rotation restraining device is comprised of a plurality of rotation restraining assemblies.

In the preferred embodiment, the projection (74) is preferably elongated and has a rectangular shape such that the projection (74) has opposed first and second ends (76, 78), opposed side surfaces (80) and a bottom surface (82) which comprises a portion of the bottom surface (72) of the assembly housing (60). Accordingly, in this case, the projection (74) extends continuously or as a unit between the first and second ends (76, 78) to provide a continuous bottom surface (82) as shown in FIG. 7. However, alternately, the projection (74) and thus the bottom surface (82) need not extend continuously between the first and second ends (76, 78). Rather, the projection (74) may be comprised of two or more parts or portions which are a spaced distance apart or are otherwise disconnected or discontinuous, but which together provide the first and second ends (76, 78), the side surfaces (80) and the bottom surface (82) of the projection (74) for receipt in the pocket (48).

Preferably, the projection (74) has a size or dimension such that it is closely received within the pocket (48), although some amount of longitudinal movement of the projection (74) within the pocket (48) is permissible to facilitate the mounting and removal of the assembly housing (52). Thus, when received within the pocket (48), the first and second (76, 78) of the projection (74) are adjacent or proximate to the first and second ends (52, 54) of the pocket (48) and the side surfaces (80) of the projection (74) are adjacent or proximate to the side surfaces (56) of the pocket (48). Finally, the bottom surface (82) of the projection (74) is preferably adjacent or proximate to the bottom surface (58) of the pocket (48), however, these bottom surfaces (82, 58) may alternatively be a spaced distance apart.

In addition, the side surfaces (68) of the assembly housing (60) extending outwardly from the projection (74) preferably provide or define a lip portion (84) compatible for engagement or contact with the flat portion (59) of the exterior surface (36) of the apparatus housing (22) adjacent the pocket (48). Thus, when the projection (74) is received in the pocket (48), the lip portion (84) of the assembly housing (60) rests upon and engages the flat portion (59) of the apparatus housing (22). The engagement of the lip portion (84) and the flat portion (59) may be utilized to assist with or facilitate the mounting of the rotation restraining assembly (50) as discussed below.

Further, in the preferred embodiment, the first and second ends (64, 66) of the assembly housing (60) extend longitudinally or axially from the first and second ends (76, 78) of the projection (74) respectively such that they extend towards the first and second ends (28, 30) of the apparatus housing (22) when the projection (74) is received in the pocket (48). In this case, each of the first and second ends (64, 66) of the assembly housing (60) preferably abut with or engage the adjacent exterior surface (36) of the apparatus housing (22). However, alternately, the first and second ends (64, 66) of the assembly housing (60) may terminate at or in proximity to the first and second ends (76, 78) of the projection (74) respectively such that the first and second ends (64, 66) of the assembly housing (60) do not extend beyond the first and second ends(52, 54) of the pocket (48).

The assembly housing (60) has an assembly housing size and the assembly housing size preferably defines the device size. In other words, the assembly housing size of each of the rotation restraining assemblies (50) is preferably variable such that the plurality of interchangeable rotation restraining devices (24) may be provided with differing device sizes. In the preferred embodiment, each of the plurality of interchangeable rotation restraining devices (24) is comprised of a plurality of rotation restraining assemblies (50). The assembly housing size of each of the rotation restraining assemblies (50) in a single rotation restraining device (24) is preferably the same. Thus, each of the similar assembly housing sizes of each of the rotation restraining assemblies (50) contribute to or provide the device size for that particular rotation restraining device (24). However, where desired or required for a particular application or use of the drilling apparatus (20) downhole, the assembly housing sizes may differ between each of the rotation restraining assemblies (50) in a single rotation restraining device (24). In this instance, the differing assembly housing sizes would contribute to or provide the device size for that particular rotation restraining device (24). Accordingly, various combinations of assembly housing sizes may be used in a rotation restraining device (24) to achieve a desired device size.

Figure 5:
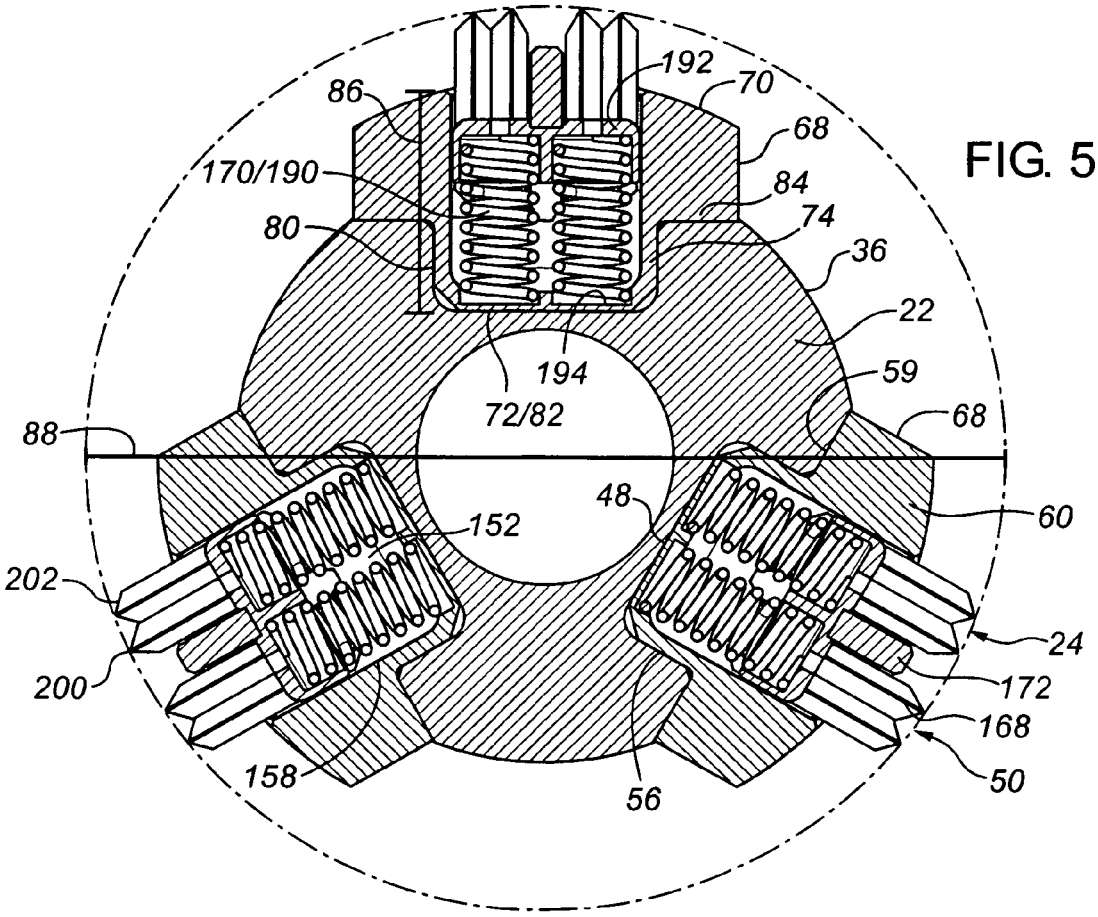
FIG. 5 is a cross-sectional view of the drilling apparatus taken along line 5—5 of FIG. 2 showing the first device size.
Figure 6:
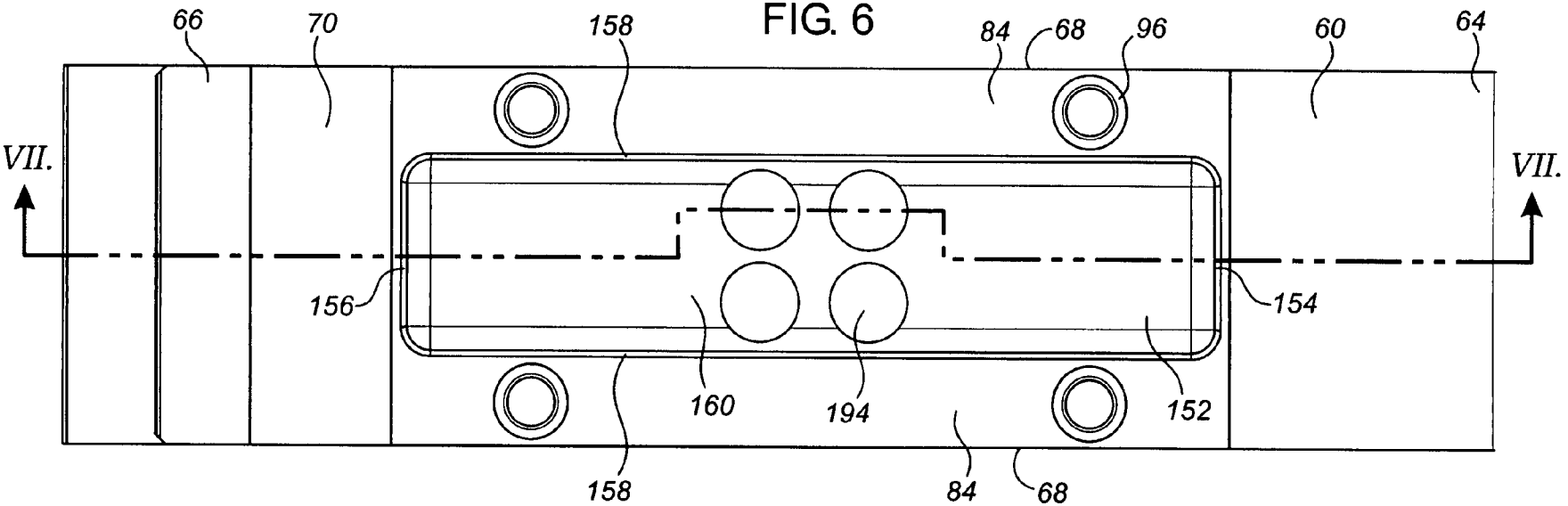
FIG. 6 is a top view of an assembly housing of one of the plurality of the rotation restraining assemblies shown in FIG. 2.
Figure 11:
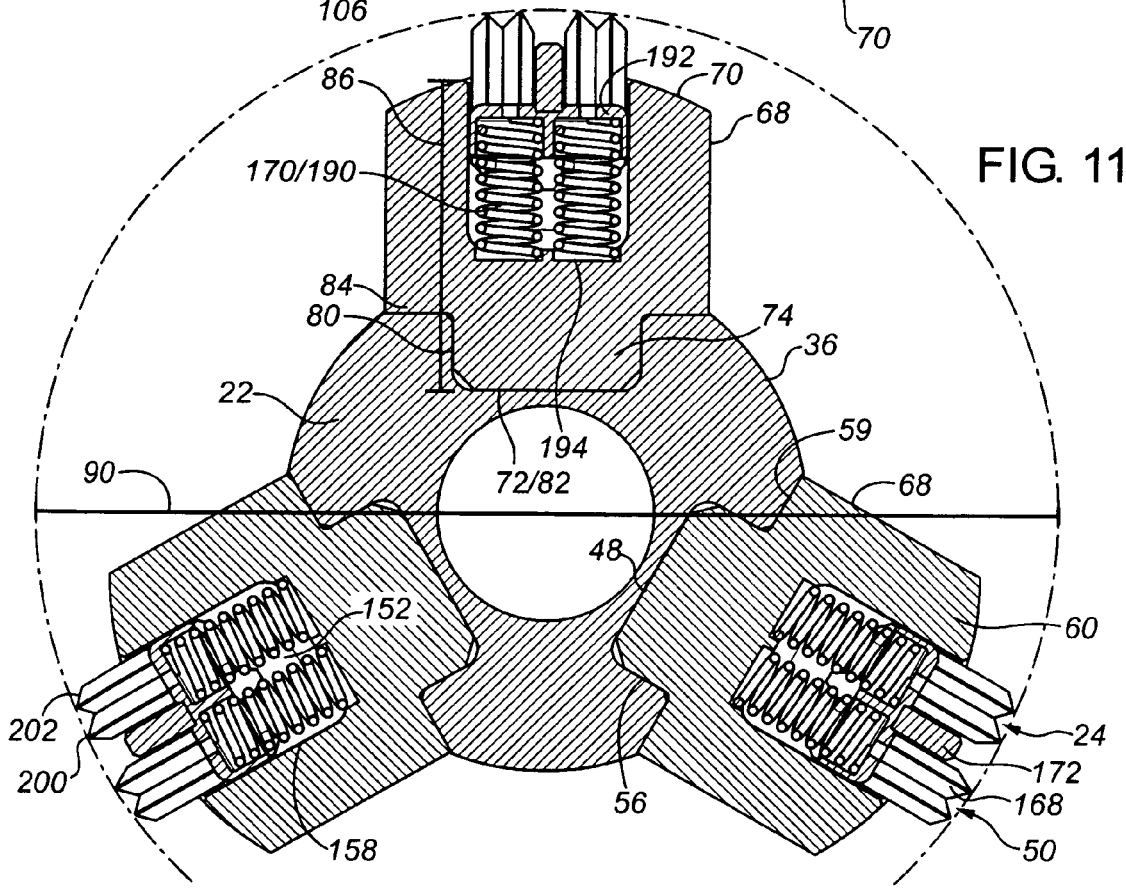
FIG. 11 is a cross-sectional view of the drilling apparatus taken along line 11—11 of FIG. 8 showing the second device size.
Figure 12:
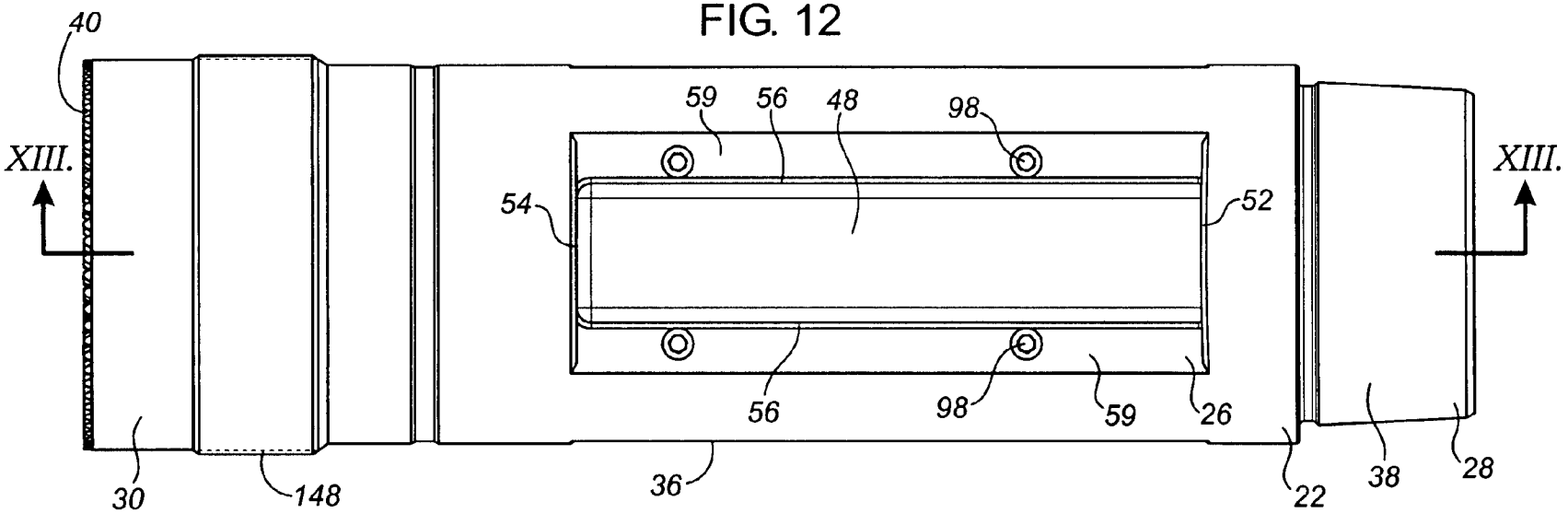
FIG. 12 is a side view of an apparatus housing of the drilling apparatus as shown in FIGS. 2 and 8.

Referring particularly to FIGS. 5 and 11, the assembly housing size, as shown by reference number (86), is defined by the maximum depth of the assembly housing (60) measured between the top surface (70) and the bottom surface (72) of the assembly housing (60). Thus, the assembly housing size is comprised of two components. The first component is the maximum depth of the lip portion (84) being the distance between the top surface (70) of the assembly housing (60) and the bottom surface (72) of the assembly housing (60) adjacent the projection (74). The second component is the maximum depth of the projection (74) being the distance between the bottom surface (72) of the assembly housing (60) adjacent the projection (74) and the bottom surface (82) of the projection (74).

In the preferred embodiment, the size or dimensions of the pockets (48) comprising the device mount (26) are substantially identical and capable of receiving any of the plurality of rotation restraining assemblies (50). In order to ensure that any of the plurality of rotation restraining assemblies (50) is receivable in each pocket (48), in the preferred embodiment, the size or dimensions of the projection (74) of the assembly housing (60) of each of the plurality of rotation restraining assemblies (50) for each of the plurality of rotation restraining devices (24) are also preferably identical. As a result, the second component of the assembly housing size provided by the depth of the projection (74) does not vary or change, but rather is constant or the same between the rotation restraining assemblies (50). Instead, the first component provided by the depth of the lip portion (84) is varied in order to vary the assembly housing size to provide the different device sizes.

For instance, each of the assembly housings (60) shown in FIG. 5 has an assembly housing size (86) which together define a first device size which provides a first drilling apparatus size, as shown by reference number (88), when the rotation restraining device (24) is mounted on the apparatus housing (22) and each rotation restraining member (62) is in an extended position as described herein. Each of the assembly housings (60) shown in FIG. 11 has a different assembly housing size (86) than that shown in FIG. 5 which together define a second device size which provides a second drilling apparatus size, as shown by reference number (90), when the rotation restraining device (24) is mounted on the apparatus housing (22) and each rotation restraining member (62) is in the extended position. In each of FIGS. 5 and 11, the second component of the assembly housing size (86) provided by the maximum depth of the projection (74) is the same. Thus, the differing assembly housing sizes, and thus the difference between the first and second device sizes, is achieved by varying only the second component of the assembly housing size (86) provided by the maximum depth of the lip portion (84).

Each rotation restraining assembly (50) may be secured within its respective pocket (48) in any manner and by any mechanism, structure or fastener capable of maintaining the rotation restraining assembly (50) in the pocket (48) during use of the drilling apparatus (20) while still permitting the release or removal of the rotation restraining assembly (50) therefrom as desired or required to interchange the rotation restraining device (24) to vary the drilling apparatus size. However, the drilling apparatus (20) is preferably further comprised of a securing mechanism (92), or a combination of a plurality of securing mechanisms, for securing each rotation restraining assembly (50) in its pocket (48). In the preferred embodiment, a similar securing mechanism (92) or combination of securing mechanisms (92) is used for each rotation restraining assembly (50). Alternately, different securing mechanisms (92) or combinations thereof may be used for each of the rotation restraining assemblies (50).

For instance, the securing mechanism (92) may be comprised of a fastener (94), and preferably a plurality of fasteners (94), such as a screw, bolt, pin or dowel extending between the rotation restraining assembly (50) and the apparatus housing (22). Any number of fasteners (94) may be used as required to perform the securing function either alone or in combination with one or more further securing mechanisms (92). Where one or more fasteners (94) are used, each fastener (94) preferably extends or passes between the assembly housing (60) and the apparatus housing (22). Each fastener (94) may extend between any two opposed surfaces of the assembly housing (60) and the apparatus housing (22).

Referring to FIGS. 1–2, 4, 6, 8, 10 and 12 of the preferred embodiment, four fasteners (94) are provided, two of which are provided adjacent each of the side surfaces (68) of the assembly housing (60) within the lip portion (84). Each fastener (94) preferably extends through the lip portion (84) and into the adjacent flat portion (59) of the exterior surface (36) of the apparatus housing (22) adjacent the pocket (48). Thus, the lip portion (84) of the assembly housing (60) adjacent each side surface (68) preferably defines one or more passages or apertures (96) extending between the top and bottom surfaces (70, 72) for the insertion of a fastener (94) therethrough. Further, the adjacent flat portion (59) of the apparatus housing (22) preferably defines a corresponding aperture (98) therein for receipt of an end of the fastener (94) therein.

Thus, the fastener (94) extends through the aperture (96) in the assembly housing (60) for receipt in the aperture (98) of the apparatus housing (22). Where the assembly housing size differs between rotation restraining assemblies (50), the length of the fastener (94) required to extend between the assembly housing (60) and the apparatus housing (22) will vary. Thus, as shown in FIGS. 5 and 11, the length of the fastener (94) is selected to correspond with the assembly housing size (86). In addition, in order to permit a small amount of movement of the housing assembly (60) relative to the apparatus housing (22) when the fasteners (94) are in position, the aperture (96) of the assembly housing (60) is preferably sized to be greater than the fastener (94) such that the wall of the aperture (96) is spaced apart from the fastener (94). As a result, an amount of movement of the assembly housing (60) will be permissible without placing any undue stress on the fastener (94).

In the preferred embodiment, each fastener (94) is comprised of a screw having an upper screw head (100) and a lower threaded end (102). The aperture (98) defined by the apparatus housing (22) has a threaded portion corresponding to the threaded end (102) of the screw such that the screw may threadably engage the aperture (98) when the lower threaded end (102) is received therein. Further, the aperture (96) defined by the assembly housing (60) preferably provides a shoulder (104) therein for engaging or contacting the screw head (100). Specifically, as the threaded end (102) of the screw is threaded within the aperture (98) in the apparatus housing (22), the screw head (100) abuts against the shoulder (104) and thereby secures the assembly housing (60) with the apparatus housing (22). If desired or required to enhance the function of the fastener (94), one or more washers (106) may be positioned between the screw head (100) and the shoulder (104). As well, a retaining ring (108) may be located adjacent the upper end or outermost surface of the screw head (100) to further retain the fastener (94) in position. Finally, a rubber stopper (110) or other sealing device or assembly may be provided in the aperture (96) of the assembly housing (60). Specifically, the rubber stopper (110) may be positioned between the retaining ring (108) and the screw head (100).

It has been found that the use of certain configurations of fasteners (94) alone, such as the screws described above, as the securing mechanism (92) may not be sufficient to retain the rotation restraining assembly (50) in position in the pocket (48) under some downhole conditions which may be encountered by the drilling apparatus (20) during the drilling operation. Therefore, as an alternative or in addition to the use of fasteners, a further securing mechanism (92) may be used.

Even where a further or alternative securing mechanism (92) is used, the fasteners (94) or screws described above are still used in the preferred embodiment to assist with or facilitate the assembly of the drilling apparatus (20). Specifically, the apparatus housing (22) is positioned horizontally and rotated so that a desired pocket (48) is facing upwardly for ease of access to position a rotation restraining assembly (50) therein. An I-bolt (not shown) or other lifting apparatus or device may be inserted and secured in the aperture (96) in the assembly housing (60) for lifting the rotation restraining assembly (50) such that it may be moved into position within the desired pocket (48). Once the rotation restraining assembly (50) is lowered into the pocket (48), the I-bolt is removed and a fastener (94) inserted therein to fasten the rotation restraining assembly (50) to the apparatus housing (22). Once the fasteners (94) are secured in position, the apparatus housing (22) may be further rotated so that a second desired pocket (48) is facing upwardly, while maintaining the rotation restraining assembly (50) in the desired position in the previous pocket (48).

As stated, in the preferred embodiment, a further securing mechanism (92) is provided which is comprised of at least one underlying surface (112) on the rotation restraining assembly (50) and at least one complementary overlying surface (114) on the device mount (26). Preferably, the securing mechanism (92) is comprised of a plurality of underlying surfaces (112) on the rotation restraining assembly (50) and a plurality of complementary overlying surfaces (114) on the mount (26). In the preferred embodiment, as described in detail below, an underlying surface (112) and a complementary overlying surface (114) are provided at or adjacent each of the first and second ends (64, 66) of the assembly housing (60).

More particularly, one of the plurality of underlying surfaces (112) on the rotation restraining assembly (50) is comprised of an overcut angular surface (116) on the assembly housing (60), particularly on the projection (74), and the complementary overlying surface (114) is comprised of a complementary undercut angular surface (118) on the apparatus housing (22), particularly within the pocket (48). The overcut angular surface (116) and the complementary undercut angular surface (118) may be provided by any of the adjacent ends or surfaces of the projection (74) and pocket (48) respectively. Preferably, the overcut angular surface (116) and the complementary undercut angular surface (118) are provided by one or both of the adjacent first ends (76, 52) of the projection (74) and pocket (48) respectively and the adjacent second ends (78, 54) of the projection (74) and pocket (48) respectively.

Referring to FIGS. 3, 7, 9 and 13, in the preferred embodiment, the overcut angular surface (116) is provided by or comprised of the first end (76) of the projection (74) and the complementary undercut angular surface (118) is provided by or comprised of the adjacent first end (52) of the pocket (48). Preferably an angle of about 3 degrees, or between about 2 to 4 degrees is provided between the overcut and undercut angular surfaces (116, 118) to maintain the projection (74) of the assembly housing (60) in the pocket (48). In order to properly secure the rotation restraining assembly (50) with the assembly housing (22), the overcut and undercut angular surfaces (116, 118) are preferably maintained in engagement with each other. Thus, the securing mechanism (92) in this case is preferably further comprised of an urging mechanism (120) for urging into engagement the overcut angular surface (116) and the undercut angular surface (118). The preferred embodiment of the urging mechanism (120) is described below. However, any structure, mechanism or device may be used which urges the assembly housing (60) axially or longitudinally relative to the apparatus housing (22) in the direction of the first end (28) of the apparatus housing (22).

In addition, referring to FIGS. 1–3, 8–9 and 12–19, the device mount (26) is preferably further comprised of an axially movable member (122) positioned on the apparatus housing (22). The axially movable member (122) is axially movable in a securing direction toward a securing position in which the axially movable member (122) overlies the rotation restraining assembly (50) so that one of the plurality of overlying surfaces (114) on the device mount (26) is comprised of the axially movable member (122). In the preferred embodiment, the securing direction is in the direction of the first end (28) of the apparatus housing (22). Thus, the axially movable member (122) is axially movable in the direction of the first end (28) of the apparatus housing (22), being the securing direction, toward the securing position. In the preferred embodiment, in the securing position, the axially movable member (122) overlies the assembly housing (60). In particular, the complementary underlying surface (112) is provided or defined by the second end (66) of the assembly housing (60). Thus, the overlying surface (114) of the axially movable member (122) engages the underlying surface (112) of the second end (66) of the assembly housing (60).

The axially movable member (122) is preferably comprised of at least one ring which surrounds the apparatus housing (60). In the preferred embodiment, the axially movable member (122) is comprised of an abutment ring (124) which surrounds the apparatus housing (22) and a locking ring (126) which surrounds the apparatus housing (22). The abutment ring (124) may also be referred to as a flow diverter ring. For reasons discussed below, the abutment ring (124) is axially positioned between the locking ring (126) and the second end (66) of the assembly housing (60).

The abutment ring (124), which is shown in isolation in FIGS. 14–17, is slidably positioned about the apparatus housing (22). More particularly, the abutment ring (124) is comprised of a ring portion (128) and at least one arm (130), and preferably a plurality of arms (130), extending from the ring portion (128). When positioned about the apparatus housing (22), the arms (130) extend axially or longitudinally, preferably substantially parallel with the longitudinal axis of the apparatus housing (22), in the securing direction. Further, when the axially movable member (122) including the abutment ring (124) is in the securing position, the ring portion (128) abuts against each of the rotation restraining assemblies (50) and at least a portion of each arm (130) is axially or longitudinally aligned with at least one, and preferably each, of the plurality of rotation restraining assemblies (50) so that rotation of the abutment ring (124) relative to the apparatus housing (22) is inhibited by the rotation restraining assemblies (50).

More particularly, in the preferred embodiment, three arms (130) are spaced circumferentially about the ring portion (128). The arms (130) are positioned about the ring portion (128) such that a single arm (130) extends longitudinally between two adjacent rotation restraining assemblies (50). Further, each arm (130) is preferably sized or configured to be closely received between the two adjacent rotation restraining assemblies (50) such that the opposed side surfaces (132) of each arm (130) is adjacent or in proximity to the adjacent side surface (68) of the assembly housing (60) of the rotation restraining assembly (50). Finally, each arm (130) is preferably tapered or sloped from the ring portion (128) outwardly. In other words, the thickness of each arm (130), as shown by reference number (133) in FIG. 14, decreases in a direction away from the ring portion (128).

Further, the ring portion (128) of the abutment ring (124) defines an abutment ring shoulder (134) for abutting or engaging the rotation restraining assembly (50) when the abutment ring (124) is moved to the securing position. More particularly, the spaces or portions of the ring portion (128) between the arms (130) comprise the abutment ring shoulder (134). Thus, in the securing position, the abutment ring shoulder (134) engages the second end (66) of the assembly housing (60). In the preferred embodiment, the second end (66) of the assembly housing (60) defines an assembly housing shoulder (136) which corresponds with the abutment ring shoulder (134) such that the shoulders (134, 136) abut against each other as the axially movable member (122) including the abutment ring (124) is moved in the securing direction. Accordingly, in the securing position, the abutment ring (124) provides an overlying surface (114) overlying the underlying surface (112) of the second end (66) of the assembly housing (60) and the abutment ring shoulder (136) engages the assembly housing shoulder (136).

Figure 19:
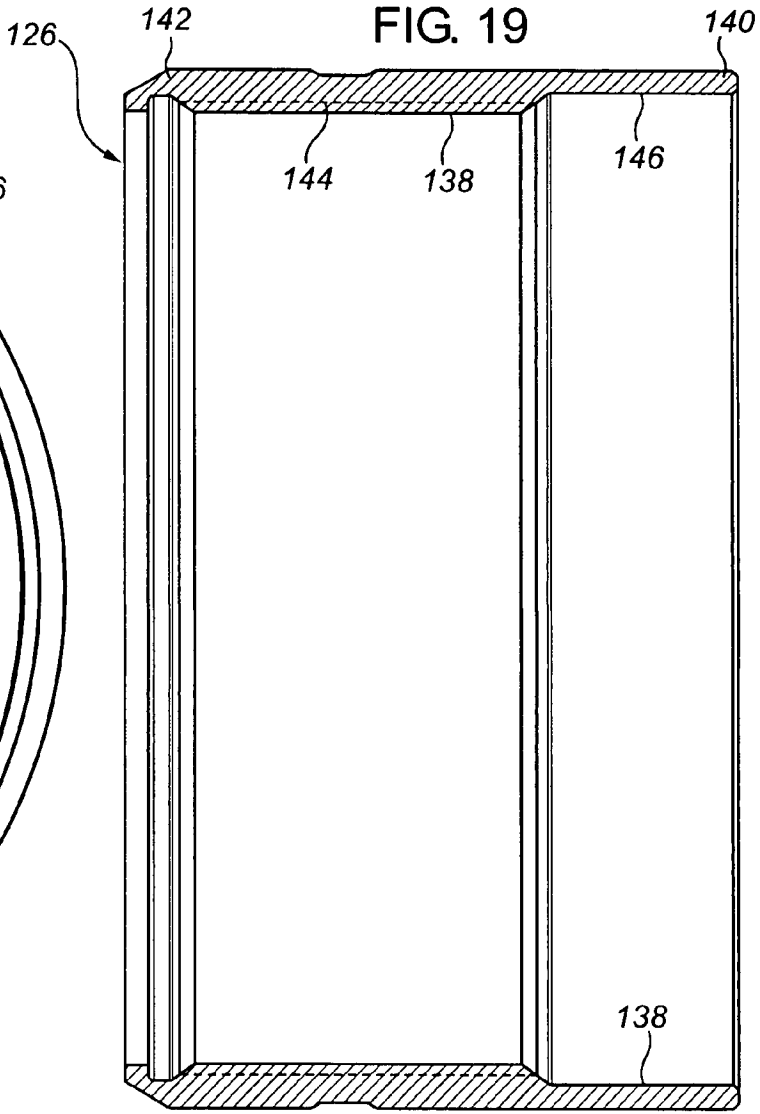
FIG. 19 is a sectional view of the locking ring taken along line 19—19 of FIG. 18.
Figure 18:
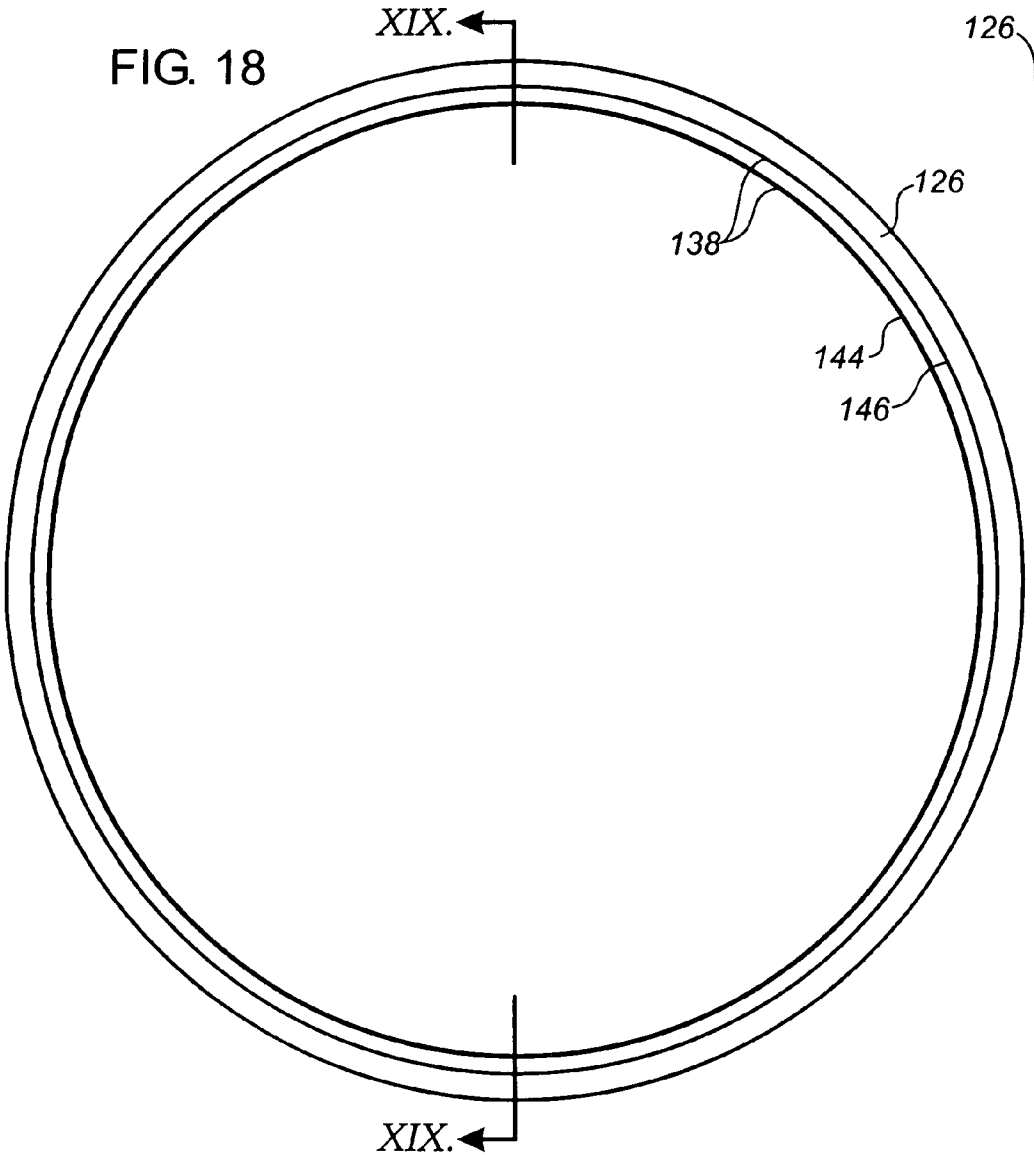
FIG. 18 is an end view of a locking ring of the drilling apparatus as shown in FIGS. 2 and 8.
Figure 20:
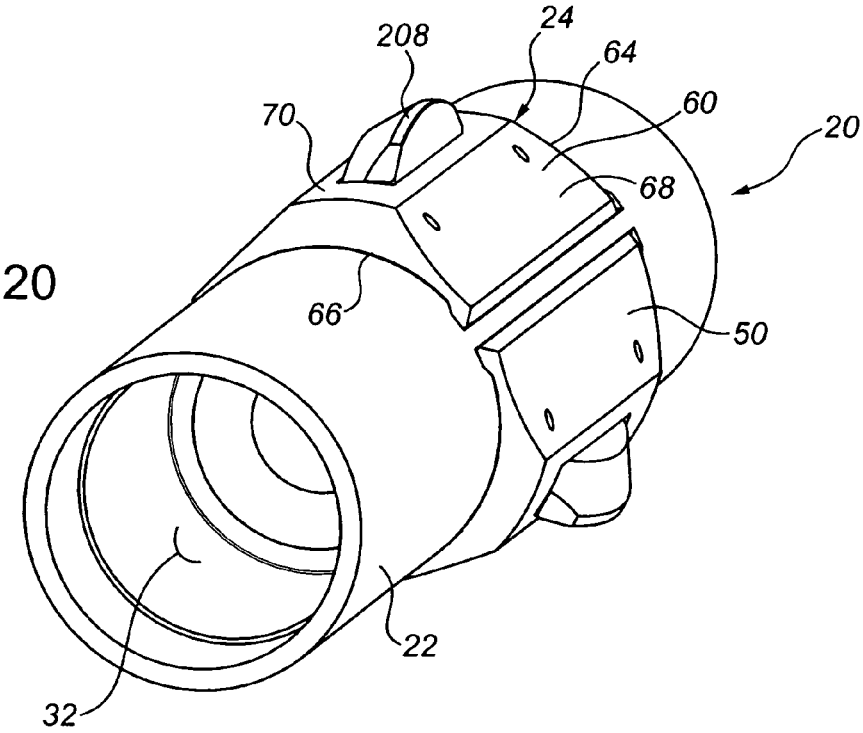
FIG. 20 is a pictorial view of a first alternate embodiment of the variable gauge drilling apparatus comprised of an interchangeable borehole engaging device.
Figure 21:
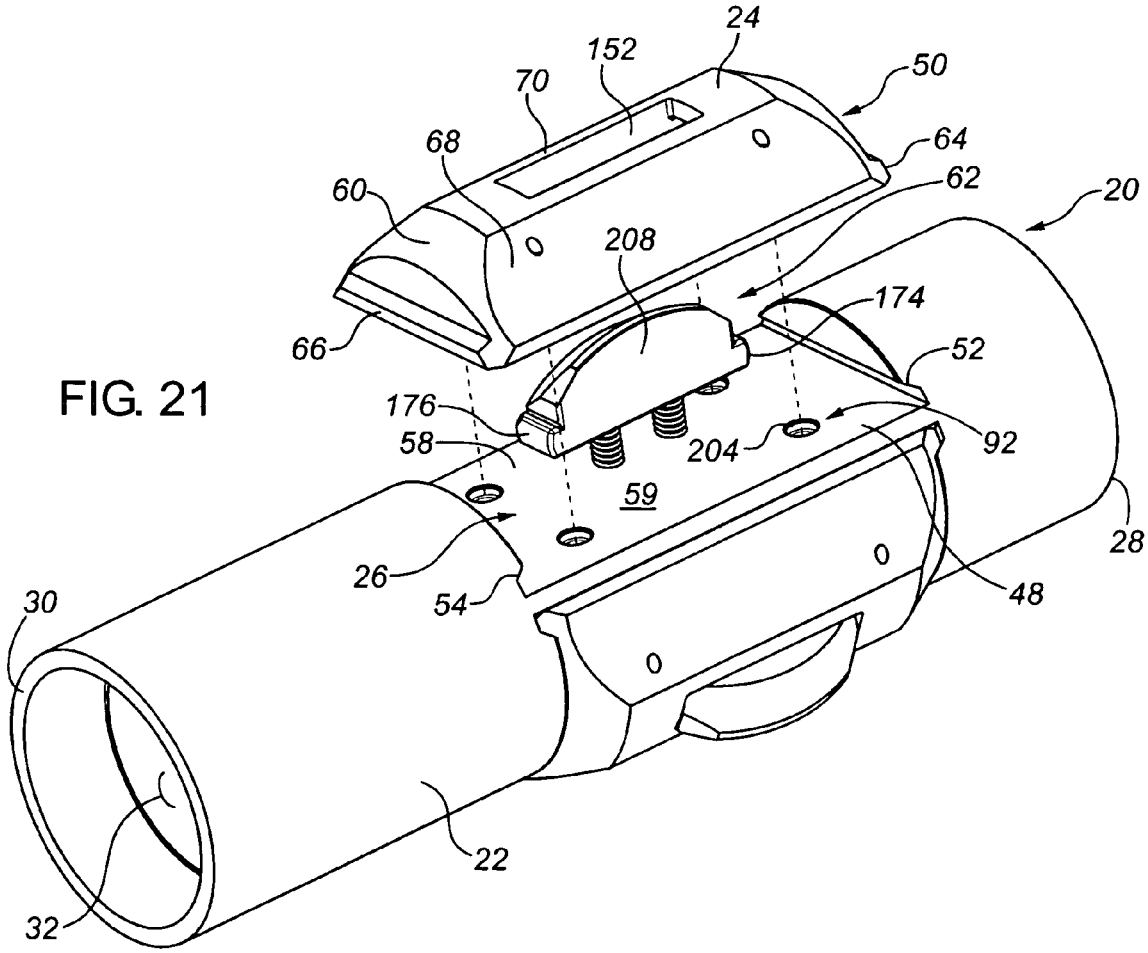
FIG. 21 is an exploded pictorial view of the variable gauge drilling apparatus shown in FIG. 20.

The locking ring (126), which is shown in isolation in FIGS. 18–19, is positioned about the apparatus housing (22) such that the abutment ring (124) is axially positioned between the locking ring (126) and the second end (66) of the assembly housing (60). Accordingly, movement of the locking ring (126) axially or longitudinally in the securing direction will cause the locking ring (126) to abut against or engage the abutment ring (124) causing the abutment ring (124) to slide longitudinally in the securing direction to abut against or engage the second end (66) of the housing assembly (60). The locking ring (126) is preferably movably connected with the apparatus housing (60) in a manner permitting a desired position of the locking ring (126) relative to the apparatus housing (22) to be maintained during use of the drilling apparatus (20). In the preferred embodiment, the locking ring (126) is threadably connected with the apparatus housing (22).

More particularly, referring to FIGS. 3, 9 and 18–19, the locking ring (126) has an inner surface (138), a first end (140) and an opposed second end (142). When positioned about the apparatus housing (22), the first end (140) of the locking ring (126) extends towards the first end (28) of the apparatus housing (22) and the second end (142) of the locking ring (126) extends towards the second end (30) of the apparatus housing (22). Further, the inner surface (138) is preferably comprised of a threaded portion (144) adjacent the second end (142) of the locking ring (126) and a slidable non-threaded portion (146) adjacent the first end (140) of the locking ring (126). The exterior surface (36) of the apparatus housing (22) adjacent the second end (28) of the apparatus housing (22) preferably defines a threaded portion (148) compatible with the threaded portion (144) of the locking ring (126) to provide a threaded connection therebetween. Thus, the locking ring (126) may be rotated relative to the apparatus housing (22) to move the locking ring (126) axially or longitudinally towards or away from the securing position.

When moved towards the securing position, the first end (140) of the locking ring (126) abuts against or engages the adjacent abutment ring (124) to slidably move the abutment ring (124) towards the securing position and to subsequently retain the abutment ring (124) in the securing position. Further, in the preferred embodiment, the non-threaded portion (146) of the locking ring (126) provides a further overlying surface (114) for overlying the underlying surface (112) of the second end (66) of the assembly housing (60) in the securing position. Thus, in the preferred embodiment, the securing mechanism (92) is comprised of the underlying surface (122) of the second end (66) of the assembly housing (60) and the complementary overlying surfaces (114) of the abutment ring (124) and the locking ring (126).

As discussed previously, an urging mechanism (120) is provided for urging the overcut angular surface (116) of the first end (76) of the projection (74) of the assembly housing (60) into engagement with the undercut angular surface (118) of the first end (52) of the pocket (48). Preferably, the urging mechanism (120) is comprised of the axially movable member (122) such that the overcut angular surface (116) and the undercut angular surface (118) are urged into engagement by axial movement of the axially movable member (122) in the securing direction. Further, the axially movable member (122) is comprised of an urging shoulder (150) for engaging the rotation restraining assembly (50) and the urging mechanism (120) is comprised of the urging shoulder (150).

More particularly, in the preferred embodiment, the urging mechanism (120) is comprised of the combination of the locking ring (126) and the abutment ring (124). Axial movement of the locking ring (126) in the securing direction causes a corresponding axial movement of the abutment ring (124) such that the abutment ring (124) contacts the assembly housing (60) to move the assembly housing (60) axially to urge the first end (76) of the projection (74) of the assembly housing (60) into engagement with the first end (52) of the pocket (48) Further, in the preferred embodiment, the urging shoulder (150) of the axially movable member (122) is comprised of the abutment ring shoulder (134) of the abutment ring (124) which engages the assembly housing shoulder (136) of the second end (66) of the assembly housing (60). Thus, the urging mechanism (120) is comprised of the abutment ring shoulder (134).

Thus, the abutment ring (124) preferably performs several functions. First, the abutment ring (124) acts as a securing mechanism (92) which secures the rotation restraining assembly (50) to the apparatus housing (22)by providing an overlying surface (114). Second, the arms (130) of the abutment ring (124) assist in preventing any relative rotation between the abutment ring (124) and the rotation restraining assemblies (50) during assembly or use of the drilling apparatus (20) and may assist in stabilizing the rotation restraining assembly (50) during use of the drilling apparatus (20). Third, the abutment ring (124), and in particular the arms (130) thereof, provides a smooth transition between the relative diameters of the rotation restraining assemblies (50) and the apparatus housing (22).

Finally, the abutment ring (124) is preferably relatively more deformable than both the rotation restraining assembly (50), and in particular the assembly housing (60), and the locking ring (126). Thus, the abutment ring (124) comprises or provides a yieldable member or yieldable surface between the assembly housing (60) and the locking ring (126) which facilitates the assembly of the drilling apparatus (20) and which enhances or facilitates the locking action of the locking ring (126) when the locking ring (126) is in the securing position.

Similarly, the locking ring (126) preferably performs various functions. First, the locking ring (126) also acts as a securing mechanism (92) which secures the rotation restraining assembly (50) to the apparatus housing (22) by providing an overlying surface (114). Second, the locking ring (126) facilitates or assists the action of the abutment ring (124) by maintaining the abutment ring (124) in the desired secured position during use of the drilling apparatus (20). Third, the locking ring (126) facilitates or assists the engagement of the undercut and overcut angular surfaces (118, 116) by urging the adjacent ends (76, 52) of the assembly housing (60) and the pocket (48) together in the secured position during use of the drilling apparatus (20). In other words, the locking ring (126) holds or maintains each assembly housing (60) in its respective pocket (48) by sandwiching the assembly housing (60) between the first end (52) of the pocket (48) and the abutment ring (124).

As stated, each of the plurality of rotation restraining assemblies (50) is comprised of the assembly housing (60) and a rotation restraining member (62) connected with the assembly housing (60). The rotation restraining member (62) may be connected with the assembly housing (60) either permanently or removably. Preferably, the rotation restraining member (62) is detachably or removably connected with the assembly housing (60) such that it may be readily removed for repairs, maintenance or replacement.

Preferably, the assembly housing (60) defines a compartment (152), space or enclosure therein, accessible from at least the top surface (70) of the assembly housing (60), for receipt of the rotation restraining member (62). The compartment (152) may also be accessible from the bottom surface (72) of the assembly housing (60) where a continuous or unitary projection (74) is not provided along the bottom surface (72). Thus, the compartment (152) defined by the assembly housing (60) may have any shape adapted for accepting, receiving or containing the rotation restraining member (62) or a portion thereof.

In the preferred embodiment, referring to FIGS. 1, 3–7 and 9–11, the compartment (152) is comprised of an elongate indentation or cavity within the top surface (70) of the assembly housing (60) which is preferably oriented longitudinally or axially aligned such that a longitudinal axis of the compartment (152) is substantially parallel with the longitudinal axis of the apparatus housing (22) when the assembly housing (60) is mounted with the apparatus housing (22). Further, the compartment (152) is aligned in the assembly housing (60) such that the compartment (152) is particularly defined by or within the projection (74) of the assembly housing (60).

Thus, in the preferred embodiment, the compartment (152) is preferably rectangular in shape having opposed first and second ends (154, 156) extending towards the first and second ends (76, 78) respectively of the projection (74) of the assembly housing (60), opposed side surfaces (158) adjacent the side surfaces (80) of the projection (74) and a bottom surface (160) adjacent the bottom surface (82) of the projection. Accordingly, the particular dimensions of the compartment (152) will be dependent upon the dimensions of the projection (74) and the amount of space required to affix or fasten the rotation restraining member (62) therein.

Referring to FIGS. 1–5 and 8–11, each of the rotation restraining members (62) is comprised of a carriage assembly (162) and one or more borehole engaging elements or members (164) carried by the carriage assembly (162) for engaging the wall of the borehole when inserted in the subject borehole (21). Further, the carriage assembly (162) is retained in the compartment (152) by a carriage retainer (166). Each of the borehole engaging elements or members (164) may be comprised of a roller, piston, blade, pad or other borehole engaging structure able to perform a rotation restraining or anti-rotation function. In the preferred embodiment, the borehole engaging element or member (164) is a roller (168) and each of the rotation restraining members (62) is comprised of a plurality of rollers (168).

Each of the rotation restraining members (62), comprised of the carriage assembly (162) and the plurality of rollers (168), is connected or mounted within the compartment (152) of the assembly housing (60). Preferably, the rotation restraining member (62) is mounted in the compartment (152) in a manner such that the rotation restraining member (62) is capable of movement between a retracted position and an extended position. Further, the rotation restraining assembly (62) is preferably comprised of at least one biasing device (170) for biasing the rotation restraining member (62) toward the extended position as shown in each of FIGS. 3–5 and 9–11. In the preferred embodiment, the carriage assembly (162) is mounted within the compartment (152) by the carriage retainer (166) in a manner such that the carriage assembly (162) is movable between the retracted and extended positions. The biasing device (170) acts upon the carriage assembly (162) for biasing the carriage assembly (162) toward the extended position. In the extended position, the rotation restraining member (62), and thus the plurality of rollers (168), extend radially outwardly from the assembly housing (60) for engaging the borehole wall. Movement in an opposite direction radially inwardly towards the retracted position facilitates the movement of the drilling apparatus (20) through the borehole.

The carriage assembly (162) is comprised of an elongate member (172) having opposed first and second ends (174, 176) and sized to fit within the compartment (152) proximate to the first and second ends (154, 156) of the compartment (152) respectively. Each of the first and second ends (174, 176) of the elongate member (172) defines an outwardly facing engagement shoulder (178). The elongate member (172) is retained within the compartment (152) by the carriage retainer (166). The carriage retainer (166) may be integrally formed with the assembly housing (60) or may be comprised of one or more separate or distinct elements or members.

In the preferred embodiment, the carriage retainer (166) is comprised of two retainer members (180). Each retainer member (180) is sized and configured to be insertable between one of the first and second ends (154, 156) of the compartment (152) and the first and second ends (174, 176) of the elongate member (172) respectively. Further, each retainer member (180) defines a groove or slot (182) therein for receipt of the respective end (174, 176) of the elongate member (172). Each slot (182) further defines an inwardly facing engagement shoulder (184) compatible for engagement with the outwardly facing engagement shoulder (178) on the first and second ends (174, 176) of the elongate member (172).

Thus, each of the first and seconds (174, 176) of the elongate member (172) is received with the slot (182) of one of the retainer members (180). The retainer members (180) are then inserted in position within the compartment (152) and removably or detachably mounted within the compartment (152). Although each retainer member (180) may be held in the compartment (152) by any retaining mechanism, in the preferred embodiment, one or more spring tensions pins (186) is extended or passed through the assembly housing (60) between the side surfaces (68) at a location such that the pins (186) also extend through the retainer member (180) in the compartment (152) defined by the assembly housing (60). Corresponding pin holes (188) are provided in each of the assembly housing (60) and retainer members (180) to permit the passage of the tension pin (186) therethrough.

Once mounted within the compartment (152), the first and second ends (174, 176) of the elongate member (172) are movable within the slots (182) of the retainer members (180). The elongate member (172) is movable radially outwardly to the extended position of the carriage assembly (162), which defines the extended position of the rotation restraining member (62). In the extended position, the outwardly facing engagement shoulders (178) of the elongate member (172) engage the inwardly facing engagement shoulders (184) of the retainer members (180). Conversely, the elongate member (172) is movable radially inwardly to the retracted position of the carriage assembly (162), which defines the retracted position of the rotation restraining member (62). Any movement inwardly away from the extended position as defined above is considered to be a retracted position. However, the rotation restraining member (62) is in a fully retracted position when further inward radial movement of the elongate member (172) is prevented. For instance, the elongate member (172) may abut against or engage the bottom surface (160) of the compartment (152). However, in the preferred embodiment, the biasing device (170) is positioned between the elongate member (172) and the bottom surface (160), as discussed further below, which prevents the abutment of the elongate member (172) with the bottom surface (160).

The biasing device (170) is provided to bias the rotation restraining assembly (62), and particularly the carriage assembly (162) to the extended position. Any biasing device or urging mechanism may be used, however, in the preferred embodiment, the biasing device (170) is comprised of at least one spring (190). In the preferred embodiment, four springs (190) are positioned between the elongate member (172) and the bottom surface (160) of the compartment (152) such that the springs (190) are compressed as the carriage assembly (162) moves inwardly away from the extended position. Further, in the preferred embodiment, the carriage assembly is comprised of at least one spring mount (192), and preferably four, permanently or detachably mounted with the elongate member (172) for receiving an end of the spring (190) therein. Further, the bottom surface (160) of the compartment (152) preferably defines at least one corresponding spring indentation (194), and preferably four, for receiving the other end of the spring (190) therein. Thus, each of the springs (190) is held in position between the spring mount (192) and the corresponding spring indentation (194). The outwardly biasing force or spring force may be selected according to the expected drilling conditions.

The carriage assembly (162) is provided for carrying the plurality of rollers (168). In use, at least one of the rollers (168) of one of the rotation restraining assemblies (50) engages the borehole wall at all times to slow or inhibit the rotation of the apparatus housing (22) within the borehole. Each of the rollers (168) is preferably mounted with or carried by the carriage assembly (162), and particularly the elongate member (172), such that each roller (168) has an axis of rotation substantially perpendicular to the longitudinal axis of the apparatus housing (22) and is oriented such that the roller (168) is capable of rolling about its axis of rotation in response to a force exerted on the roller (168) substantially in the direction of the longitudinal axis of the apparatus housing (22). For instance, as a longitudinal force is exerted through the drilling string from the surface, the roller (168) rolls about its axis to permit the drilling apparatus (20) to move through the borehole in either an uphole or downhole direction as required.

Further, the plurality of rollers (168) within each rotation restraining member (62) are preferably mounted in one or more sets (196) of rollers (168) such that each set (196) of rollers (168) has a substantially common axis of rotation. In the preferred embodiment, each rotation restraining member (62) is comprised of two sets (196) of rollers (168) and wherein each set (196) is comprised of four rollers (168)

rotatably mounted on a single roller shaft (198). Each roller shaft (198) extends through the elongate member (172), wherein two rollers (168) are mounted on each of the opposed sides of the elongate member (172).

Each roller (168) may have any shape or configuration permitting it to roll or move longitudinally through the borehole, while also restraining the rotation of the apparatus housing (22). Preferably each roller (168) is comprised of a peripheral surface (200) about a circumference of the roller (168) permitting it to roll or move longitudinally within the borehole. In addition, the peripheral surface (200) is preferably comprised of an engagement surface (202) for engaging the borehole wall to restrain rotation of the apparatus housing (22). The engagement surface (202) may have any shape or configuration capable of contacting and engaging the borehole wall. Preferably, the engagement surface (202) is comprised of the peripheral surface of the roller (168) being tapered.

As stated above, the present invention is further comprised of a method for assembling a variable gauge drilling apparatus (20) for insertion in the subject borehole (21) as discussed above. The preferred embodiment of the method may be used with any suitable variable gauge drilling apparatus but is particularly suited for use with the drilling apparatus (20) as described herein. Further, the method is preferably performed utilizing the preferred embodiment of the drilling apparatus (20) described herein but may also be performed with each of the alternate embodiments described below. Finally, the method is applicable for use with a drilling apparatus (20) comprised of a plurality of any interchangeable borehole engaging devices (24) such as stabilizing devices or underreaming devices but is particularly described herein for use with a plurality of interchangeable rotation restraining devices.

Preferably, the method comprises selecting the apparatus housing (22). As described above, the apparatus housing (22) has a housing size (27) which is suitable for insertion in the subject borehole (21). The housing size is selected to be smaller than the subject borehole size (23) such that the apparatus housing (22) is insertable therein. In addition, the apparatus housing (22) is selected so that the housing size is smaller than the subject borehole size (23) to an extent sufficient to prevent blockage of the annulus or clearance space (25) between the apparatus housing (22) and the wall of the subject borehole (21) during use of the drilling apparatus (20) to permit the passage of fluids therethrough.

A rotation restraining device (24) is then selected from the plurality of interchangeable rotation restraining devices (24), which is referred to herein as the selected rotation restraining device (24). The selected rotation restraining device (24) is chosen or selected so that the selected rotation restraining device (24) has a device size which will provide the drilling apparatus (20) with a selected drilling apparatus size. In the preferred embodiment, selecting the rotation restraining device (24) is comprised of selecting a selected assembly housing size for the assembly housing (60) of each of the rotation restraining assemblies (50) comprising the rotation restraining device (24).

The selected drilling apparatus size is chosen to be compatible for use of the drilling apparatus (20) within the subject borehole (21). More particularly, the selected rotation restraining device (24) is preferably selected to provide a selected drilling apparatus size such that the rotation restraining device (24) will engage the borehole during use of the drilling apparatus (20) to inhibit rotation of the apparatus housing (22) relative to the borehole. In the preferred embodiment, the selected rotation restraining device (24) is selected so that the selected drilling apparatus size is approximately equal to the borehole size.

Once each of the apparatus housing (22) and the selected rotation restraining device (24) are selected to achieve the selected drilling apparatus size, the selected rotation restraining device (24) is mounted on the apparatus housing (22) using the universal rotation restraining device mount (24) located on the apparatus housing (22). More particularly, as described previously, the assembly housing (60) of each rotation restraining assembly (50) is mounted within its respective pocket (48). The securing mechanisms (92) are utilized to secure the assembly housing (60) to the apparatus housing (22).

More particularly, in greater detail with respect to the preferred embodiment, the abutment ring (124) is first passed over the exterior surface (36) of the apparatus housing (22) from the first end (28) of the apparatus housing (22), being the downhole end, towards the second end (30), being the uphole end, until the abutment ring (124) abuts the threaded portion (148) of the exterior surface (36) of the apparatus housing (22). The locking ring (126) is then passed over the second end (30) of the apparatus housing (22) and the threaded portion (144) of the inner surface (138) of the locking ring (126) is partially threaded onto the threaded portion (148) of the exterior surface (36) of the apparatus housing (22).

The projection (74) of the assembly housing (60) of each of the three rotation restraining assemblies (50) are subsequently sequentially inserted into the three pockets (48) of the device mount (26). As discussed previously, the fasteners (94) are preferably utilized to hold each assembly housing (60) in place such that the assembly housing (60) does not drop out of its respective pocket (48) during rotation of the apparatus housing (22) during assembly. In this case, the fasteners (94) are not fully tightened in order to allow for shifting or some movement of the assembly housing (60) within the pocket (48) during the subsequent torquing of the locking ring (126) as discussed below.

The drilling apparatus (20) is then connected with the remaining pieces or components of the drilling string so that the drilling string can provide a reaction force to offset the force required to torque the locking ring (126). The locking ring (126) is subsequently fully threaded onto the threaded portion (148) of the exterior surface (36) of the apparatus housing (22) so that each of the rotation restraining assemblies (50), and in particular each of the assembly housings (60), is sandwiched between the first end (52) of the pocket (48) and the abutment ring (124) and is tightened to a desired torque level. The fasteners (94) may now be fully tightened to provide a secondary securing mechanism (92).

When the drilling apparatus (20) is subsequently desired to be used in a second subject borehole (21) having a subject borehole size (23) different from that of the first subject borehole (21), the first selected rotation restraining device (24) may be removed by reversing the above steps. A second rotation restraining device (24) may then be selected and the process repeated for mounting the second selected rotation restraining device (24) with the device mount (26).

In particular, a second selected rotation restraining device (24) is selected from the plurality of interchangeable rotation restraining devices (24). The second selected rotation restraining device (24) is chosen or selected so that the second selected rotation restraining device (24) has a different device size which will provide the drilling apparatus (20) with a second selected drilling apparatus size. In the preferred embodiment, selecting the second rotation restraining device (24) is comprised of selecting a second selected assembly housing size for the assembly housing (60) of each of the rotation restraining assemblies (50) comprising the rotation restraining device (24). The second selected drilling apparatus size is chosen to be compatible for use of the drilling apparatus (20) within the second subject borehole (21).

The second selected rotation restraining device (24) is also mounted on the apparatus housing (22) using the universal rotation restraining device mount (24). More particularly, the assembly housing (60) of each rotation restraining assembly (50) is mounted within its respective pocket (48) and the securing mechanisms (92) are utilized to secure the assembly housing (60) to the apparatus housing (22).

Figure 29:
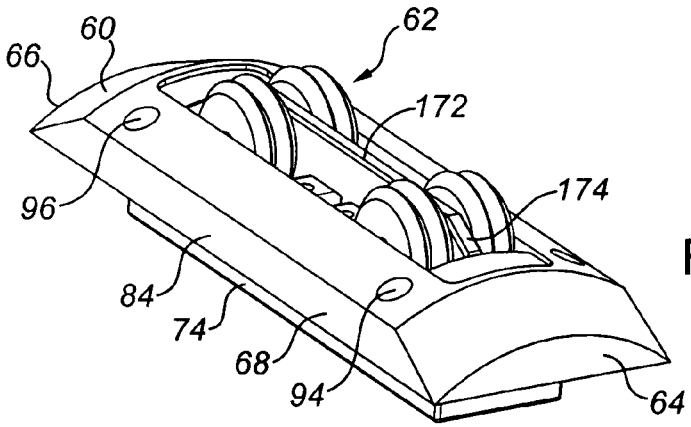
FIG. 29 is a pictorial view of a rotation restraining assembly of the variable gauge drilling apparatus shown in FIG. 27.
Figure 30:
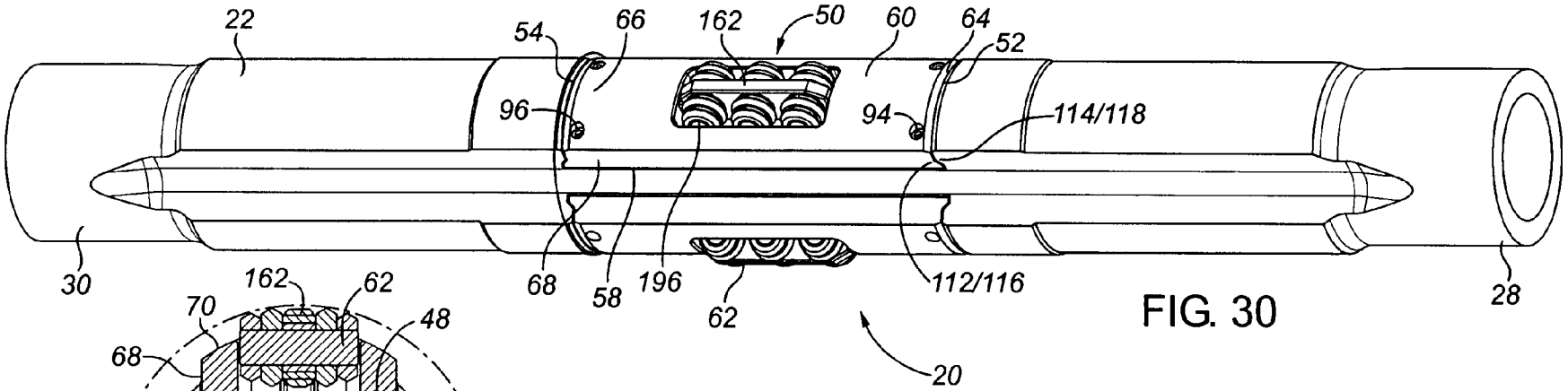
FIG. 30 is a pictorial side view of a third alternate embodiment of the variable gauge drilling apparatus comprised of an interchangeable borehole engaging device.
Figure 32:
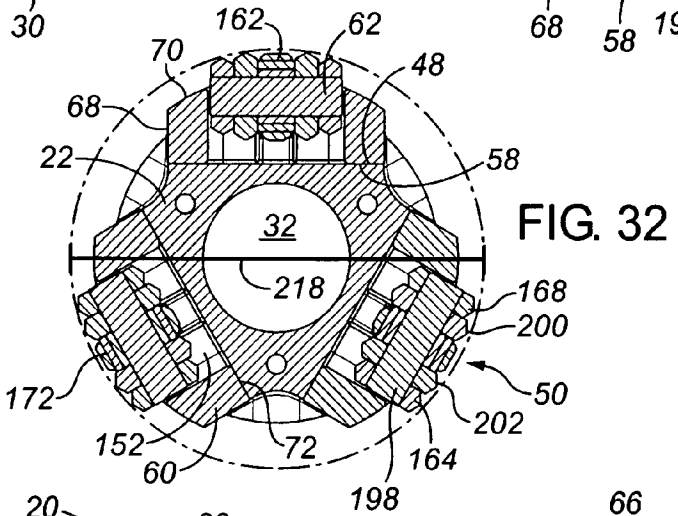
FIG. 32 is a cross-sectional view of the variable gauge drilling apparatus taken along line 32—32 of FIG. 31.
Figure 31:
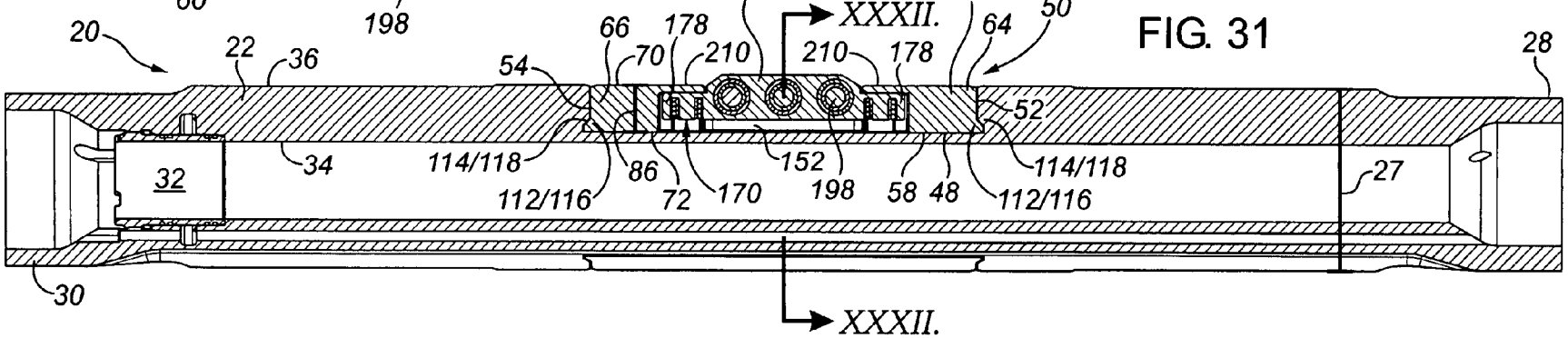
FIG. 31 is a longitudinal sectional view of the variable gauge drilling apparatus shown in FIG. 30.
Figure 33:
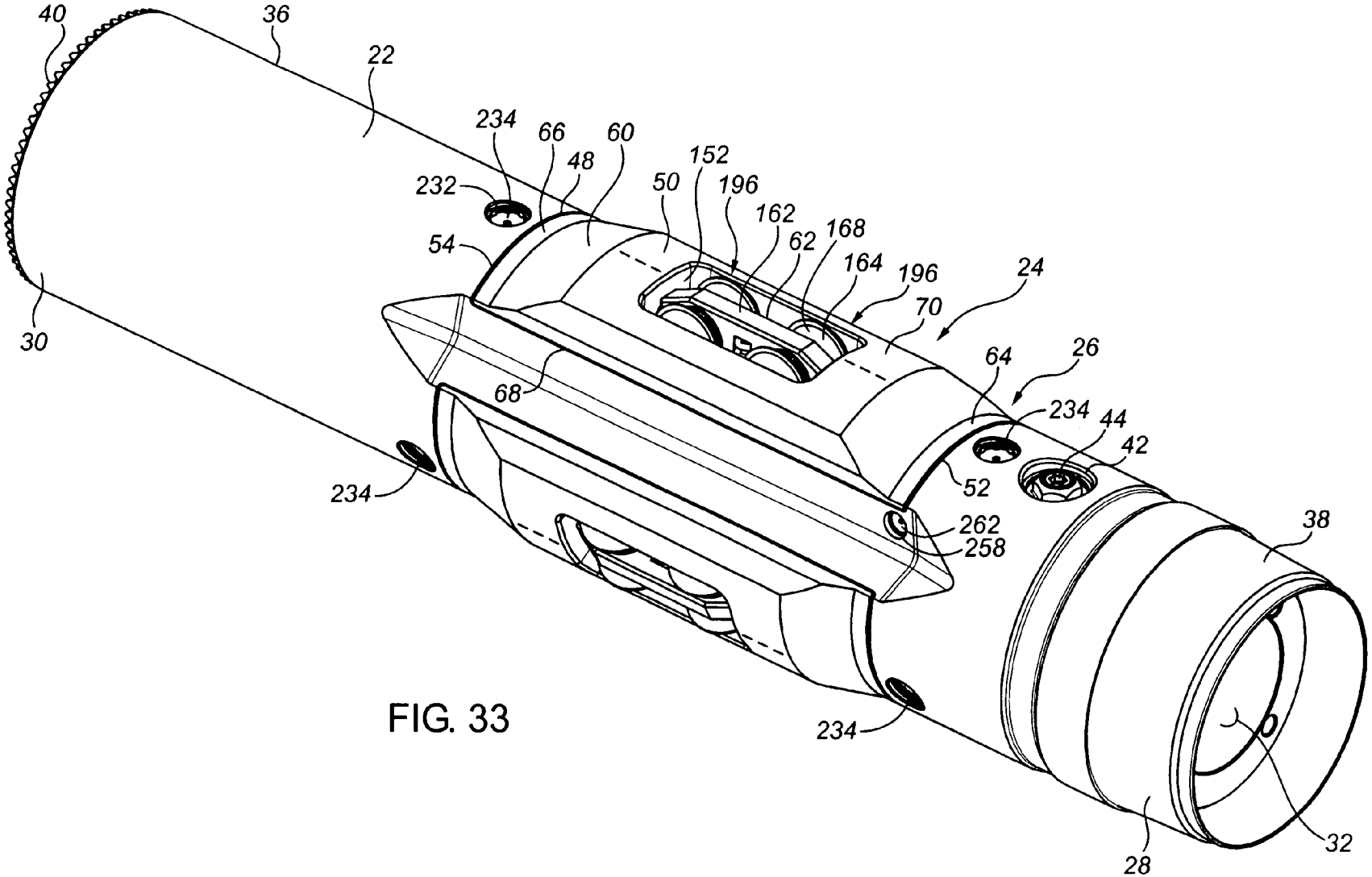
FIG. 33 is a pictorial view of a fourth alternate embodiment of the variable gauge drilling apparatus comprised of an interchangeable borehole engaging device including a rotation restraining assembly.
Figure 34:
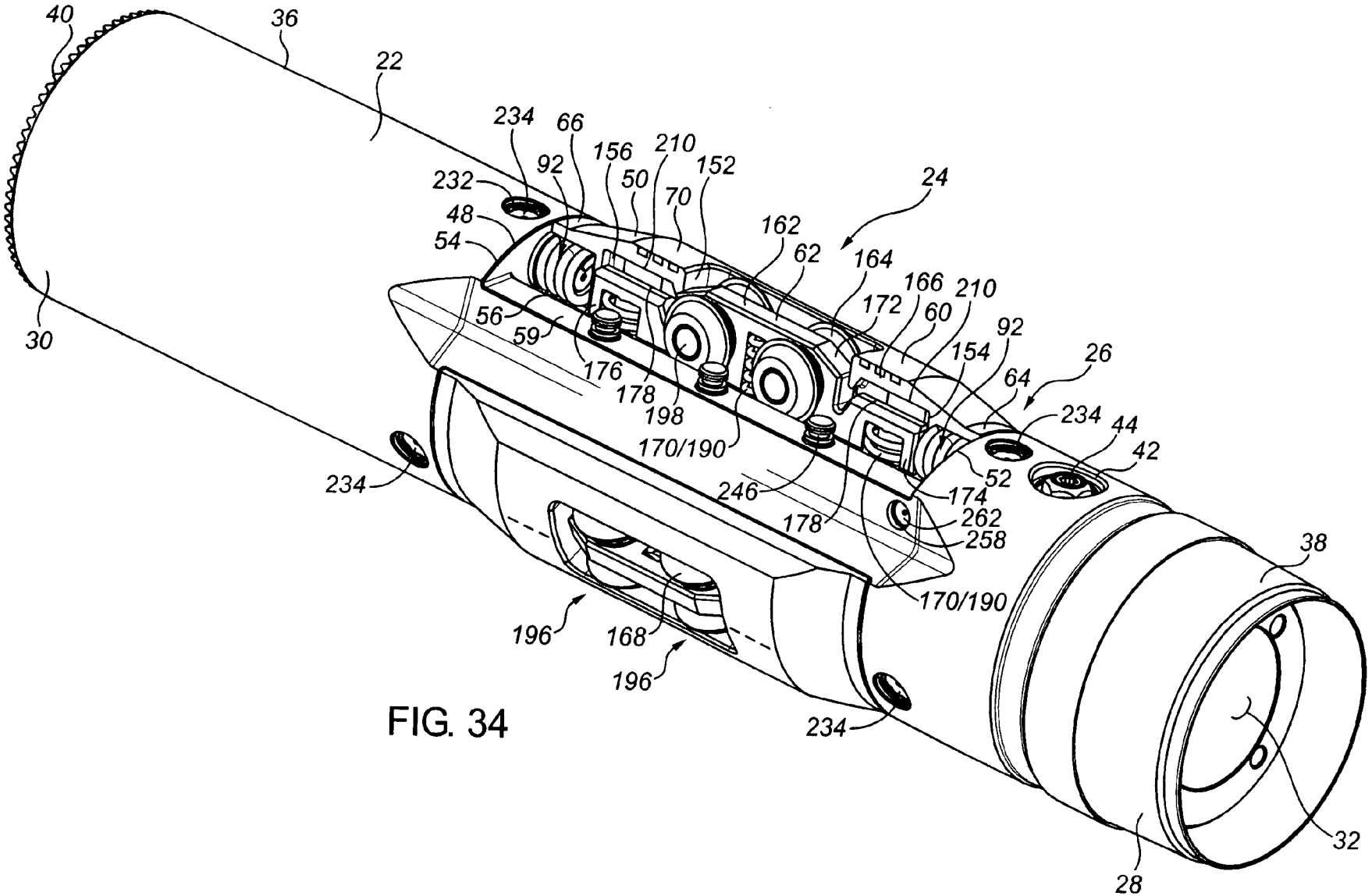
FIG. 34 is a pictorial view of the variable gauge drilling apparatus shown in FIG. 33, wherein the rotation restraining assembly is shown therein in longitudinal section.

FIGS. 20–24 show a first alternate embodiment of the variable gauge drilling apparatus (20), FIGS. 25–29 show a second alternate embodiment of the variable gauge drilling apparatus (20), FIGS. 30–32 show a third alternate embodiment of the variable gauge drilling apparatus (20) and FIGS. 33–42 show a fourth alternate embodiment of the variable gauge drilling apparatus (20). Each of the alternate embodiments is substantially similar to the preferred embodiment as described herein and the same reference numbers are used in the Figures of the alternate embodiments to designate similar or like components or elements. The primary difference between the preferred embodiment and each of the alternate embodiments of the drilling apparatus (20) relates to the securing mechanism (92) for securing the rotation restraining assembly (50) in the pocket (48). The differences relating to the securing mechanism (92), and other differences of particular significance, are detailed below.

Referring to FIGS. 20–24 showing the first alternate embodiment of the drilling apparatus (20), the pocket (48) is provided with a different configuration. Specifically, the pocket (48) is comprised of an indentation or cut away portion of the apparatus housing (22) having first and second ends (52, 54) and a relatively flat bottom surface (58) but no side surfaces (56). In other words, the bottom surface (58) and the flat portions (59) in the preferred embodiment are continuous in this alternate embodiment.

Figure 22:
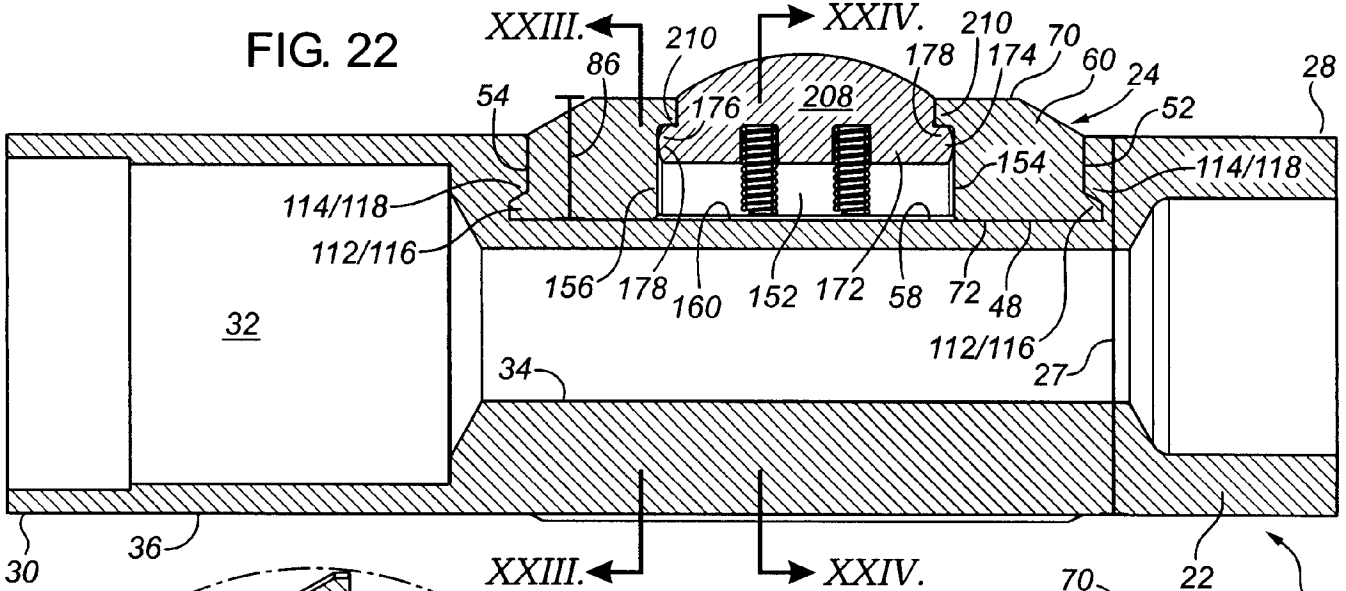
FIG. 22 is a longitudinal sectional view of the variable gauge drilling apparatus shown in FIG. 20.
Figure 24:
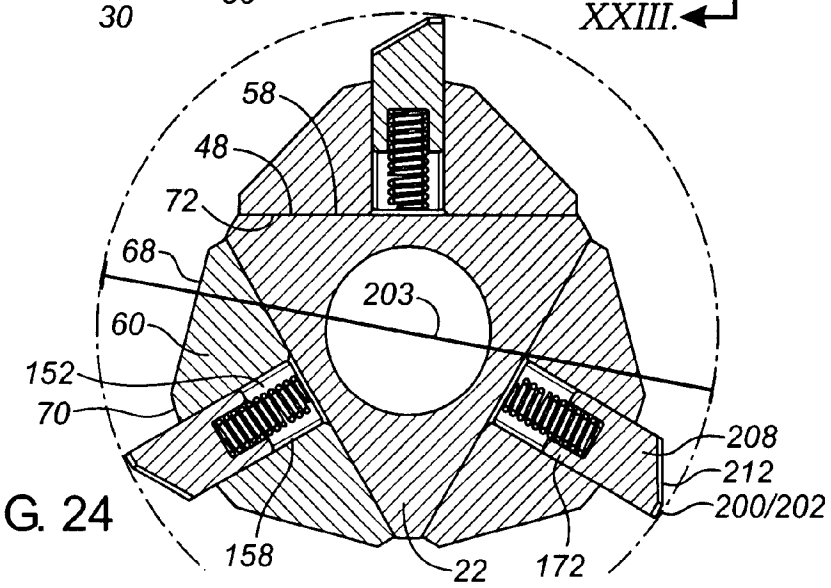
FIG. 24 is a cross-sectional view of the variable gauge drilling apparatus taken along line 24—24 of FIG. 22.
Figure 25:
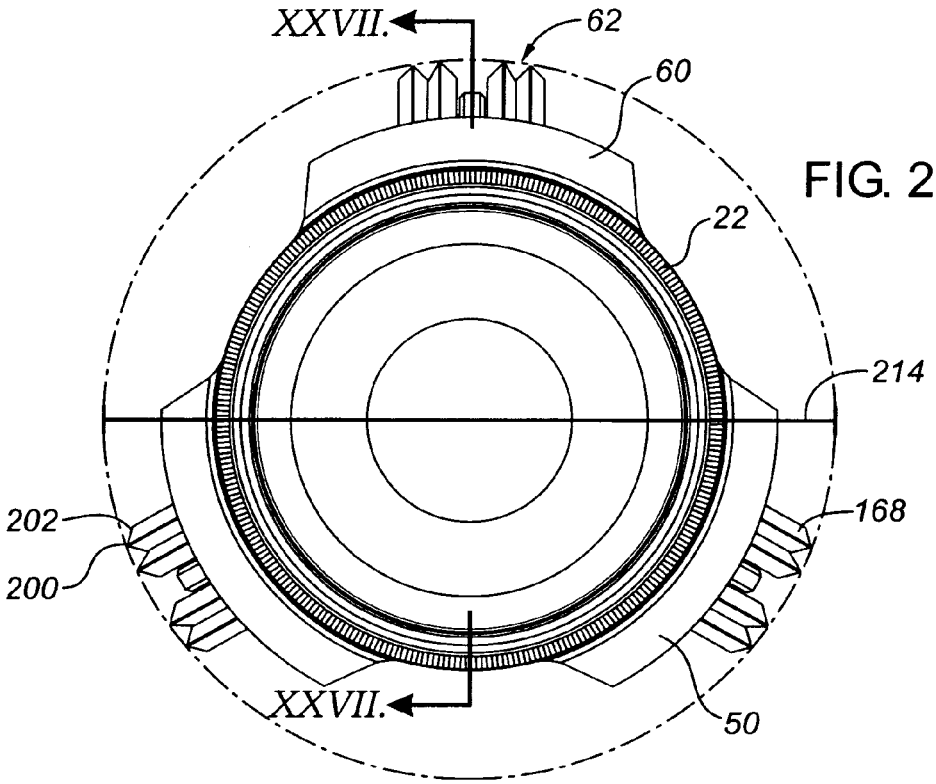
FIG. 25 is an end view of a second alternate embodiment of the variable gauge drilling apparatus comprised of an interchangeable borehole engaging device having a first device size.
Figure 26:
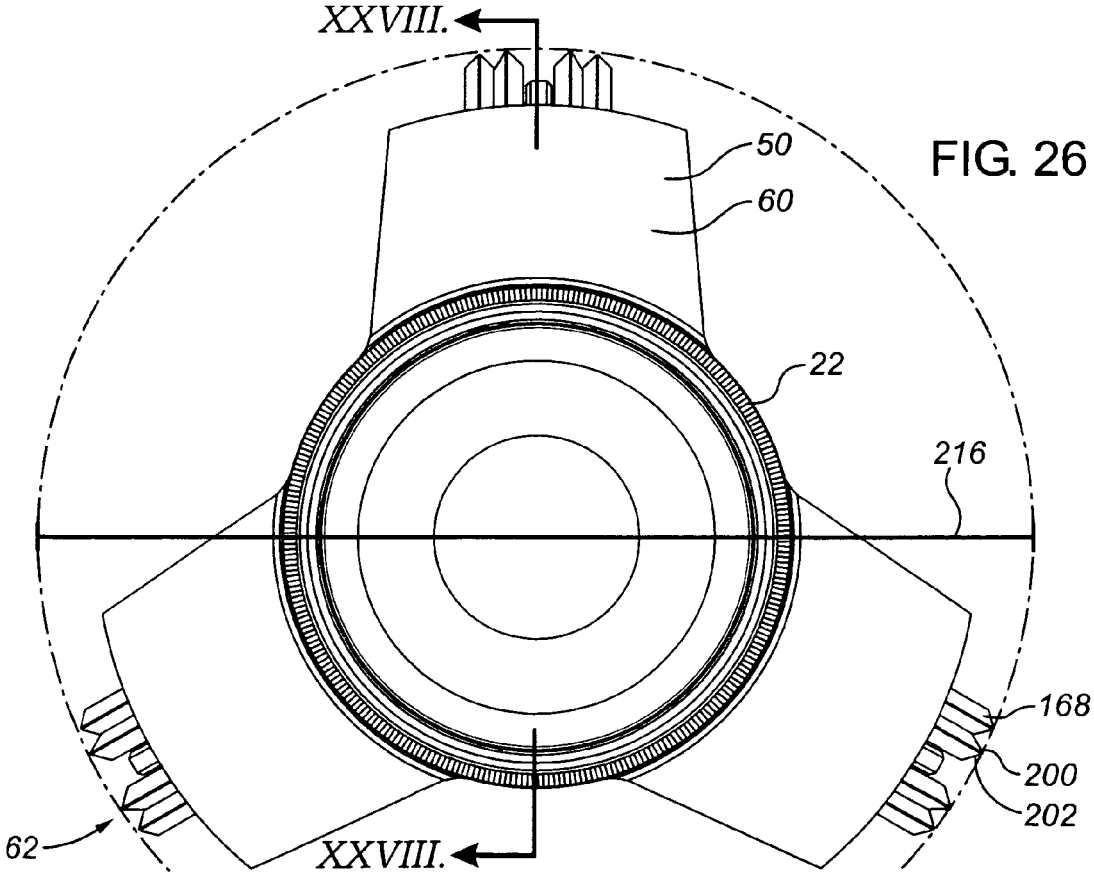
FIG. 26 is an end view of the second alternate embodiment of the variable gauge drilling apparatus comprised of an interchangeable borehole engaging device having a second device size.
Figure 27:
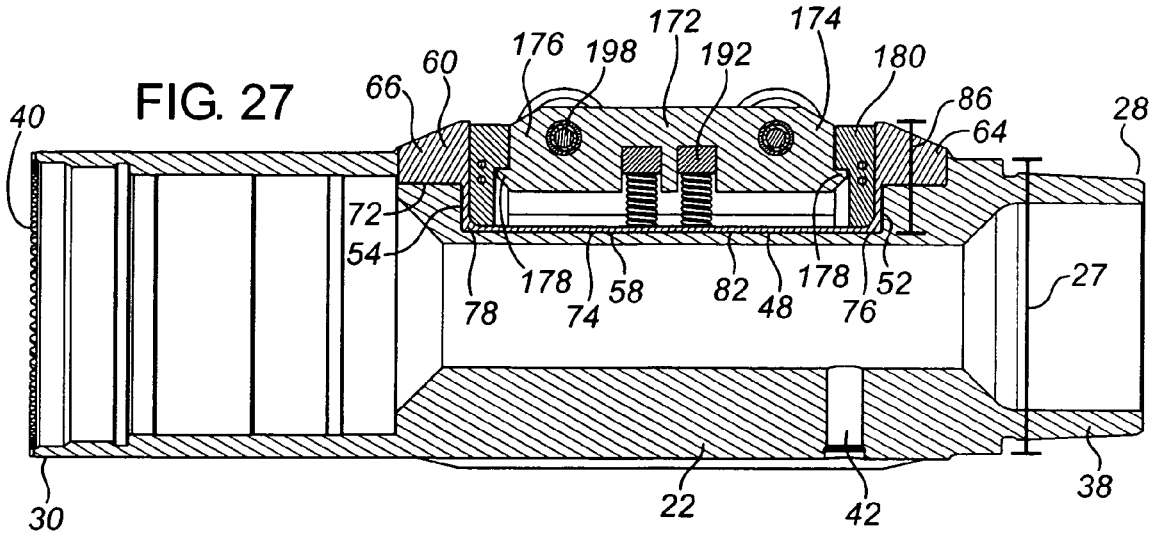
FIG. 27 is a longitudinal sectional view of the variable gauge drilling apparatus taken along line 27—27 of FIG. 25.
Figure 28:
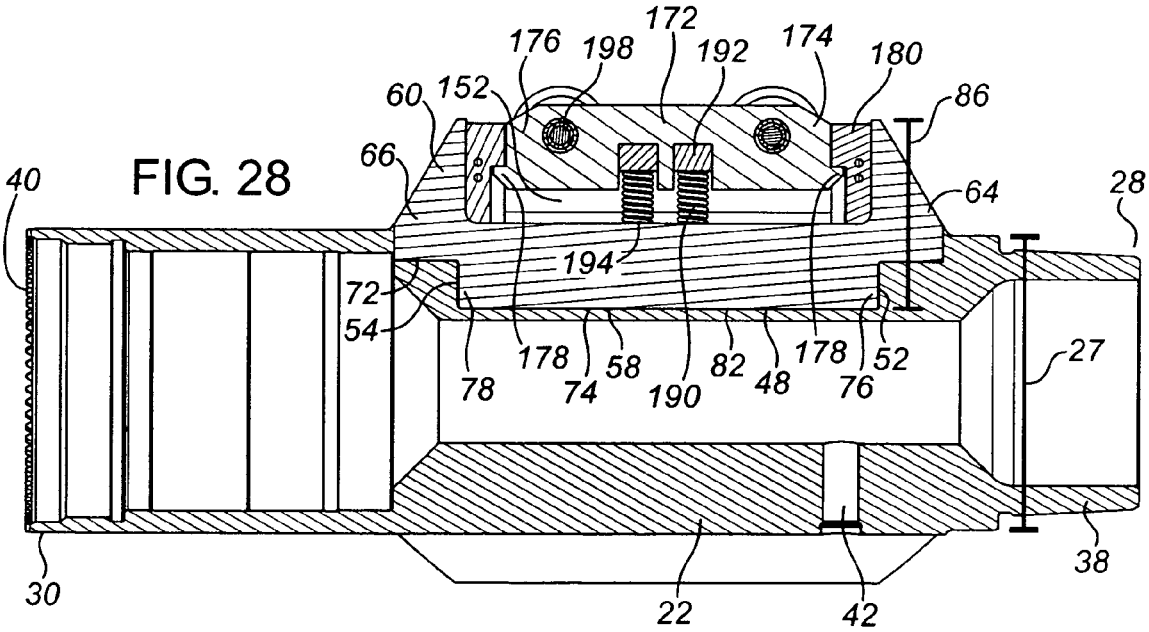
FIG. 28 is a longitudinal sectional view of the variable gauge drilling apparatus taken along line 28—28 of FIG. 26.

Thus, the configuration of the assembly housing (60) also differs in this alternate embodiment from the preferred embodiment so that the assembly housing (60) is compatible with the differing configuration of the pocket (48). Specifically, the assembly housing (60) has first and second ends (64, 66) and opposed side surfaces (68) sloping outwardly from the top surface (70) to the bottom surface (72). However, the assembly housing (60) does not include a projection (74) for receipt in the pocket (48) and further does not include a lip portion (84). Rather, substantially the complete or entire bottom surface (72) of the assembly housing (60) is receivable within the pocket (48) such that the bottom surface (72) of the assembly housing (60) engages the bottom surface (58) of the pocket (48). Further, the Figures show a single assembly housing size. Referring particularly to FIGS. 22 and 24, each of the assembly housings (60) has an assembly housing size (86) which together define a first device size which provides a first drilling apparatus size, as shown by reference number (203), when the rotation restraining device (24) is mounted on the apparatus housing (22).

Figure 23:
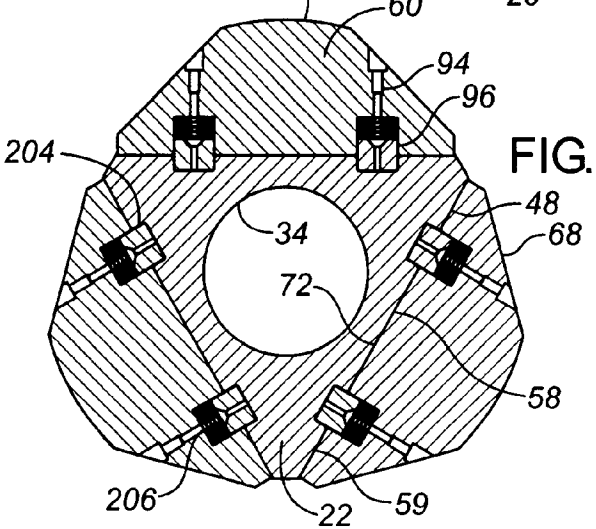
FIG. 23 is a cross-sectional view of the variable gauge drilling apparatus taken along line 23—23 of FIG. 22.

In addition, as in the preferred embodiment, greater than one securing mechanism (92) is provided in this first alternate embodiment. A first securing mechanism (92) is comprised of a plurality of fasteners (94) as shown in FIG. 23. Each fastener (94) extends through an aperture (96) in the assembly housing (60) for receipt in a corresponding aperture (204) in the bottom surface (58) of the pocket (48). In the preferred form of this alternate embodiment, to facilitate the assembly of the drilling apparatus (20), each fastener (94) is comprised of a spring laded locking dowel or pin (206) which is removable by using of a jacking screw.

A second securing mechanism (92) is comprised of an underlying surface (112) defined by the assembly housing (60) and a complementary overlying surface (114) defined by the apparatus housing (22) at each of the ends (64, 66) of the assembly housing (60). Specifically, the first end (64) and the second end (66) of the assembly housing (60) each comprise an underlying surface (112), while the first end (52) and the second end (54) of the pocket (48) each comprise a complementary overlying surface (114). More particularly, each of the underlying surfaces (112) of the first and second ends (64, 66) of the assembly housing (60) is comprised of an overcut angular surface (116), while each of the first and second ends (52, 54) of the pocket (48) is comprised of an undercut angular surface (118). An urging mechanism (120) as described in the preferred embodiment is not required. Rather, the assembly housing (60) is mounted in the pocket (48) and the complementary surfaces (116, 188) are engaged by sliding the assembly housing (60) into the pocket (48) from a side of the pocket (48). Accordingly, this alternate embodiment does not include an axially movable member (122).

As well, the assembly housing (60) defines the compartment (152) therein for receipt of the carriage assembly (162). The compartment (152) has first and second ends (154, 156) and side surfaces (158) but no bottom surface (160). Rather, the carriage assembly (162) acts directly against the bottom surface (58) of the pocket (48). In addition, the rotation restraining member (62) is comprised of the carriage assembly (162) and the borehole engaging element or member (164), however, the borehole engaging element or member (164) is integrally formed with the carriage assembly (162). Specifically, the carriage assembly (162) is comprised of the elongate member (172) having first and second ends (174, 176). The borehole engaging element or member (164), comprised of a blade (208) in this embodiment, is integrally formed with the upper or outer surface of the elongate member (172).

As well, this embodiment does not require the use of a separate or distinct carriage retainer (166). Either, a carriage retainer (166) is not used or it is integrally formed with the assembly housing (60) defining the compartment (152). In either event, the first and second ends (174, 176) of the elongate member (172) directly engage the first and second ends (154, 156) of the compartment (152). Specifically, the outwardly facing engagement shoulder (178) defined by the first and second ends (174, 176) of the elongate member (172) engage against a complementary inwardly facing engagement shoulder (210) defined by each of the first and second ends (154, 156) of the compartment (152). The biasing device (170), comprised of a plurality of springs (190), acts between the elongate member (172) and the bottom surface (58) of the pocket (48) to move the carriage assembly (162) to the extended position. Where the device size varies, by varying the assembly housing size, the size of the springs (190) may be varied, an additional member may be placed between the bottom surface (58) of the pocket (48) and the springs (190) or a bottom surface may be added to the assembly housing (60) so that the springs (190) may act between the elongate member (172) and a bottom surface of the assembly housing (60) as in the preferred embodiment.

Finally, the peripheral surface (200) of the blade (208) is comprised of the engagement surface (202) for engaging the borehole wall. In the preferred embodiment, one or more portions or areas of the blade (208) adjacent the outermost peripheral surface (200) of the blade (208) may be sloped or angled downwardly from the peripheral surface (200) to comprise one or more fluid contact surfaces (212). In addition, the longitudinal orientation of the carriage assembly (162) and integral blade (208) is preferably variable within the compartment (152) of the assembly housing (60). In other words, the blade (208) may be oriented within the compartment (152) to form an angle with the longitudinal axis of the apparatus housing (22). Any mechanism, structure or device may be provided for rotating the blade (208) within the compartment (152) to vary its angle.

Thus, when the blade (208) is angled within the compartment (152), any fluids passing through the borehole may contact the fluid contact surfaces (212). During use of the drilling apparatus (20), there will be a natural tendency for the apparatus housing (22) to rotate in a first direction, typically clockwise. The configuration of the fluid contact surfaces (212) and the angle of the blade (208) may counter or offset this natural tendency by encouraging the apparatus housing (22) to rotate in a second opposite direction, typically counter-clockwise.

Referring to FIGS. 25–29 showing the second alternate embodiment of the drilling apparatus (20) which is similar to the preferred embodiment in many respects. Thus, only the significant or substantial differences will be detailed herein. The assembly housing size differs between FIGS. 25 and 27 and FIGS. 26 and 28. Each of the assembly housings (60) shown in FIGS. 25 and 27 has an assembly housing size (86) which together define a first device size which provides a first drilling apparatus size, as shown by reference number (214), when the rotation restraining device (24) is mounted on the apparatus housing (22). Each of the assembly housings (60) shown in FIGS. 26 and 28 has a different assembly housing size (86) than that shown in FIGS. 25 and 27 which together define a second device size which provides a second drilling apparatus size, as shown by reference number (216), when the rotation restraining device (24) is mounted on the apparatus housing (22).

The primary difference as compared to the preferred embodiment relates to the securing mechanism (92). Specifically, each of the securing mechanisms (92) provided is comprised of at least one fastener (94). This alternate embodiment does not include the underlying surface (112) and the complementary overlying surface (114). Thus, this alternate embodiment does not include the axially movable member (122) and does not include the overcut and undercut angular surfaces (116, 118).

The securing mechanism (92) is comprised of a plurality of fasteners (94) as shown in FIG. 29, preferably a plurality of screws. Each screw (94) extends through an aperture (96) in the assembly housing (60) for receipt in a corresponding aperture (98) in the apparatus housing (22). As well, if desired as an alternative to the screws (94), or in addition to the screws (94) to further secure the assembly housing (60), one or more further types of fasteners (94) may be used such as cam pins and compatible cam locks or locking cams (not shown). For instance, cam pins (not shown) may be associated or mounted with the assembly housing (60), which cam pins are matable or engagable with corresponding cam locks (not shown) extending through the apparatus housing (22) in a manner permitting the cam lock to act upon the cam pin. Thus, each cam lock may be rotated to act upon the cam pin to lock the cam pin in place and thereby secure the assembly housing (60) with the apparatus housing (22).

Referring to FIGS. 30–32 showing the third alternate embodiment of the variable gauge drilling apparatus (20), the pocket (48) is provided with a different configuration which is similar to that shown for the first alternate embodiment. Specifically, the pocket (48) is comprised of an indentation or cut away portion of the apparatus housing (22) having first and second ends (52, 54) and a relatively flat bottom surface (58) but no side surfaces (56). In other words, the bottom surface (58) and the flat portions (59) in the preferred embodiment are continuous in this alternate embodiment.

Thus, the configuration of the assembly housing (60) also differs in this alternate embodiment from the preferred embodiment so that the assembly housing (60) is compatible with the differing configuration of the pocket (48). Specifically, the assembly housing (60) has first and second ends (64, 66) and opposed side surfaces (68) extending between the top surface (70) to the bottom surface (72). However, the assembly housing (60) does not include a projection (74) for receipt in the pocket (48) and further does not include a lip portion (84). Rather, substantially the complete or entire bottom surface (72) of the assembly housing (60) is receivable within the pocket (48) such that the bottom surface (72) of the assembly housing (60) engages the bottom surface (58) of the pocket (48). Further, the Figures show a single assembly housing size. Referring particularly to FIGS. 31–32, each of the assembly housings (60) has an assembly housing size (86) which together define a first device size which provides a first drilling apparatus size, as shown by reference number (218), when the rotation restraining device (24) is mounted on the apparatus housing (22).

In addition, as in the second alternate embodiment, greater than one securing mechanism (92) is provided in this third alternate embodiment. A first securing mechanism (92) is comprised of a plurality of fasteners (94) as shown in FIG. 30. Each fastener (94) extends through an aperture (96) in the assembly housing (60) for receipt in a corresponding aperture (not shown) in the bottom surface (58) of the pocket (48). Further, as shown in FIG. 30, the fasteners (94) are preferably located adjacent or proximate to the first and second ends (64, 66) of the assembly housing (60). As in the second alternate embodiment, to facilitate the assembly of the drilling apparatus (20), each fastener (94) may be comprised of a spring loaded locking dowel or pin which is removable by using a jacking screw.

A second securing mechanism (92) is comprised of an underlying surface (112) defined by the assembly housing (60) and a complementary overlying surface (114) defined by the apparatus housing (22) at each of the ends (64, 66) of the assembly housing (60). Specifically, the first end (64) and the second end (66) of the assembly housing (60) each comprise an underlying surface (112), while the first end (52) and the second end (54) of the pocket (48) each comprise a complementary overlying surface (114). More particularly, each of the underlying surfaces (112) of the first and second ends (64, 66) of the assembly housing (60) is comprised of an overcut angular surface (116), while each of the first and second ends (52, 54) of the pocket (48) is comprised of an undercut angular surface (118). An urging mechanism (120) as described in the preferred embodiment is not required. Rather, the assembly housing (60) is mounted in the pocket (48) and the complementary surfaces (116, 188) are engaged by sliding the assembly housing (60) into the pocket (48) from a side of the pocket (48). Accordingly, this alternate embodiment does not include an axially movable member (122).

As in the second alternate embodiment, the assembly housing (60) defines the compartment (152) therein for receipt of the carriage assembly (162). The compartment (152) has first and second ends (154, 156) and side surfaces (158) but no bottom surface (160). Rather, the carriage assembly (162) acts directly against the bottom surface (58) of the pocket (48). In addition, the rotation restraining member (62) is comprised of the carriage assembly (162) and the borehole engaging element or member (164). The borehole engaging elements or members (164), comprised of rollers (168), are mounted with or carried by the carriage assembly (162) in a similar manner as in the preferred embodiment. The carriage assembly (162) is comprised of the elongate member (172) having first and second ends (174, 176).

As well, this second embodiment also does not require the use of a separate or distinct carriage retainer (166). Either, a carriage retainer (166) is not used or it is integrally formed with the assembly housing (60) defining the compartment (152). In any event, the first and second ends (174, 176) of the elongate member (172) directly engage the apparatus housing (22) adjacent the first and second ends (154, 156) of the compartment (152). Specifically, the outwardly facing engagement shoulder (178) defined by the first and second ends (174, 176) of the elongate member (172) engage against a complementary inwardly facing engagement shoulder or lip (210) defined by each of the first and second ends (154, 156) of the compartment (152). The biasing device (170), comprised of a plurality of springs (190), acts between the elongate member (172) and the bottom surface (58) of the pocket (48) to move the carriage assembly (162) to the extended position. Where the device size varies, by varying the assembly housing size, the size of the springs (190) may be varied, an additional member may be placed between the bottom surface (58) of the pocket (48) and the springs (190) or a bottom surface may be added to the assembly housing (60) so that the springs (190) may act between the elongate member (172) and a bottom surface of the assembly housing (60) as in the preferred embodiment.

Figure 39:
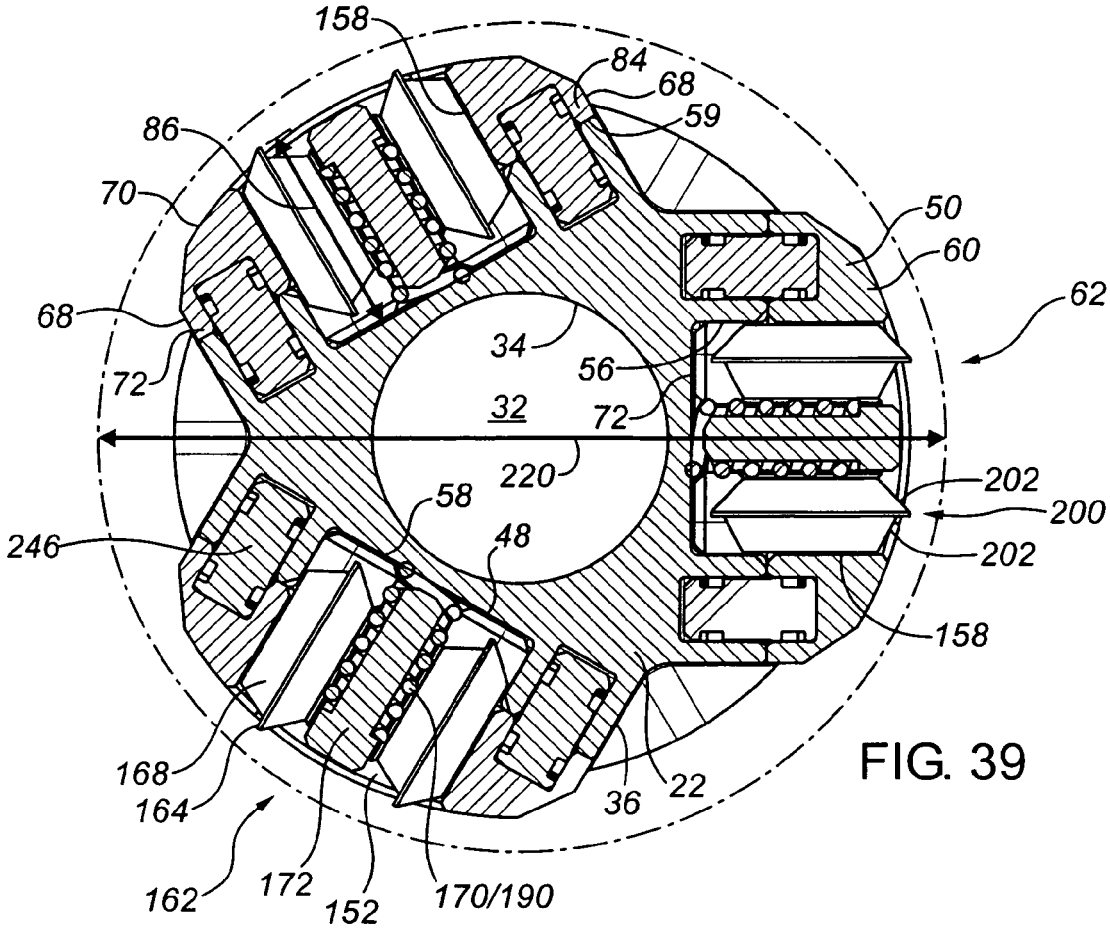
FIG. 39 is a cross-sectional view of the variable gauge drilling apparatus taken along line 39—39 of FIG. 37.

Referring to FIGS. 33–42 showing the fourth alternate embodiment of the variable gauge drilling apparatus (20), the Figures show the rotation restraining member (162) in the retracted position only. Further, the Figures show a single assembly housing size. Referring particularly to FIG. 39, each of the assembly housings (60) has an assembly housing size (86) which together define a first device size which provides a first drilling apparatus size, as shown by reference number (220), when the rotation restraining device (24) is mounted on the apparatus housing (22) and each rotation restraining member (62) is in an extended position. As indicated, the rotation restraining members (62) are shown in the retracted position in FIG. 39. However, the anticipated outermost circumference or perimeter of the rotation restraining members (62) when in the extended position is shown by the circular broken line in FIG. 39, which accordingly defines the first drilling apparatus size (220).

The primary difference between the fourth alternate embodiment and the preferred embodiment relates to the securing mechanism (92). Specifically, the securing mechanism (92) is comprised of at least one fastener (94) and preferably a plurality of fasteners (94). More particularly, each fastener (94) is comprised of a dowel (222) or pin extending between opposed or adjacent surfaces of the assembly housing (60) and the apparatus housing (22), particularly the pocket (48) defined thereby, as described further below. This fourth alternate embodiment does not include the underlying surface (112) and the complementary overlying surface (114). Thus, this alternate embodiment does not include the axially movable member (122) and does not include the overcut and undercut angular surfaces (116, 118).

As indicated, the securing mechanism (92) is comprised of a plurality of dowels (222), and preferably two dowels (222), as shown in FIGS. 35, 36, 38 and 42. The dowels (222) may extend between any opposed or adjacent surfaces of the assembly housing (60) and the apparatus housing (22) when the assembly housing (60) is positioned within its respective pocket (48). More particularly, the dowels (222) preferably extend between opposed or adjacent surfaces of the assembly housing (60) and the pocket (48). In addition, the dowels (222) are preferably positioned at opposed ends of the assembly housing (60) such that securing mechanism (92) acts upon or engages the assembly housing (60) at its first and second ends (64, 66).

In this alternate embodiment, the first and second ends (64, 66) of the assembly housing (60) terminate at or in proximity to the first and second ends (76, 78) of the projection (74) respectively such that the first and second ends (64, 66) of the assembly housing (60) do not extend beyond the first and second ends (52, 54) of the pocket (48). One dowel (222) is located or positioned to extend between the first end (64) of the assembly housing (60), also being the first end (76) of the projection (74), and the adjacent first end (52) of the pocket (48). The other dowel (222) is located or positioned to extend between the second end (66) of the assembly housing (60), also being the second end (78) of the projection (74), and the adjacent second end (54) of the pocket (48).

More particularly, each dowel (222), which may also be referred to as an expansion piston, may be comprised of any reciprocally movable dowel or pin such that the dowel (222) may be moved between an extended position, in which the rotation restraining assembly (50) is secured within the pocket (48) by the dowel (222), and a retracted position, in which the rotation restraining assembly (50) may be placed within or removed from the pocket (48). Each dowel (222) is positioned or aligned to reciprocate axially or along the longitudinal axis of the rotation restraining assembly (50). When in the extended or expanded position or condition, each dowel (222) extends from the rotation restraining assembly (50) for engagement with the pocket (48). When in the retracted or unexpanded position or condition, each dowel (222) is withdrawn from engagement with the pocket (48).

Preferably, each dowel (222) has an inner end (224) for receipt in or engagement with an end (64, 66) of the assembly housing (60) and an outer end (226) for receipt in or engagement with an end (52, 54) of the pocket (48). Further, each of the first and second ends (64, 66) of the assembly housing (60) preferably defines a chamber (228) for receiving the inner end (224) of the dowel (222). A biasing mechanism (230) is preferably associated with the dowel (222) for urging the dowel (222) axially out of the chamber (228) to extend from the end (64, 66) of the assembly housing (60). Any biasing mechanism (230) may be used, however, preferably at least one spring is located within the chamber (228) to act upon the dowel (222).

As well, each of the first and second ends (52, 54) of the pocket (48) preferably defines a chamber (232) for receiving the outer end (226) of the dowel (222). Thus, when the rotation restraining assembly (50) is received in the pocket (48), the spring (230) urges the dowel (222) axially away from the assembly housing (60) such that the outer end (226) of each dowel (222) is received within the corresponding chamber (232) defined by each end (52, 54) of the pocket (48). Accordingly, the dowels (222) are in the extended position such that the rotation restraining assembly (50) is secured within the pocket (48).

In order to permit the removal of the rotation restraining assembly (50) from the pocket (48), a release mechanism (234) is preferably provided for releasing or withdrawing the dowel (222) such that the dowel (222) moves longitudinally or axially in an opposed direction to the retracted position or condition. The release mechanism (234) moves or urges the dowel (222) axially towards the end (64, 66) of the assembly housing (60) and into the chamber (228). The release mechanism (234) may be positioned at any location in which it is capable of acting upon the dowel (222) in the desired manner. Preferably, the chambers (232) defined by the first and second ends (52, 54) of the pocket (48) extend to the exterior surface (36) of the apparatus housing (22) for access thereto. Further, a release mechanism (234) is preferably positioned or located within each of the chambers (232) such that the release mechanism (234) may be actuated from the exterior of the apparatus housing (22) to act upon the dowel (222) to cause its withdrawal from the chamber (232), thereby releasing the assembly housing (60).

Although any release mechanism (234) may be used, each release mechanism (234) is preferably comprised of an inner release wedge or member (236) defining an angled or sloped surface (240) and an outer release wedge or member (238) defining a compatible angled or sloped surface (240). The inner release wedge (236) is located in the chamber (232) adjacent the end (52 or 54) of the pocket (48), while the outer release wedge (238) is located in the chamber (232) adjacent the exterior surface (36) of the apparatus housing (22). When the compatible angled sloped surfaces (240) are engaged, depression of the outer release wedge (238) through the exterior surface (36) of the apparatus housing (22) causes the inner release wedge (236) to engage and act upon the outer end (226) of the dowel (222) to axially move the dowel (222) toward the retracted position. The outer release wedge (238) is preferably maintained within the chamber (232) by a retaining ring (242) and one or more springs (244) such as a wave spring. The inner release wedge (236) is maintained within the chamber (232) by the action of the biasing mechanism (230) which urges the outer end (226) of the dowel (222) into contact with the inner release wedge (236).

Figure 40:
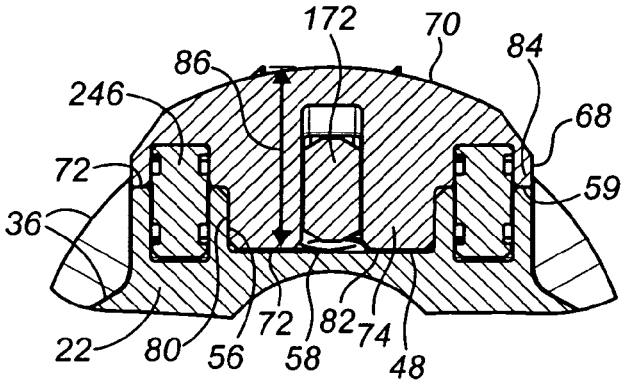
FIG. 40 is a cross-sectional view of a portion of the variable gauge drilling apparatus taken along line 40—40 of FIG. 37.

In addition, the action of the securing mechanism (92) as described above may be aided or facilitated by the use of one or more differential plugs (246) between the rotation restraining assembly (50) and the device mount (26). Specifically, a plurality of pressure differential plugs (246) are positioned between the assembly housing (60) and the apparatus housing (22). Preferably, the differential plugs (246) extend between the lip portion (84) of the assembly housing (60) and the flat portion (59) of the exterior surface (36) of the apparatus housing (22) adjacent the pocket (48) as shown in FIGS. 39 and 40. The differential plugs (246) create a differential area between the top surface (70) of the assembly housing (60) and the bottom surface (72) of the assembly housing (60) so that a pressure acting upon the assembly housing (60) applies a differential force to the assembly housing (60) to further secure the assembly housing (60) with the apparatus housing (22).

Further, in this embodiment, as indicated previously, the assembly housing (60) has the first end (64) and the opposed second end (66), opposed side surfaces (68), the top surface (70) and the opposed bottom surface (72). The bottom surface (72) of the assembly housing (60) is comprised of or defines the projection (74) which is configured to be compatible with or to correspond to the pocket (48) such that the projection (74) is receivable within the pocket (48).

In this alternate embodiment, the projection (74) is preferably comprised of two projection portions, being a first projection portion (248) and a second projection portion (250), which are each configured for receipt in the pocket (48). The first and second projection portions (248, 250) are located adjacent the first and second ends (64, 66) respectively. Thus, the first projection portion (248) defines the first end (76) of the projection (74), while the second projection portion (250) defines the second end (78) of the projection (74). Further, the first and second projection portions (248, 250) together define or provide the opposed side surfaces (80) and the bottom surface (82) which comprises a portion of the bottom surface (72) of the assembly housing (60). In other words, the projection (74) is not continuous between the first and second ends (76, 78) of the projection (74), but rather or space or gap is provided between the first and second projection portions (148, 150) which defines, at least in part, the compartment (152) in the assembly housing (60) for receiving the rotation restraining member (62).

Referring to FIGS. 33–36 and 41–42, either or both of the first and second ends (76, 78) of the projection (74) defines at least one angled or sloped surface (252) which angles inwardly from the side surface (80) towards its respective end (76 or 78). In the preferred alternate embodiment, each of the first and second ends (76, 78) of the projection (74) defines two opposed angled or sloped surfaces (252). In order to minimize or decrease the amount of vibration which may be experienced by the assembly housing (60) within the pocket (48) during use of the drilling apparatus (20), at least one wedge (254) is provided for acting with one of the angled surfaces (252) for dampening or decreasing the vibration. Specifically, the wedge (254) defines an angled or sloped surface (256) which is compatible for engagement with the angle surface (252) of the projection (74).

Figure 41:
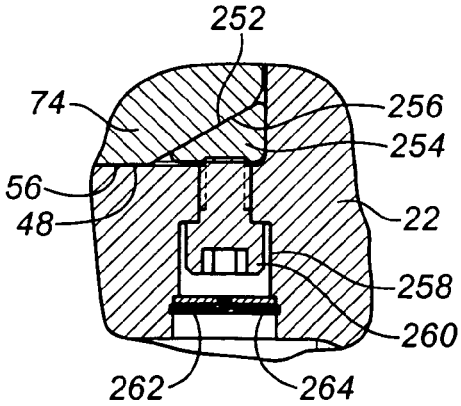
FIG. 41 is a sectional view of a portion of the variable gauge drilling apparatus taken along line 41—41 of FIG. 38.
Figure 42:
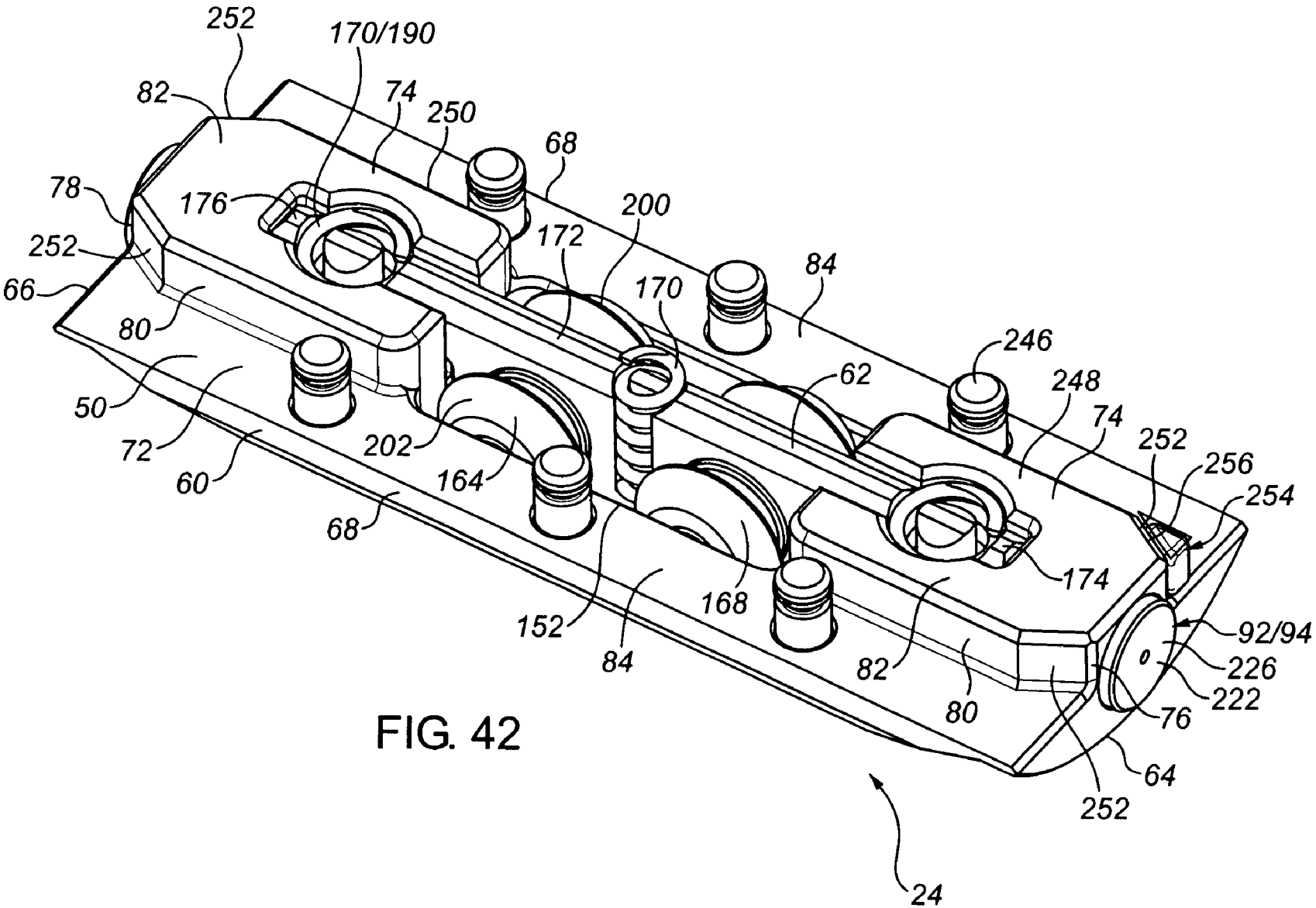
FIG. 42 is a bottom view of the rotation restraining assembly as shown in FIG. 33.

Specifically, the wedge (254) is placed within the pocket (48) between the side surface (56) of the pocket (48) and one of the sloped surfaces (252) of the projection (74). Urging of the wedge (254) toward the projection (74) causes the engagement of the compatible sloped surfaces (252, 256) to more securely maintain the projection (74) within the pocket (48) and decrease any movement of the projection (74) within the pocket (48). The wedge (254) may be urged or biased towards the projection (74) in any manner and using any mechanism capable of urging the wedge (254) in the desired direction. However, preferably, the apparatus housing (22) defines at least one orifice or passage (258) from the exterior surface (36) of the apparatus housing (22) to the side surface (56) of the pocket (48) adjacent the wedge (254) location. A screw (260) or other suitable fastener extends through the passage (258) such that an end engages the wedge (254) as shown in FIG. 41. Thus, tightening of the screw (260) within the passage (258) moves the end of the screw (26) into engagement with the wedge (254) and thereby moves the wedge (254) toward the projection (74). The outermost end of the passage (258) adjacent the exterior surface (36) of the apparatus housing (22) may include a flow cover (262) for inhibiting the flow of fluids into the passage (258), which flow cover (262) is preferably held in position by a retaining ring (264). Although the Figures of the alternate embodiment show the use of only one wedge (254), as many as four wedges (254) may be used. In this case, a corresponding passage (258) would be provided at each desired wedge (254) location.

Further, in this alternate embodiment, the assembly housing (60) defines the compartment (152) therein for receipt of the carriage assembly (162). The compartment (152) has first and second ends (154, 156) and side surfaces (158) but no bottom surface (160). Rather, the carriage assembly (162) acts directly against the bottom surface (58) of the pocket (48).

The rotation restraining member (62) is comprised of the carriage assembly (162) and the borehole engaging element or member (164). The borehole engaging elements or members (164), comprised of rollers (168), are mounted with or carried by the carriage assembly (162) in a similar manner as in the preferred embodiment. The carriage assembly (162) is comprised of the elongate member (172) having first and second ends (174, 176). However, this embodiment does not require the use of a separate or distinct carriage retainer (166). Either, a carriage retainer (166) is not used or it is integrally formed with the assembly housing (60) defining the compartment (152).

More particularly, the first and second ends (174, 176) of the elongate member (172) directly engage the first and second ends (154, 156) of the compartment (152). Specifically, the outwardly facing engagement shoulder (178) defined by the first and second ends (174, 176) of the elongate member (172) engage against a complementary inwardly facing engagement shoulder (210) defined by each of the first and second ends (154, 156) of the compartment (152). Abutment of the outwardly facing engagement shoulder (178) with the complementary inwardly facing engagement shoulder (210) prevents or inhibits further radial or outward movement of the carriage assembly (162).

Figure 35:
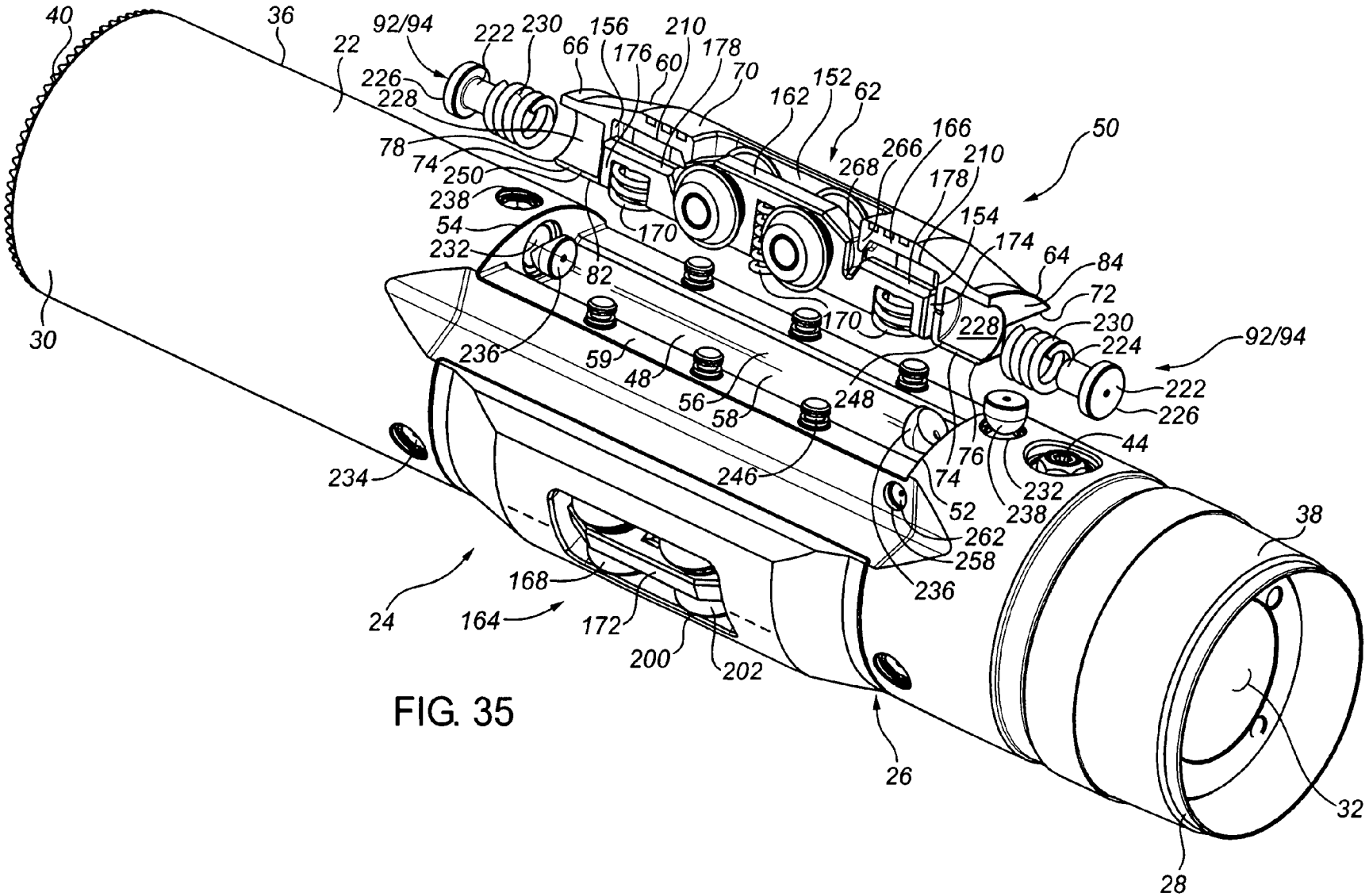
FIG. 35 is a partial exploded pictorial view of the variable gauge drilling apparatus as shown in FIG. 34.
Figure 36:
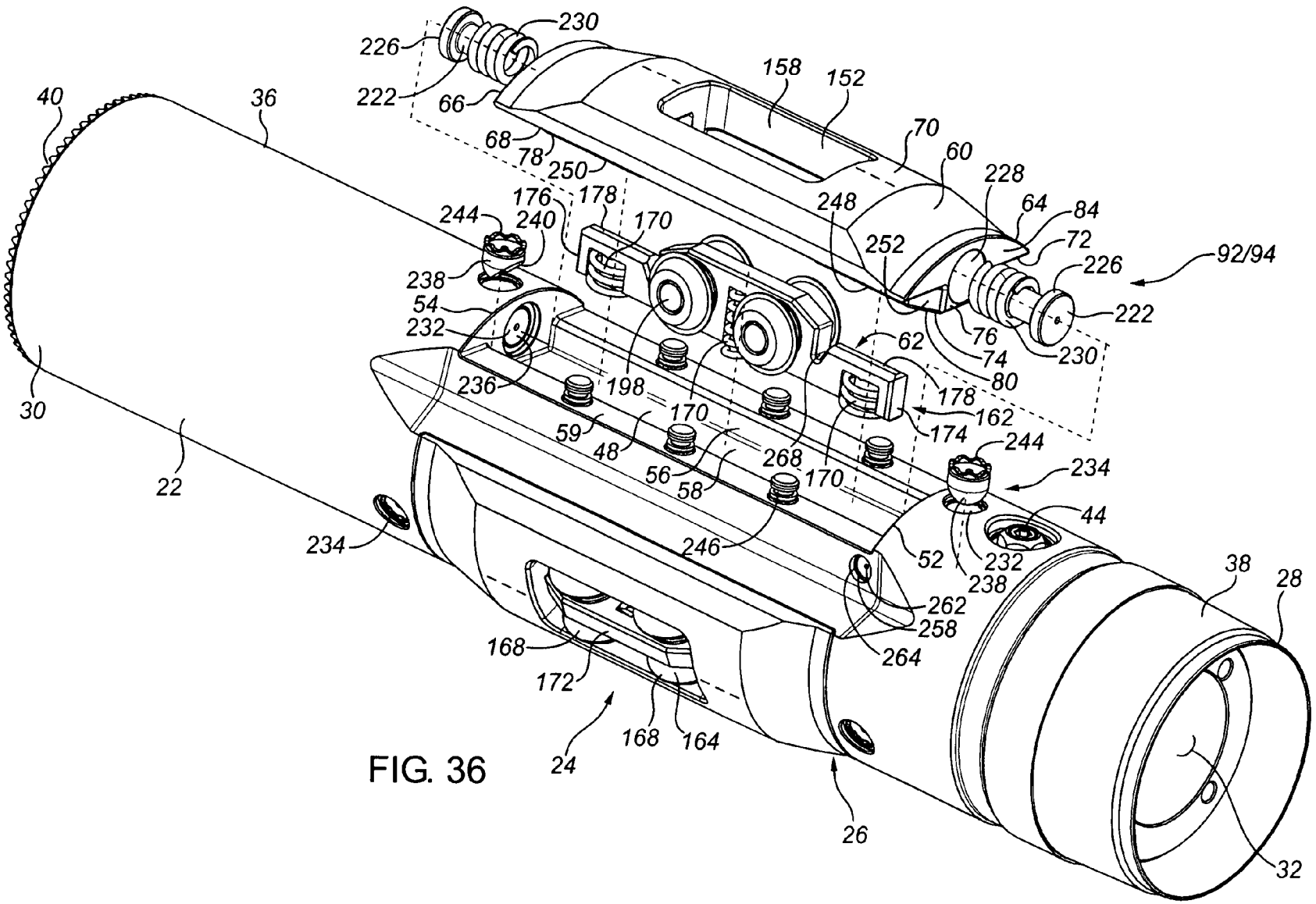
FIG. 36 is an exploded pictorial view of the variable gauge drilling apparatus shown in FIG. 33.
Figure 37:
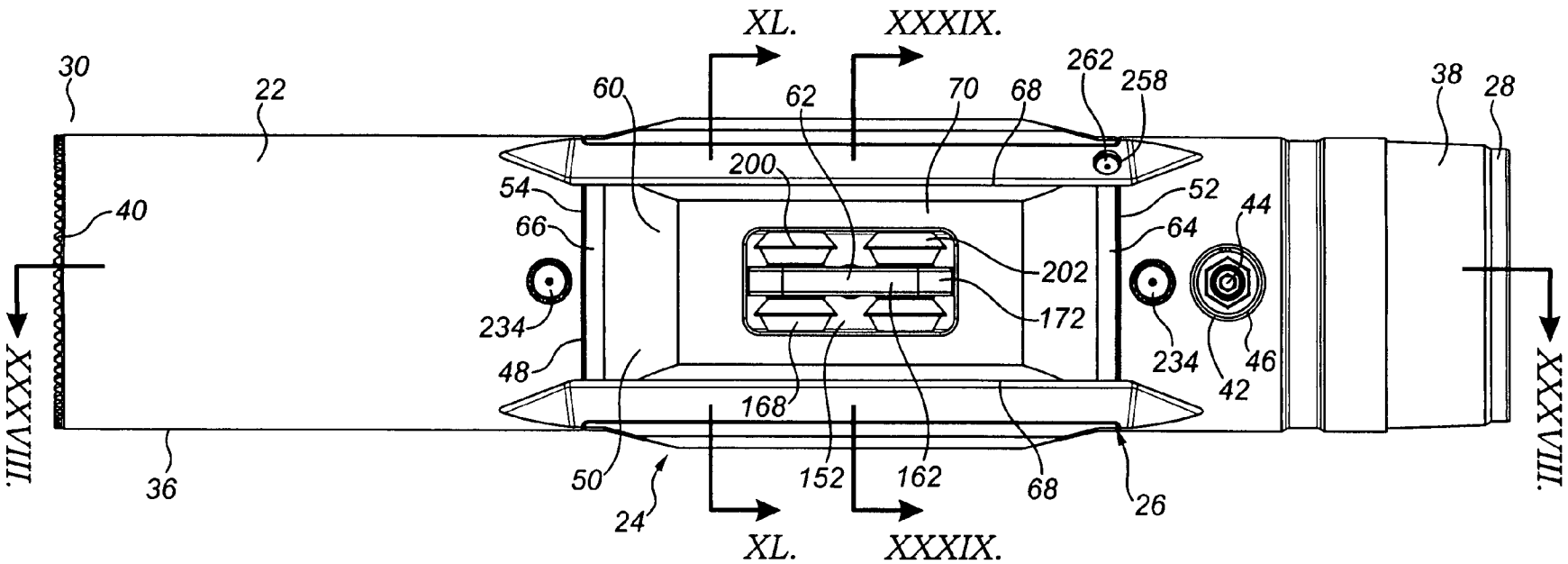
FIG. 37 is a side view of the variable gauge drilling apparatus shown in FIG. 33.
Figure 38:
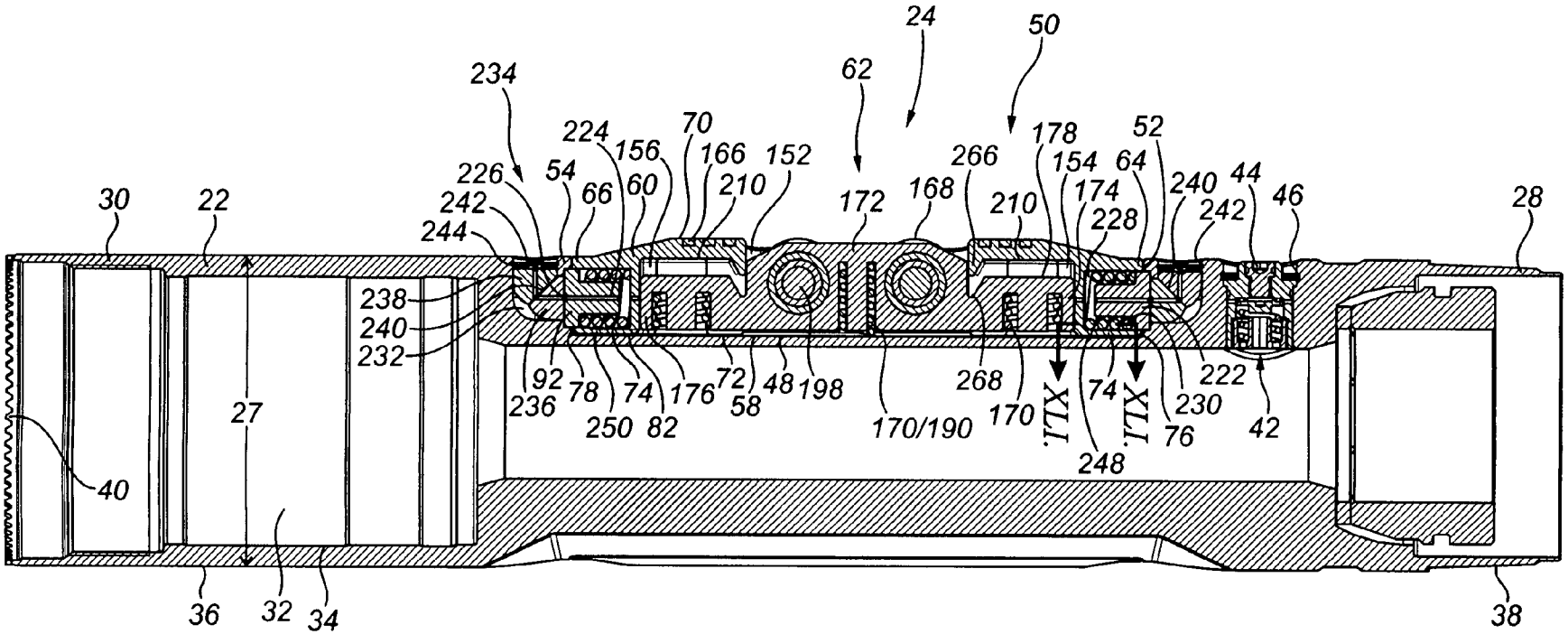
FIG. 38 is a longitudinal sectional view of the variable gauge drilling apparatus taken along line 38—38 of FIG. 37.

Further, as shown in FIG. 35, the outwardly facing engagement shoulder (178) and the inwardly facing engagement shoulder (210) may further comprise or define a structure or mechanism which further prevents or inhibits the longitudinal or axial movement of the carriage assembly (162) within the compartment (152). For instance, as shown in FIG. 35, each inwardly facing engagement shoulder (210) comprises a projection (266) or extension which extends from the inwardly facing engagement shoulder (210) towards the elongate member (172). Each outwardly facing engagement shoulder (178) comprises or defines a compatible slot (268) or receptacle for receiving the projection (266) therein as the outwardly and inwardly facing engagement shoulders (178, 210) move into abutment. Receipt of the projection (166) in the corresponding slot (268) prevents or inhibits any longitudinal or axial movement of the carriage assembly (162).

Finally, the biasing device (170), comprised of a plurality of springs (190), acts between the elongate member (172) and the bottom surface (58) of the pocket (48) to move the carriage assembly (162) to the extended position. Where the device size varies, by varying the assembly housing size, the size of the springs (190) may be varied, an additional member may be placed between the bottom surface (58) of the pocket (48) and the springs (190) or a bottom surface may be added to the assembly housing (60) so that the springs (190) may act between the elongate member (172) and a bottom surface of the assembly housing (60) as in the preferred embodiment.

The embodiments of the invention in which an exclusive property or privilege is claimed are defined as follows:

1. A variable gauge drilling apparatus comprising:

(a) an apparatus housing having a housing size which is suitable for insertion in a subject borehole which has a subject borehole size within a design range of borehole sizes;

(b) a plurality of interchangeable borehole engaging devices having different device sizes for mounting on the apparatus housing to provide the drilling apparatus with a drilling apparatus size within a range of drilling apparatus sizes, wherein the range of drilling apparatus sizes is compatible for use of the drilling apparatus within the design range of borehole sizes, wherein the plurality of interchangeable borehole engaging devices is comprised of a plurality of interchangeable rotation restraining devices; and (c) a universal borehole engaging device mount located on the apparatus housing, wherein the mount is configured to accept for mounting any one of the plurality of interchangeable borehole engaging devices, wherein the mount is comprised of a pocket defined by an exterior surface of the apparatus housing;

wherein each of the plurality of interchangeable rotation restraining devices is comprised of a rotation restraining assembly for mounting in the pocket, wherein the rotation restraining assembly is comprised of an assembly housing and a rotation restraining member connected with the assembly housing, wherein the assembly housing has an assembly housing size and wherein the assembly housing size defines the device size.

2. The drilling apparatus as claimed in claim 1, further comprising a securing mechanism for securing the rotation restraining assembly in the pocket.

3. The drilling apparatus as claimed in claim 2 wherein the rotation restraining member is comprised of a plurality of rollers.

4. The drilling apparatus as claimed in claim 3 wherein the rotation restraining member is capable of movement between a retracted position and an extended position.

5. The drilling apparatus as claimed in claim 4 wherein the rotation restraining assembly is further comprised of a biasing device for biasing the rotation restraining member toward the extended position.

6. The drilling apparatus as claimed in claim 2 wherein each of the plurality of interchangeable rotation restraining devices is comprised of a plurality of rotation restraining assemblies and wherein the mount is comprised of a plurality of pockets.

7. The drilling apparatus as claimed in claim 6 wherein the securing mechanism is comprised of at least one fastener.

8. The drilling apparatus as claimed in claim 7 wherein the securing mechanism is comprised of a plurality of fasteners.

9. The drilling apparatus as claimed in claim 6 wherein the securing mechanism is comprised of at least one underlying surface on the rotation restraining assembly and at least one complementary overlying surface on the mount.

10. The drilling apparatus as claimed in claim 9 wherein the securing mechanism is comprised of a plurality of underlying surfaces on the rotation restraining assembly and a plurality of complementary overlying surfaces on the mount.

11. The drilling apparatus as claimed in claim 10 wherein the mount is further comprised of an axially movable member positioned on the apparatus housing and wherein the axially movable member is axially movable in a securing direction toward a securing position in which the axially movable member overlies the rotation restraining assembly so that one of the plurality of overlying surfaces on the mount is comprised of the axially movable member.

12. The drilling apparatus as claimed in claim 11 wherein the axially movable member is comprised of a ring which surrounds the apparatus housing.

13. The drilling apparatus as claimed in claim 11 wherein one of the plurality of underlying surfaces on the rotation restraining assembly is comprised of an overcut angular surface on the rotation restraining assembly and wherein one of the overlying surfaces on the mount is comprised of a complementary undercut angular surface on the mount.

14. The drilling apparatus as claimed in claim 13 wherein the securing mechanism is further comprised of an urging mechanism for urging into engagement the overcut angular surface and the undercut angular surface.

15. The drilling apparatus as claimed in claim 14 wherein the urging mechanism is comprised of the axially movable member and wherein the overcut angular surface and the undercut angular surface are urged into engagement by axial movement of the axially movable member in the securing direction.

16. The drilling apparatus as claimed in claim 15 wherein the axially movable member is comprised of an urging shoulder for engaging the rotation restraining assembly and wherein the urging mechanism is comprised of the urging shoulder.

17. The drilling apparatus as claimed in claim 16 wherein the axially movable member is comprised of an abutment ring which surrounds the apparatus housing and a locking ring which surrounds the apparatus housing.

18. The drilling apparatus as claimed in claim 17 wherein the abutment ring is axially positioned between the locking ring and the rotation restraining assembly.

19. The drilling apparatus as claimed in claim 18 wherein the abutment ring is slidably positioned on the apparatus housing and wherein the locking ring is threadably connected with the apparatus housing.

20. The drilling apparatus as claimed in claim 19 wherein the abutment ring is relatively more deformable than both the rotation restraining assembly and the locking ring.

21. The drilling apparatus as claimed in claim 19 wherein the abutment ring is comprised of at least one arm extending axially in the securing direction such that when the axially movable member is in the securing position, at least a portion of the arm is axially aligned with at least one of the plurality of rotation restraining assemblies so that rotation of the abutment ring relative to the apparatus housing is inhibited by at least one of the plurality of rotation restraining assemblies.

22. The drilling apparatus as claimed in claim 21 wherein each of the plurality of pockets is axially aligned.

23. The drilling apparatus as claimed in claim 22 wherein the abutment ring is comprised of a plurality of arms extending axially in the securing direction such that when the axially movable member is in the securing position at least a portion of each of the arms is axially aligned with each of the plurality of rotation restraining assemblies.

24. The drilling apparatus as claimed in claim 6 wherein each of the rotation restraining members is comprised of a plurality of rollers.

25. The drilling apparatus as claimed in claim 24 wherein each of the rotation restraining members is capable of movement between a retracted position and an extended position.

26. The drilling apparatus as claimed in claim 25 wherein each of the plurality of rotation restraining assemblies is further comprised of a biasing device for biasing the rotation restraining members toward the extended position.

27. A method for assembling a variable gauge drilling apparatus for insertion in a subject borehole, wherein the subject borehole has a subject borehole size within a design range of borehole sizes, the method comprising the following steps:

(a) selecting an apparatus housing having a housing size which is suitable for insertion in the subject borehole;

(b) selecting a selected rotation restraining device from a plurality of interchangeable rotation restraining devices having different device sizes so that the selected rotation restraining device will provide the drilling apparatus with a selected drilling apparatus size within a range of drilling apparatus sizes, wherein the range of drilling apparatus sizes is compatible for use of the drilling apparatus within the design range of borehole sizes and wherein the selected drilling apparatus size is compatible for use of the drilling apparatus within the subject borehole; and (c) mounting the selected rotation restraining device on the apparatus housing using a universal rotation restraining device mount located on the apparatus housing.

wherein each of the plurality of interchangeable rotation restraining devices is comprised of a rotation restraining assembly, wherein the rotation restraining assembly is comprised of an assembly housing and a rotation restraining member connected with the assembly housing, wherein the assembly housing has an assembly housing size, wherein the assembly housing size defines the device size and wherein the selecting step (b) is comprised of selecting the selected rotation restraining device having the assembly housing size to provide the drilling apparatus with the selected drilling apparatus size.

28. The method as claimed in claim 27 wherein the apparatus housing is selected so that the housing size is smaller than the borehole size to an extent sufficient to prevent blockage of a clearance space between the apparatus housing and the borehole during use of the drilling apparatus.

29. The method as claimed in claim 27 wherein the selected rotation restraining device is selected so that the selected drilling apparatus size is approximately equal to the borehole size.

30. The method as claimed in claim 27 wherein the selected rotation restraining device is selected to provide a selected drilling apparatus size such that the rotation restraining device will engage the borehole during use of the drilling apparatus to inhibit rotation of the apparatus housing relative to the borehole.

31. The method as claimed in claim 27, further comprising the following steps:

(d) selecting a second selected rotation restraining device from the plurality of interchangeable rotation restraining devices having different device sizes so that the second selected rotation restraining device will provide the drilling apparatus with a second selected drilling apparatus size which is compatible for use of the drilling apparatus within a second subject borehole, wherein the second subject borehole has a second subject borehole size which is within the design range of borehole sizes but which is different from the subject borehole size, and wherein the selecting step (d) is comprised of selecting the second selected rotation restraining device having the assembly housing size to provide the drilling apparatus with the second selected drilling apparatus size; and (e) mounting the second selected rotation restraining device on the apparatus housing using the universal rotation restraining device mount.

* * * * *